United States Patent [19]

Asari et al.

[11] Patent Number: 4,720,256

[45] Date of Patent: Jan. 19, 1988

[54] HOT ISOSTATIC PRESS APPARATUS

[75] Inventors: Akira Asari, Ohsaka; Tsuneharu Masuda; Masanori Kurita, both of Kobe; Tsuneya Ueno, Hyogo, all of Japan

[73] Assignee: Kabushiki Kaisha Kobe Seiko Sho, Kobe, Japan

[21] Appl. No.: 751,593

[22] Filed: Jul. 3, 1985

[30] Foreign Application Priority Data

| | | | |
|---|---|---|---|
| Jul. 10, 1984 | [JP] | Japan | 59-143809 |
| Sep. 19, 1984 | [JP] | Japan | 59-197492 |
| Sep. 19, 1984 | [JP] | Japan | 59-197493 |
| Nov. 12, 1984 | [JP] | Japan | 59-171400[U] |
| Nov. 13, 1984 | [JP] | Japan | 59-239090 |
| Nov. 13, 1984 | [JP] | Japan | 59-239089 |

[51] Int. Cl.[4] ..... B30B 9/28

[52] U.S. Cl. ..... 425/405 H; 419/49; 425/73; 425/78

[58] Field of Search ..... 425/73, 74, 77, 78, 425/210, 169, 170, 405 H, 405 R, 436 RM, DIG. 200, DIG. 201; 419/49; 73/40.5 R, 45.4

[56] References Cited

U.S. PATENT DOCUMENTS

| | | | |
|---|---|---|---|
| 3,319,292 | 5/1967 | Witkin | 425/405 H |
| 3,677,674 | 7/1972 | Bowles | 425/405 H |
| 3,832,107 | 8/1974 | Cox et al. | 425/78 |
| 3,988,088 | 10/1976 | King et al. | 425/73 |
| 4,161,957 | 7/1979 | Schoellkopf | 73/40.5 R |
| 4,537,569 | 8/1985 | Asari et al. | 425/405 H |

FOREIGN PATENT DOCUMENTS

| | | | |
|---|---|---|---|
| 1370297 | 10/1974 | United Kingdom | 425/405 H |
| 984683 | 12/1982 | U.S.S.R. | 425/78 |
| 1079359 | 3/1984 | U.S.S.R. | 425/78 |

*Primary Examiner*—Jay H. Woo
*Assistant Examiner*—J. Fortenberry
*Attorney, Agent, or Firm*—Oblon, Fisher, Spivak, McClelland & Maier

[57] ABSTRACT

A hot isostatic press apparatus wherein a material to be processed such as preliminarily shaped metal powder is charged into a high pressure vessel provided with a heater and the material to be processed is pressed by superhigh pressure of fluid or gas sealed into the vessel and heating by a heater. The apparatus includes a main station including a high pressure vessel, a movable cover, a member for moving the material to be processed; one or more auxiliary stations including an inserting station, a preheating station, a removing station, etc.; a sealed tank; and transfer mechanisms for the material to be processed. The apparatus also includes a seal leakage detector.

24 Claims, 79 Drawing Figures

FIGURE 6(IIa)
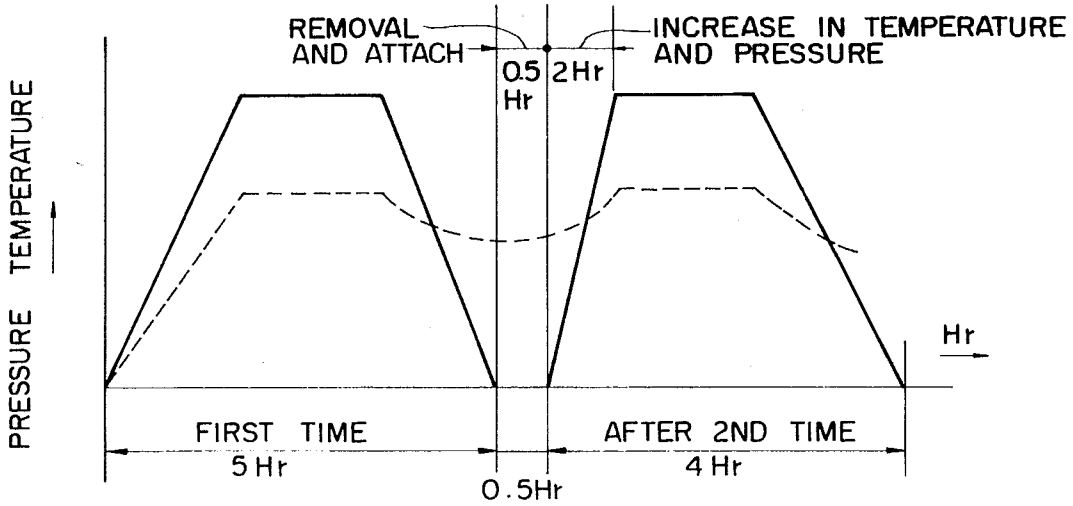

FIGURE 6(IIb)
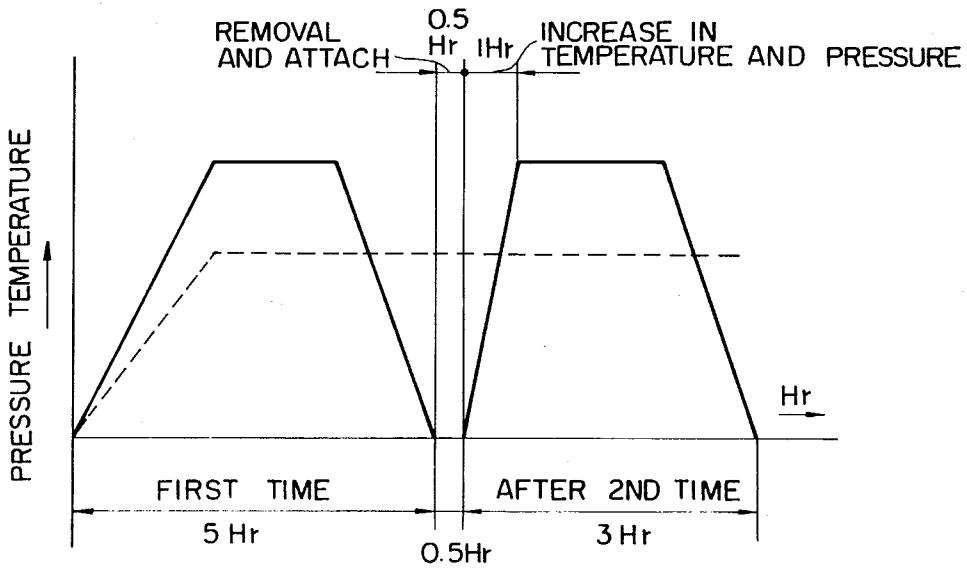

FIGURE 6(III)
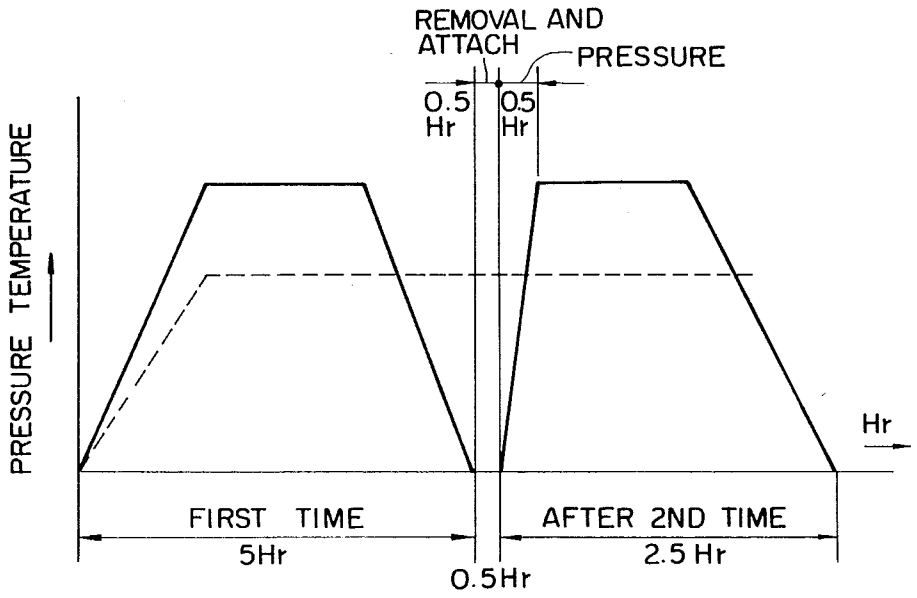

HOT ISOSTATIC PRESS APPARATUS

BACKGROUND OF THE INVENTION

1. Field of the Invention

The present invention relates to a hot isostatic press apparatus in which a material to be processed such as preliminarily shaped metal powder or the like is charged into a high pressure vessel provided with a heater, and the material is pressed and molded by superhigh boosted pressure of fluid or gas medium sealed into the vessel and heating by a heater, making it possible to attain high efficiency of actual production equipment further relates to apparatus in which in stepwise execution of processing operation as required with respect to various materials to be processed including metal material, successive transfer of the material to be processed from one station to the other is automatically performed within a closed operating space still further relates to apparatus for detection of seal leakage in continuous hot isostatic pressing apparatus.

2. Discussion of the Background

A hot isostatic pressing apparatus is known which is one of a number of superhigh press molding technologies and is the so-called HIP apparatus, within which hot isostatic pressing apparatus, a material to be processed, such as preliminarily shaped metal powder, is charged into a high pressure vessel provided with a heater and the interior of which vessel is in a vacuum state or in an active and inactive gas atmosphere, and the material is pressed and molded into a block-like configuration by superhigh boosted pressure of fluid or gas medium sealed into the vessel. Actual production equipment of such apparatus principally comprises a high pressure vessel of a sealed construction in which a part thereof is opened and closed by a cover and the vessel is isolated from the outside by the closure of the cover, as is known. This vessel is merely accompanied by means for opening and closing a cover and means for carrying a material to be processed in and out of the vessel, which means are both exposed to the outside of the vessel, and considerable handling operation is required.

As a heater heretofore used in a high pressure vessel, a heater using an energizing heat generating wire formed of molybdenum group or graphite group material is ordinarily used in a relatively high temperature area. However, such a heater is oxidized (consumed) when it is exposed to the air, and therefore, in removal of a material to be processed, from the high pressure vessel, which is pressed and molded under the sealed condition in the vessel, it is necessary to delay its removal until the heater has been cooled to some degree after high temperature and high pressure have subsided. This naturally involves a longer press cycle time and impairs an increase in productivity. Further, in the antestep of HIP processing, it is necessary to attach a material to be processed to the apparatus at normal temperature and normal pressure and thereafter increase temperature and pressure. This also involves a longer press cycle and impairs productivity.

Furthermore, since the molybdenum group or graphite group heater is oxidized in a high temperature atmosphere, a nonoxidized atmosphere is required or a special atmosphere is required a material to be processed cannot be removed at a high temperature in the atmosphere.

In most cases, a one step operation is not sufficient to form a material to be processed of metal from a blank to a finished product but instead stepwise processing after preliminary molding is required, and in case a hot treatment is applied thereto, heat treatment such as heating is also required. These operations are mostly carried out at respective separate positions and separate places, and therefore, transfer means for blanks and half-finished products for transferring them from one station to the other have to be provided. In the past, in transfer of these materials, conveyors and other transfer means are merely generally used under an atmospheric environment.

For materials to be processed for which specific thermo-environment or atmospheric environment is required, special consideration has to be naturally directed to the transfer means therefor. For example, in the hot isostatic pressing apparatus known as an HIP apparatus which is one of superhigh presses, a preliminarily shaped material to be treated such as metal powder is charged into a high pressure vessel provided with a heater and the interior of the vessel is in a vacuum state or in an active and inactive gas atmosphere, and the material to be processed is pressed and formed into a block-like configuration by a superhigh boosted pressure of fluid (liquid, gas) sealed into the vessel. However, this apparatus principally comprises a high pressure vessel which is isolated from the outside by an openable cover. Means for opening and closing the cover and means for carrying the material to be processed in and out of the vessel are merely provided in a state exposed to the outside of the vessel. As a heater used in the high pressure vessel, a heater using an energizing heat generating wire formed of molybdenum group or graphite group material is ordinarily used. However, the heater of this kind is oxidized (consumed) when it is exposed to the air, and therefore, in removal of a material to be processed, from the high pressure vessel, which is pressed and molded under the sealed condition in the vessel, it is necessary to delay its removal until the heater has been cooled to some degree after the high temperature and high pressure have been reduced. Further, a material to be processed is set in the vessel at normal temperature and normal pressure and thereafter the temperature and pressure are increased. Therefore, this involves a longer press cycle and impairs productivity. In heating a material to be processed in a separate preliminary step, complicated equipment and cumbersome operation are required in terms of time and place according to conventional transfer means. Of course, in not only the HIP apparatuses but apparatus which performs operating steps at separate places and requires a transfer between the respective steps, thus transfer means have to be provided therefor. In materials to be processed wherein such materials need to be placed under a specific thermo-condition and atmospheric environment and wherein members constituting an apparatus which require the aforesaid conditions, are needed conventional transfer means often give rise to inconveniences.

The present applicant is desirous of developing a so-called continuous hot isostatic pressing apparatus which is designed so that a hot isostatic forming high pressure vessel and an operating chamber for inserting or removing a material to be processed are brought into communication with each other by a sealed tank, and the material to be processed is transferred within the sealed tank.

Incidentally, in the continuous hot isostatic pressing equipment as described above, it is extremely difficult for the operating chambers, the high pressure vessel and the sealed tank to be placed under the same pressure and same atmosphere. If the balance of atmospheres is not secured, for example, if when a material to be processed is charged into a sealed tank and transferred, pressure balance between the high pressure vessel, operating chambers and sealed tank is lost, the amount of material to be processed can be reduced or air pressure can possibly blow away a seal material.

In a hot isostatic pressing apparatus for pressing and molding a material to be processed such as metal powder by hot isostatic pressure, an apparatus has been proposed in which operation from insertion to removal of a material to be processed is continuously carried out while being moved from one station to the other.

In the apparatus of this kind, for example, in a main station where a material to be processed is directly pressed and molded, a movable cover with a material to be processed placed thereon is detachably fitted from the lower side thereof into a high pressure vessel, a lower end of which is open to a sealed tank. A seal material on the side where the movable cover is fitted is repeatedly fitted and removed, and as a result, such is liable to be damaged and there is a great possibility of occurrence of seal leakage.

However, in the past, there has not been provided a device for detecting a breakage of the seal material, and accordingly, if such a breakage should occur, high pressure leakage of the sealed tank can lead to breakage of the sealed tank. Because of this, it is necessary to provide a sealed tank which is increased in plate thickness so as not to break the sealed tank even when a seal leakage occurs. This arrangement results in an increase in weight of the sealed tank and thus required a larger-size.

Conversely, if any trouble occurs in a high pressure gas generator for supplying high pressure gas to a high pressure vessel, the high pressure gas back-flows towards the high pressure vessel from the sealed tank so as to thus make it impossible to maintain the atmosphere of the sealed tank.

SUMMARY OF THE INVENTION

In accordance with the present invention, a material to be processed may be attached when a heater is turned on irrespective of operation which opens and closes one end of the HIP apparatus. In addition, the HIP process material is immediately able to be removed outside the vessel without waiting for the heater which lowers the temperature to an oxidation preventive level, thus shortening the press cycle time and materially enhancing productivity in the hot isostatic pressing apparatus by the high pressure vessel of this kind.

According to a first invention, there is provided a hot isostatic pressing apparatus which comprises a main station comprising a hot isostatic pressing and forming high pressure vessel one end of which is open, a movable cover member for opening and closing said open one end, a member attached to said movable cover member to transfer a material to be treated into and out of the vessel and the like; an auxiliary station for inserting and removing a material to be processed comprising an operating chamber one end of which is open and inserting and/or removing a material to be processed, a movable cover member for opening and closing said open one end, a member attached to said movable cover member to transfer a material to be processed into and out of the chamber and the like, said auxiliary chamber being arranged adjacent said main station; a sealed tank in which internal spaces of said main and auxiliary stations are interrupted in common from outside and placed in a vacuum state or in a required gas atmosphere, said sealed tank surrounding said internal spaces in a state of communication therewith; and a transfer device comprising a movable transfer member mounted on said sealed tank and movable between said spaces and a support member for supporting a material to be processed, said support member being disengageably retained relative to said transfer member.

According to a second invention, there is provided a rotary type continuous hot isostatic pressing equipment which comprises a main station on which are provided a hot isostatic pressing and forming a high pressure vessel at least one end of which can be opened in terms of function, a movable cover member for opening and closing said open one end of the vessel, and a member for transferring a material to be processed into and out of the vessel, said member being attached to said vessel; an auxiliary station for inserting and removing a material to be processed and in which are provided an operating chamber one end of which is open and which inserts and/or removes a material to be processed, a movable cover member for opening and closing said open one end of said operating chamber, and a member for transferring a material to be processed into and out of the chamber, said member being attached to said movable cover member; said main and auxiliary stations being arranged on one and the same circumferential surface, a loop-shaped sealed tank in which internal spaces of both said stations are interrupted in common from outside and placed in a vacuum state or in a required gas atmosphere, said sealed tank surrounding said internal spaces in a state of communication; a rotational table provided internally of the loop of said sealed tank, said rotational table being freely rotated and driven on a horizontal surface; said movable members being placed on the rotational table in said both stations, an elevating device for moving up and down said movable cover members from said rotational table; and a detachable hole for said elevating device formed in said rotational table.

In a third invention, in transfer of a material to be transfered as described above, particularly, a material to be processed subjected to thermo-processing or atmospheric processing, from one station to the other according to the operating step, operating stations are disposed collectively in a closed space isolated from the exterior, and the material to be processed is automatically transferred within the closed space to make the distance of transfer short and compact, and to avoid occurrence of external and internal change in the material to be processed so as to enhance productivity. There is provided an apparatus for transferring a material to be processed in a closed operating space which comprises a plurality of operating stations for applying operating steps to a material to be processed on one side of a sealed tank forming a closed operating space, said operating stations being arranged serially and in such a manner that both inlets and outlets for the material to be processed are open to said operating space; opening and closing a cover for a material to be processed provided corresponding to the inlet and outlet of the material to be treated in said operating stations on the other side of the sealed tank, said cover being operable and being provided serially and movably up and down and; a pair of transfer shafts extending through the sealed tank above said opening and closing cover of the material to be processed, said transfer shafts being juxtaposed retractably along said covers and in a spaced relation so as not to interfere with said covers; gripping disengageable pawls for a material to be processed provided at a position opposed to the placing and opening and closing covers in the operating stations except the final operating station in both the transfer shafts; and axially retractable means for said transfer shafts and rotatable means provided externally of the sealed tank.

According to a fourth invention, there is provided a continuous hot isostatic pressing apparatus which comprises a main station on which are provided at least a hot isostatic pressing and forming high pressure vessel at least one end of which can be opened, and a movable cover member for opening and closing said open one end of the vessel; an inserting station and a removing station for a material to be processed on which are provided at least operating chambers each one end of which is open and which inserts or removes a material to be processed, and a movable cover member for opening and closing each one end of the operating chambers; a sealed tank in which internal spaces of said stations are interrupted in common from outside and placed in a vacuum state or in a required gas atmosphere and which has a communication chamber surrounding each internal space in a communicating fashion; a tunnel-like preheating furnace provided in the communication chamber of the sealed tank between the inserting station and the main station, said furnace having transfer means capable of accommodating a plurality of materials to be processed and transferring the material to be processed from the inserting station to the main station; transfer means for successively transferring the material to be processed from the inserting station to the preheating furnace, from the preheating furnace to the main station and from the main station to the removing station; and openable door means provided in communicating portions between the inserting station and the main station of the preheating furnace.

In the fourth invention there is further provided a cooling furnace having transfer means between the main station and the removing station, whereby an optimum cooling time period may be selected according to the character, quality, shape and the like of a material to be processed.

Furthermore, in a fifth invention, atmospheres between the operating chamber and high pressure vessel and sealed tank can be balanced when the movable cover is moved in and out to thereby provide high efficiency of actual operation, to prevent falling of a material to be processed and prevent peeling of a seal material, etc.

According to the fifth invention, there is provided a continuous hot isostatic pressing apparatus which comprises a main station on which are provided at least a hot isostatic pressing and forming high pressure vessel at least one end of which is open in terms of function, and a movable cover member for opening and closing said open one end of the vessel; auxiliary stations such as an inserting station and a removing station for a material to be processed on which are provided at least operating chambers each one end of which is open and which insert or remove a material to be processed, and a movable cover member for opening and closing one end of said operating chamber; a sealed tank in which internal spaces of said stations are interrupted in common from outside and in a vacuum state or in a required gas atmosphere, said sealed tank having a communication chamber surrounding said internal spaces in a communicating fashion, said sealed tank being interiorly provided with means for transferring a material to be processed between said auxiliary station and including main station; and passages to provide communication between the sealed tank and said high pressure vessel and said operating chambers, said passages each being provided with an opening and closing valve.

In addition to the foregoing, in a sixth invention, seal leakage resulting from a breakage of a seal material can be detected simply and positively.

According to the sixth invention, there is provided a seal leakage detecting apparatus in a continuous hot isostatic pressing apparatus, which apparatus comprises a vessel at least one end of which is open into a sealed tank, and a movable cover capable of placing a material to be processed thereon and detachably fitted into the vessel from the sealed tank side, said detector comprising at least two seal elements provided, in a fitted portion between the vessel and the movable cover, in an axially spaced relation, a bore formed in the vessel, said bore extending from an intermediate portion of said seal elements to the air, and a sensor provided in said bore in a communicating fashion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 to FIG. 7 are views in connection with a first invention (hereinafter referred to "the invention (I)"), in which: FIG. 7 illustrates operation of prior art;

FIG. 8 to FIG. 24 are views in connection with a second invention (hereinafter referred to "the invention (II)"), in which: FIG. 8 is a schematic plan view of a first embodiment, FIG. 9 is a sectional view taken on line A—A of FIG. 8, FIG. 10 is a sectional view taken on line B—B of FIG. 8, FIG. 11 is a sectional view taken on line E—E of FIG. 8, FIG. 12 is a sectional view taken on line F—F of FIG. 8, FIG. 13 is a schematic plan view of a second embodiment, FIG. 14 is a schematic plan view of a third embodiment, FIG. 15 is a schematic plan view of a fourth embodiment, FIG. 16 is a schematic plan view of a fifth embodiment, FIG. 17 is a sectional view taken on line C—C of FIGS. 15 and 16, FIG. 18 is a sectional view taken on line D—D of FIGS. 14 and 16, FIGS. 19–22 are developed sectional views for explaining the operating step of the fifth embodiment, FIG. 23(*a*) to (*e*) illustrate operation of the embodiments of the invention (II), and FIG. 24 illustrates operation of prior art;

FIGS. 25 to 35 are views in connection with a third invention (hereinafter referred to as "the invention (III)"), in which: FIG. 25 is a longitudinal sectional front view of a first embodiment, FIG. 26 is a sectional view taken on line A—A of FIG. 25, FIG. 27 is a side view of an embodiment of a transfer shaft rotational mechanism, FIG. 28 is a sectional view taken on line D—D of FIG. 26, FIG. 29 is a longitudinal sectional side view of an opening and closing cover above the operating chamber, FIG. 30 is a plan view of the same, FIG. 31 is a longitudinal sectional front view showing essential parts of a second embodiment of apparatus, FIG. 32 is a cross sectional plan view of the same, FIG. 33 is a longitudinal sectional front view showing essential parts of a third embodiment, FIG. 34 is a longitudinal sectional front view showing essential parts of a fourth embodiment, and FIG. 35 is a longitudinal sectional front view of a fifth embodiment;

FIGS. 36 to 48 are views in connection with a fourth invention (hereinafter referred to as "the invention (IV)"), in which: FIG. 36 is a schematic plan view of a first embodiment, FIG. 37(*a*) is a sectional view taken on line A—A of FIG. 36, FIG. 37(*b*) is a view taken on line a—a of FIG. 37(*a*), FIG. 38 is a sectional view taken on line B—B of FIG. 36, FIG. 39 is a sectional view taken on line C—C of FIG. 36, FIG. 40 is a sectional view taken on line D—D of FIG. 36, FIG. 41 is a sectional view taken on line E—E of FIG. 36, FIG. 42 is a sectional view showing a driving section of FIG. 41, FIG. 8 is a schematic plan view of a second embodiment, FIG. 44 is a schematic plan view of a third embodiment, FIG. 45 is a schematic plan view showing an embodiment of the second technical means of the invention, FIG. 46 is a sectional view taken on line C—C of FIG. 45, FIG. 47 is a sectional view taken on line F—F of FIG. 45, and FIG. 48 is a sectional view taken on line G—G of FIG. 45;

FIGS. 49 to 59 are views in connection with a fifth invention (hereinafter referred to as "the invention (V)", in which: FIGS. 49 to 54 show a first embodiment, FIG. 49 is a sectional view in which a material to be processed is inserted and removed, FIG. 54 is a sectional view in which an operating chamber and a communication chamber are in the same atmosphere, FIG. 51 is a sectional view in which a material to be processed is moved down to the communication chamber, FIG. 52 is a cross sectional plan view of FIG. 51, FIG. 53 is a sectional view taken on line A—A of FIG. 52, FIG. 54 is a sectional view taken on line B—B of FIG. 52, and FIGS. 55 to 59 show a second embodiment, FIG. 55 is a plan view, FIG. 56 is a sectional view taken on line C—C of FIG. 55, FIG. 57 is a sectional view taken on line D—D of FIG. 55, FIG. 58 is a sectional view taken on line E—E of FIG. 55, and FIG. 59 is a sectional view taken on line F—F of FIG. 55; and FIGS. 60 to 65 are views in connection with a six invention (hereinafter referred to as "the invention (VI)"), in which FIGS. 60 to 63 show a first embodiment of the invention, FIG. 60 is a structural view of essential parts, FIG. 61 is a schematic plan view showing the arrangement of the whole structure, FIG. 62 is a developed sectional view of the same, FIG. 63 is an enlarged view taken on line IV—IV of FIG. 61, and FIGS. 64 and 65 are structural views showing another embodiment.

DESCRIPTION OF THE PREFERRED EMBODIMENTS

Invention (I)

Figure 1A:
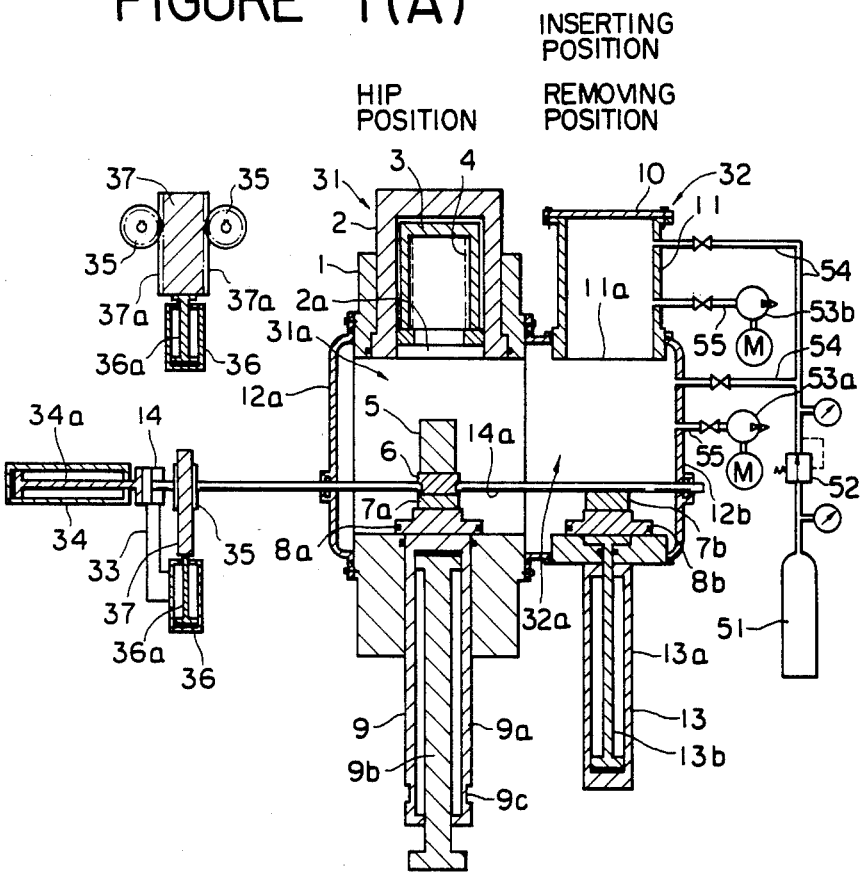
FIG. 1(A) is a longitudinal sectional front view of a first embodiment of the apparatus in accordance with the invention (I)
Figure 1B:
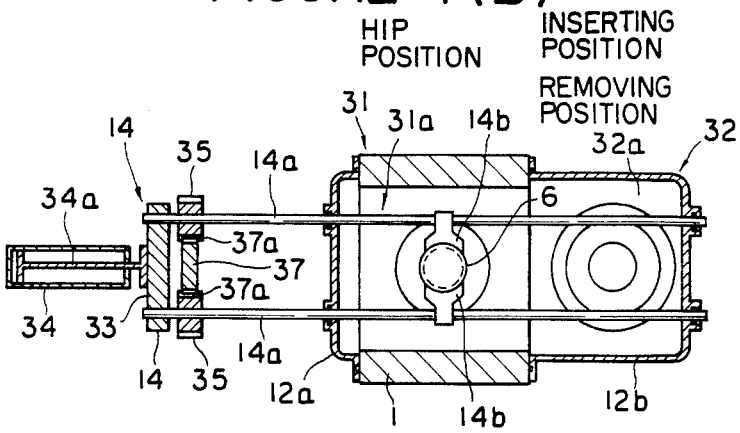
FIG. 1(B) is a cross sectional plan view of a transfer operation.
Figure 1C:
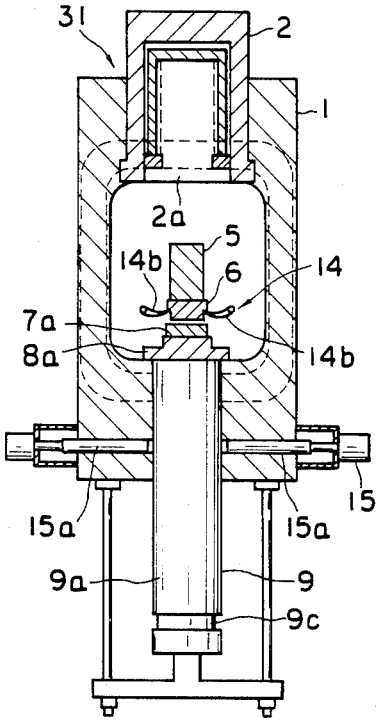
FIG. 1(C) is a longitudinal sectional side view.

As shown in FIG. 1(A), FIG. 1(B), and FIG. 1(C), the apparatus comprises a main station 31 and an auxiliary station 32, in which main station 31 a high pressure vessel 2 is provided one end (a lower end, in the illustrated embodiment) of which is open is fixedly mounted at an upper portion of a press frame 1, a movable cover member 8*a* for opening and closing one open and thereof, that is, an opening 2*a* for moving a material 5 to be processed into and out of the vessel 2 is disposed at a lower portion of the press frame 1 through an elevating device 9, said cover member 8*a* being moved up and down towards the opening 2*a*, and a member 7*a* for moving the material to be processed 5 into and out of the vessel 2 is integrally provided on the upper surface of the movable cover member 8*a*, and in which auxiliary station 32, which is positioned adjacent to the main station 31, an operating chamber 11 provided one end (a lower end, in the illustrated embodiment of which) is open as an opening 11*a* and the other end (an upper end, in the illustrated embodiment) of which serves as an opening and closing cover 10 (an opening and closing means for the cover is either manually or automatically operated) is, a movable cover member 8*b* for opening and closing the opening 11*a* is provided which is movable up and down towards the opening 11*a* by an elevating device 13, and a member 7*b* for moving the material to be processed 5 into and out of the operating chamber 11 is integrally provided on the upper surface of the movable cover member 8*b*. With this arrangement, the material to be processed 5 can be charged into the vessel 2 through the member 7*a* provided on the upper surface of the movable cover member 8*a* simultaneously with the closure of the movable cover member 8*a* with respect to the opening 2*a* of the high pressure vessel 2. Accordingly, under this condition, the material to be processed 5 can be subjected to molding operation by hot isostatic pressing by heating from a heater 4 provided within the vessel 2 through a heat insulating layer 3, by superhigh boosted pressure of a fluid or gas medium sealed into the vessel 2 as is known though not shown, and under the vacuum state or active or inert gas atmosphere state within the vessel.

As in prior art, attached to the HIP apparatus body are a high pressure gas generator, a vacuum device, a vessel cooler, a heater energizing device and the like.

On the other hand, in the auxiliary station 32, the movable cover member 8*b* with the member 7*b* for moving the material to be processed 5 provided on the upper surface thereof is made openable relative to the opening 11*a* of the operating chamber 11, whereby the operating chamber 11 can be utilized to apply necessary processing operation to the material to be processed 5 prior to or subsequent to pressing. For example, the movable cover member 8*b* is closed over the opening 11*a* to thereby open the cover 10 of the operating chamber 11 to communicate to the air, the material to be processed 5 prior to pressing is charged into the chamber, and the material to be processed is set on the member 7*b*. The cover 10 is closed to thereby independently seal the operating chamber 11 so as to be placed in the same atmosphere as that of the sealed tank, after which the movable cover member 8b is moved downward for preparation to carry the material 5 to be processed towards the main station 31. Conversely, under the state that the already pressed material 5 to be processed is placed on the member 7b of the movable cover member 8b through a support member 6, the movable cover member 8b is moved up and closes the opening 11a, the material 5 to be processed is fed into the operating chamber 11 to form the atmosphere which is the same as that of the sealed tank into an atmospheric pressure, and thereafter the cover 10 is opened. Thus, in the auxiliary station, attaching and removing of a material to be processed, and other various operations such as preliminary processing, and post-processing respectively required before and after a material to be processed has been pressed, can be independently carried out, and in addition, these operations can be carried out in a manner in cooperation with the pressing operation in the main station 31.

Sealed tanks 12a and 12b for interrupting internal spaces 31a, 32a in the main and auxiliary stations 31, 32 from outside and surrounding them in a communicating state are airtightly externally fitted whereby both the spaces 31a, 32a are interrupted from outside. Integral spaces communicated with each other are formed, and thus, a gas cylinder 51 and a vacuum pump 53 are provided in communication on either side of the sealed tanks 12a to 12b, whereby the internal spaces 31a, 32a can be placed in the same environment as the vacuum state or an active or inert gas atmosphere in the high pressure vessel 2. The object of the present invention may be easily achieved by the provision of a transfer device 14 comprising a transfer member 14a provided movably between the internal spaces 31a, 32a and a support member 6 for the material 5 to be processed disengageably held on the transfer member 14a. While in the illustrated embodiment the transfer device is extended externally, such can be housed within the tank. More specifically, in FIG. 1(A), where the material 5 to be processed is placed on the support member 6 in engagement with the transfer member 14a and the support member 6 is overlapped on the member 7a on the movable cover member 8a, if the material 5 to be processed is not yet pressed, the engagement between the transfer member 14a and support member 6 is released, after which the movable cover member 8a is moved up to be closed over the opening 2a of the high pressure vessel 2 whereby the material to be processed 5 is charged into the vessel 5 through support member 6 and the member 7a, thus applying the hot isostatic pressing to the material to be processed 5 under a predetermined high pressure and high temperature processing conditions. Further, if the material 5 to be treated has already been pressed, after the support member 6 has been brought into engagement with the transfer member 14a, the transfer member 14a is moved rightwards as viewed in the drawing whereby the support member 6 and already processed material to be processed 5 are transferred towards the auxiliary station 32, and when the support member 6 arrives at a positon where it is overlapped with the member 7b on the movable cover member 8b of the station 32, the transfer member 14a is stopped and the engagement between the member 14a and support member 6 is released. Next, when the movable cover member 8b is moved up, the movable cover member 8b is closed over the opening 11a of the operating chamber 11, and, at the same time, the material to be processed 5 and support member 6 are fed into the operating chamber 11 to subject only the interior of the operating chamber to atmospheric pressure while maintaining the interior of the sealed tank under the vacuum, active or inert gas atmosphere. Accordingly, the material 5 to be processed can be removed outside through the opening and closing cover 10 irrespective of the sealed tank. More particularly, in inserting a material to be processed prior to processing into the high pressure vessel, since the sealed tank is in the atmosphere in which a heater is not oxidized, the heater can be inserted while maintaining the high temperature. On the other hand, in removing the already pressed material 5, to be processed from the high pressure vessel 2, since the internal spaces 31a, 32a can be brought into the same atmosphere as the environmental atmosphere within the vessel 2 through the sealed tanks 12a, 12b, the movable cover member 8a is moved down and is opened immediately after termination of molding, without waiting until the temperature is lowered to a heater oxidizing preventive temperature after completion of molding in the vessel 2, to remove the material 5 to be processed and, thus considerably shortening the cycle time. Furthermore, movement and elevating of the material to be processed 5 can all be effected automatically in the shortest course by the transfer device 14 and movable cover members 8a, 8b provided on the respective stations 31, 32. Moreover, since the auxiliary stations 32 can be increased in number as necessary with respect to a single unit of main station 31, it is possible to materially enhance the shortening, efficiency and productivity of the press cycle as the actual production equipment including all the preliminary and post processings required for the material 5 to be processed.

EMBODIMENTS OF THE INVENTION (I)

Embodiment 1

In the embodiment shown in FIG. 1(A), FIG. 1(B) and FIG. 1(C), one unit of auxiliary station 32 is used with respect to the main station 31, the auxiliary station 32 serving as an inserting and removing station of the material 5 to be processed. In the main station 31, a known high pressure vessel 2 which houses a heat insulating layer 3 and a heater 4 and having an opening 2a provided at a lower end thereof is installed at the upper portion of a press frame 1 having an internal space 31a, and an elevating device 9 comprising a movable cylinder 9a and a fixed piston rod 9b is installed at a lower portion of the press frame 1 sufficiently withstanding an axial force, the movable cylinder 9a having a movable cover member 8a mounted thereon, and the movable cover member 8a having a moving member 7a for the material 5 to be processed provided on the upper surface of the movable cover member 8a. In the movable cover member 8a, an engaging portion 9c is formed at a part of the movable cylinder 9a as one member of the high pressure vessel 2 to close the opening 2a in a sealing fashion to receive a forming reaction by superhigh pressure, and a clamp 15a of a clamping device 15 for receiving the reaction positioned on the press frame 1 is clamped during presssing operation. The press frame is not limited to one shown in this embodiment and other types of the press frame can be used. In the auxiliary station 32, at an upper level on the line of the high pressure vessel 2, a cover 10 is openably provided on the upper end thereof, and a cylindrical operating chamber 1 having an opening 11*a* formed at the lower end thereof is arranged, whereas at a lower level on the line of the elevating device 9, an elevating device 13 comprising a cylinder 13*a* and a piston rod 13*b* is disposed, the piston rod 13*b* having a movable cover member 8*b* for open and closing the opening 11*a* provided thereon, the movable cover member 8*b* having a moving member 7*b* for the material 5 to be processed provided on the upper surface thereof, and an internal space 32*a* in communication with an internal space 31*a* of the main station 31 is provided between the operating chamber 11 and the elevating device 13. This sealed tank can be an integral body.

Sealed tanks 12*a*, 12*b* are integrally fixed to surround in common internal spaces 31*a*, 32*a* of the main sttion 31 and auxiliary station 32 to interrupt them from outside. Active or inert gas is supplied through a gas cylinder 51, a reducing valve 52 and a pipe line 54 to either of the sealed tanks 12*a* or 12*b* whereby the required gas atmosphere can be created over the whole area within the tank, and vacuum pumps 53*a*, 53*b* likewise create a vacuum state individually in the whole area in the tank and in the operating chamber 11 through a pipe line 55. Within the sealed tanks 12*a*, 12*b*, a pair of transfer members 14*a*, 14*a* constituting the transfer device 14 are mounted so that they may be retractably and rotatably over the overall length of the tank, and a support member 6 for the material 5 to be processed is held by clamp holders 14*b*, 14*b* provided in a symmetrical position of the transfer members 14*a*, 14*a*. The pair of transfer members 14*a*, 14*a* have each end thereof projected externally of the tank 12*a* and held on a bracket 33, and the bracket 33 is connected to a piston rod 34*a* of a movable cylinder 34 for forward and backward movement. Gears 35, 35 are mounted on one end of each of the transfer members 14*a*, 14*a*, respectively, and rack gears 37*a*, 37*a* of a rack rod 37 held on a piston rod 36*a* of a driving cylinder 36 provided on the bracket 33 are meshed with the gears 35, 35, respectively, and the transfer members 14*a*, 14*a* are rotated normally and reversely through the vertical movement of the rack rod 37 and through the rotation of the gears 35, 35 whereby the clamp holders 14*b*, 14*b* may be engaged with and disengaged from the support member 6.

According to the above-described embodiment, the interior of the sealed tanks 12*a*, 1*b* is under the same vacuum state or, active or inert gas atmosphere as that of the high pressure vessel 2, and the movable cover member 8*b* on the side of the auxiliary station 32 is moved up to close the opening 11*a* of the operating chamber 11 to interrupt the operating chamber 11 from the internal space 32*a*. The movable cover member 8*b* is positioned within the operating chamber, and the opening and closing cover 10 is opened to place the material 5 to be processed on the moving member 7*a* together with the support member 6, whereas the opening and closing cover 10 is closed to form the interior of the operating chamber 11 into the same atmosphere as that of the internal space 32*a*, after which the movable cover member 8*b*, moving member 7*b*, support member 6 and material 5 to be processed are all moved down. Next, the transfer members 14*a*, 14*a* are moved to advance the clamp holders 14*b*, 14*b* to a position corresponding to the periperal side of the support member 6, and the clamp holders 14*b*, 14*b* are turned through the rotation of the transfer members 14*a*, 14*a* into engagement on the peripheral side of the support member 6 as shown in FIG. 1(C), after which the transfer members 14*a*, 14*a* are moved towards the main station 31 through the cylinder 24. The transfer members 14*a*, 14*a* are stopped at a position where the support member 6 is overlapped on the moving member 7*a* of the movable cover member 8*a*, and the clamp holders 14*b*, 14*b* are turned to release the engagement between the transfer members 14*a*, 14*a* and the support member 6, after which the movable cover member 8*a* is moved up to close the opening 2*a* of the high pressure vessel 2 whereby the material 5 to be processed is charged into the vessel 2 through the moving member 7*a* and support member 6 to apply the hot isostatic pressing to the material 5 to be processed in a known manner. Upon completion of pressing, the movable cover member 8*a* is immediately moved down to remove the material 5 to be processed from the vessel 2, and in the state shown in FIG. 1(A), the clamp holders 14*b*, 14*b* of the transfer members 14*a*, 14*a* are again brought into engagement with the support member 6 to move the support member 6 and material 5 to be processed towards the auxiliary station 32 to disengage the clamp holders 14*b*, 14*b* from the support member 6. The movable cover member 8*b* is moved up, and the support member 6 and material 5 to be processed are fed into the operating chamber 11 through the moving member 7*b*. In the state where the opening 11*a* of the movable cover member 8*b* is closed, the operating chamber is under atmospheric pressure and thereafter the opening and closing cover 10 is opened to remove the material 5 to be processed y, and a new material 5 to be processed is placed on the support member 6 for repetition of press cycle. That is, the press cycle can be progressed in a fully automatic manner. In addition, attaching and removing of a material to be processed from the high pressure vessel can be carried out irrespective of the heater oxidizing preventive temperature since the heater is interrupted from the air and is in a non-oxidized state even if the heater is in a high temperature energized state, thus materially enhancing the productivity and further obtaining uniform and stabilized operations.

Embodiment 2

Figure 2A:
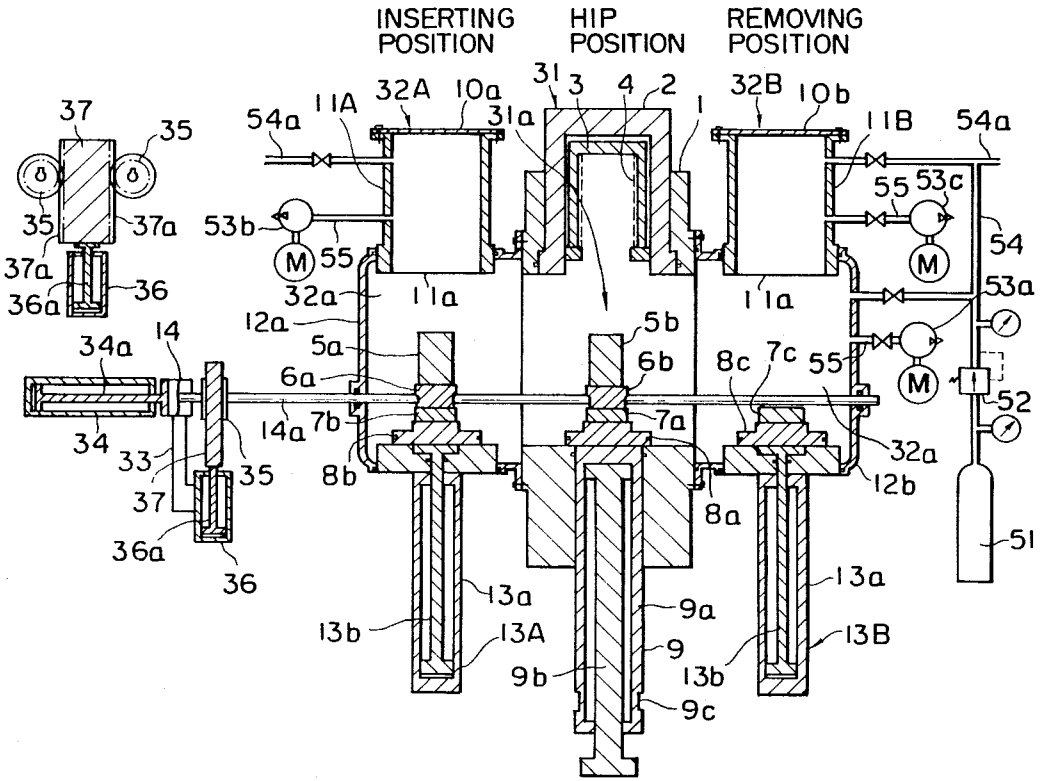
FIG. 2(A) is a longitudinal sectional front view of a second embodiment.
Figure 2B:
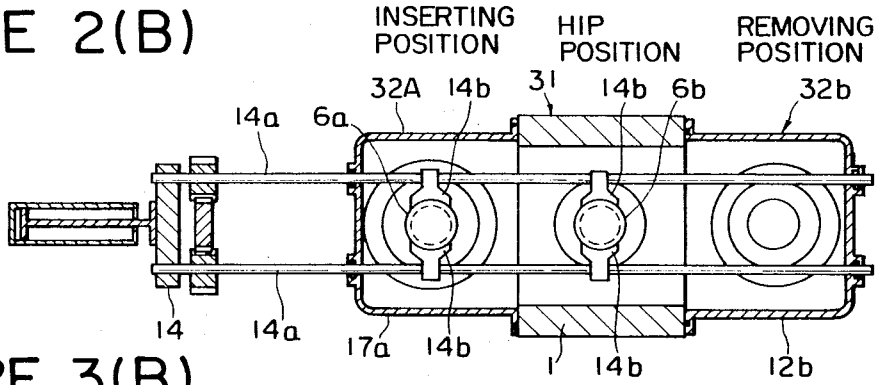
FIG. 2(B) is a cross sectional plan view of a transfer operation.

In a second embodiment shown in FIG. 2(A) and FIG. 2(B), two auxiliary stations 32A and 32B are arranged adjacent to each other and with a main station 31 sandwiched therebetween. The auxiliary station 32A serves as an inserting station for a material 5 to be processed, and the auxiliary station 32B serves as a removing station for the material 5 to be processed. This station can be of a combined station incorporating therein cooling and preheating members which will be described later. The same reference numerals as those used in the first embodiment indicate the same members as those of the first embodiment, the difference therebetween being described in the following discussion. In the inserting auxiliary station 32A, a gas supply line 54*a*, a vacuum pump 53*b* and a pipe line 55 are provided in an operating chamber 11A provided with an opening and closing cover 10*a*, whereas in the removing auxiliary station 32B, a gas cylinder 51, and vacuum pumps 53*a*, 53*c* as well as pipe lines 54, 55 are provided on the side of an operating chamber 11B provided with an opening and closing cover 10*b* and a sealed tank 12*b*. In the inserting auxiliary station 32A, a moving member 7*b*, a movable cover member 8*b* and an elevating device 13A are provided, whereas in the removing auxiliary station 32B, a moving member 7*c*, a movable cover member 8*c* and an elevating device 13B are provided.

Needless to say, the sealed tanks 12*a*, 12*b* cover in common internal spaces 31*a*, 32*a*, and 32*a* of the stations 31, 32A and 32B. In a transfer device 14, as shown in FIG. 2(B) and more particularly, in a pair of parallel transfer members 14*a*, 14*a*, the stations 31, 32A and 32B are positioned at regular intervals of equal pitch, and in correspondence thereto, two groups of clamp holders 14*b*, 14*b* and clamp holders 14*b*, 14*b* are provided in a spaced relation of the same pitch as the former.

In this embodiment, the hot isostatic pressing with respect to the material 5 to be processed and the insertion and removal of the material 5 to be processed are carried out in accordance with the following procedure. Supposing that the state shown in FIG. 2(A) is a state wherein the material 5 to be processed has already undergone the pressing in the central main station 31 and the movable cover member 8*a* has been moved down to remove the material 5 to be processed together with the moving member 7*a* and support member 6*b* from the high pressure vessel 2, the operation is such that during the pressing operation in the main station 31, on the side of the inserting auxiliary station 32A, the movable cover member 8*b* is moved up to close the 11*a* of the operating chamber 11A, open the opening cover 10*a*, insert and set a new material 5 to be processed 5*a* together with the support member 6*a* on the moving member 7*b*, close the cover, and form the interior of the operating chamber into the same atmosphere as that of the internal space, after which the movable cover member 8*b* is moved down to pull the material 5 to be processed together with the support member 6*a* and moving member 7*b* into the internal space 32*a* as shown, thus appearing the state shown in FIG. 2(A). From the illustrated state, two sets of clamp holders 14*b*, 14*b* in the transfer members 14*a*, 14*a* are brought into engagement with the support members 6*a*, 6*b* in the stations 32A, 31 and the transfer members 14*a*, 14*a* are moved rightwards as viewed in the drawing whereby the already pressed material 5 to be processed is directed opposite to the moving member 7*c* of the movable cover member 8*c* in the removing auxiliary statio 32B through the support member 6*b* whereas a new material 5 to be processed is directed opposite to the moving member 7*a* of the movable cover member 8*a* in the main station 31 through the support member 6*a*. The transfer members 14*a*, 14*a* are stopped and two sets of clamp holders 14*b*, 14*b* are disengaged from the support members 6*b*, 6*a*, respectively. The movable cover members 8*a*, 8*c* are moved up by the elevating devices 9, 13B in the main station 31 and removing auxiliary station, respectively, whereby in the main station 31, a new material 5*a* to be processed is charged into the high pressure vessel 2 for the hot isostatic pressing whereas in the removing auxiliary station 32B, the already pressed material 5*b* to be processed is charged into the operating chamber 11B, and the operating chamber is made the same atmosphere as that of the sealed tank, after which the opening and closing cover 10*b* is opened to remove the material 5*b* to be processed. During both the operations, in the inserting auxiliary station 32A, the inserting operation for a new material 5 to be processed within the operating chamber 11A is carried out. In this manner, the operation of the FIG. 2(A) state is repeated to obtain a continuous operation of insertion, pressing and removal of the material 5 to be processed. In this case, the inserting and removing positions are independent, and therefore, the productivity is further enhanced over the first embodiment, and attaching and removal of the material to be processed can be made simultaneously. Since the heater can be held at an energizing condition continuously, it is possible to extremely shorten the press cycle time as a whole and to facilitate flow operation.

Embodiment 3

Figure 3A:
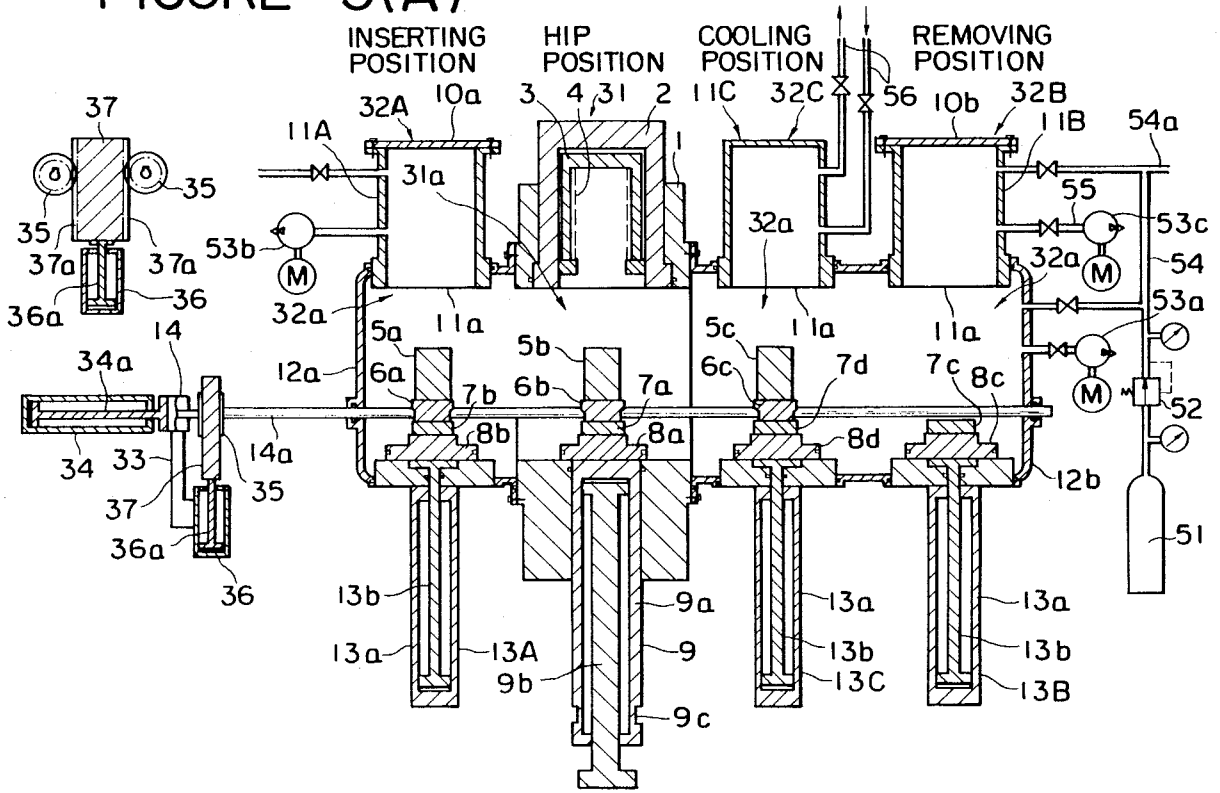
FIG. 3(A) is a longitudinal sectional front view of a third embodiment.
Figure 3B:
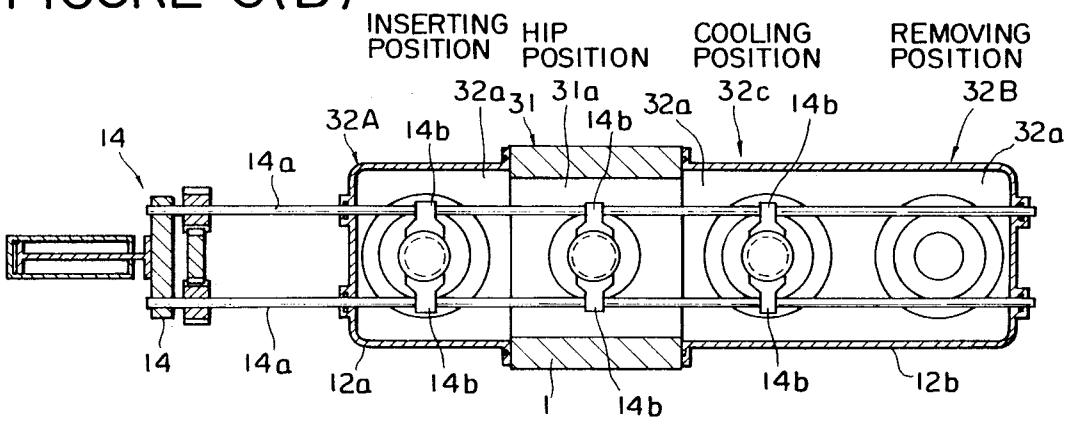
FIG. 3(B) is a cross sectional plan view of a transfer operation.

In a third embodiment shown in FIG. 3(A) and FIG. 3(B), three auxiliary stations 32A, 32B and 32C are disposed adjacent to a main station 31, and in addition to an inserting auxiliary station 32A and a removing auxiliary station 32B, a cooling auxiliary station 32C is provided for applying a cooling processing as a post-processing to an already pressed material 5 to be processed. Thus, these stations 32A, 31, 32C and 32B are arrayed in said order. The same reference numerals as those used in the second embodiment indicate the same members as those shown therein. Since the main station 31, inserting auxiliary station 32A and removing auxiliary station 32B are the same as those described in the second embodiment, the construction of only the cooling auxiliary station 32C will be described. An operating chamber 11C in the station 32C is merely provided to cool the already pressed material 5 to be processed, and therefore, the top of the operating chamber 11C is closed and a movable cover member 8*d* for openably closing an opening 11*a* at the lower end of the operating chamber 11C by an elevating device 13C and a moving member 7*d* provided on the upper surface of the movable member 8*d* are provided, and a cooling medium supply and discharge pipe line 56 is communicatingly provided in the operating chamber 11C to forcibly cool the material 5 to be processed, the cooling medium being supplied thereto. Further, since one station is added herein, in a pair of transfer members 14*a*, 14*a* in a transfer device 14, three sets of clamp holders 14*b*, 14*b* engageable with a support member 6 are provided at the same pitch as that of the station center, and sealed tanks 12*a*, 12*b* are provided to interrupt in common internal spaces 32*a*, 31*a*, 32*a*, and 32*a* of the stations 32A, 31, 32C and 32B, respectively, from outside, and to surround the spaces in a communicating fashion.

The press cycle of the third embodiment is a cycle of insertion, pressing, cooling and removal, which is merely different from that of the second embodiment, which is a cycle of insertion, pressing and removal. Therefore, such difference therebetween will be primarily described. Where the state shown in FIG. 3(A) is a state wherein in the main station 31, a material 5*b* to be processed has already been pressed, and a movable cover member 8*a* is moved down to remove the material 5*b* to be processed from the vessel 2, in the inserting auxiliary station 32A, inserting operation of a new material 5*a* to be processed for next pressing has been completed, whereas in the cooling auxiliary station 32C, an already pressed material 5*c* to be processed having been forcibly cooled within the operating chamber 11C is removed from the operating chamber 11*c* to assume the illustrated position by the downward movement of the movable cover member 8*d*. Thus, from this state, three sets of clamp holders 14*b*, 14*b* in the transfer members 14*a*, 14*a* are made corresponding to support members 6*a*, 6*b*, 6*c* for the materials 5*a*, 5*b*, 5*c* to be processed, in the stations 32A, 31, 32C, respectively, through the movement of the transfer members 14*a*, 14*a*, the clamp holders 14*b*, 14*b* are brought into engagement with the support members 6*a*, 6*b*, 6*c* through the rotation of the transfer members 14*a*, 4*a*, and the transfer members 14*a*, 14a are moved by one pitch rightwards as viewed in the drawing. To already cooled material 5c to be processed is thereby moved onto the movable cover member 8c of the removing auxiliary station 32B, the already pressed material 5b to be processed is moved onto the movable cover member 8d of the cooling auxiliary station 32C, and a new material 5a to be processed is moved onto the movable cover member 8a of the main station 31. Subsequently, the movable cover members 8a, 8d, 8c of the main station 31, cooling auxiliary station 32C and removing auxiliary station 32B are moved up, whereby in the main station, a new material 5a to be processed is subjected to pressing, and in the removing auxiliary station 32B, an already pressed and cooled material 5c to be processed is subjected to removal. On the other hand, in the cooling auxiliary station 32C, the movable cover member 8d is moved up and closed in the operating chamber 11a, the operating chamber 11c is interrupted and independent from the internal space 32a, and the already pressed material 5b to be processed is held within the chamber through the moving member 7d and support member 6c. Accordingly, cooling air or other coolant is continuously fed into the chamber through the cooling medium supply and discharge pipe line 56 to thereby positively and easily cool the material 5b to be processed to a predetermined temperature. The cooling system can be of a circulation type or of a shelf type, either of which can be used. (The detailed construction is not shown) During that period, in the inserting auxiliary station 32A, inserting operation of a new material 5 to be processed is carried out to again produce the FIG. 3(A) state.

According to the third embodiment, it is possible to incorporate not only hot isostatic pressing for a material 5 to be processed but also a cooling operation for a material to be processed required later according to the characteristic of material of a material to be processed into the press cycle and to complete the same. Thus, a separate cooling device need not be provided externally of the high pressure vessel 2, and a series of cycles can to occur with high efficiency to further enhance productivity. Also, cooling processing occurs by movement of material within the sealed tanks 12a, 12b and within the operating chamber 11c, and therefore, the quality can be maintained stably and evenly, and the whole apparatus including cooling can be designed so as to be compact.

Embodiment 4

Figure 4A:
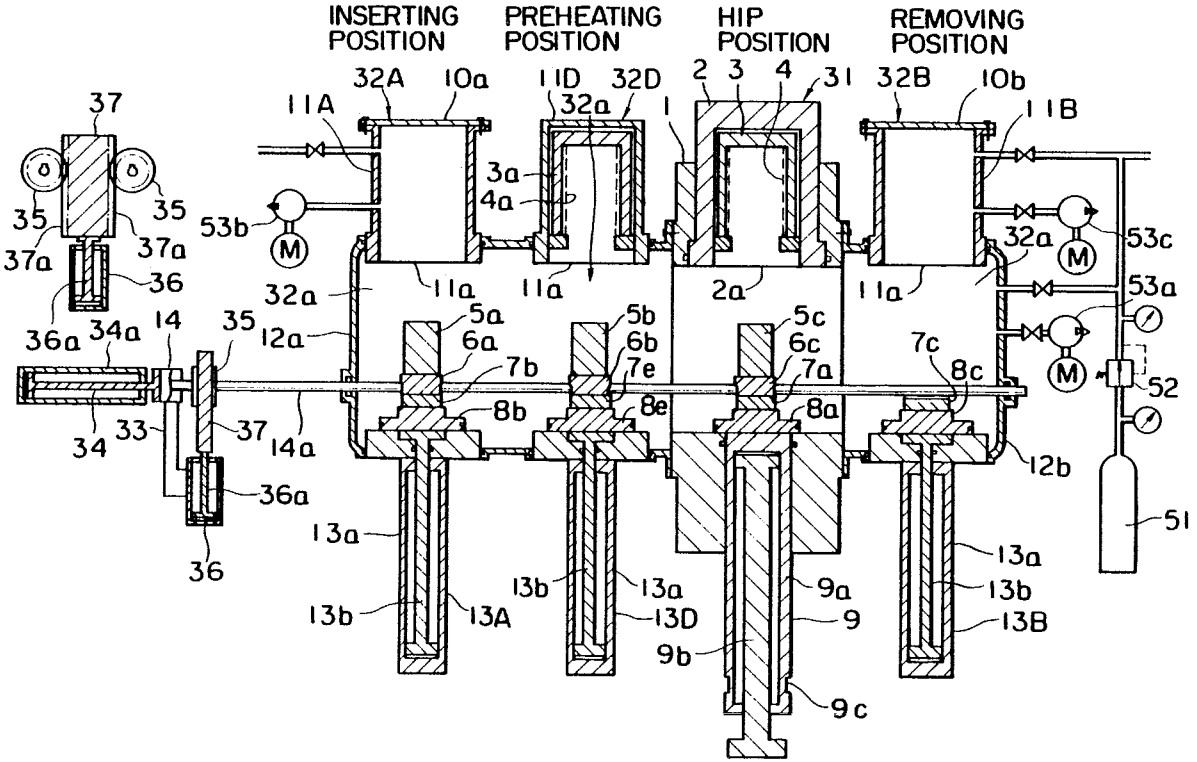
FIG. 4(A) is a longitudinal sectional front view of a fourth embodiment.
Figure 4B:
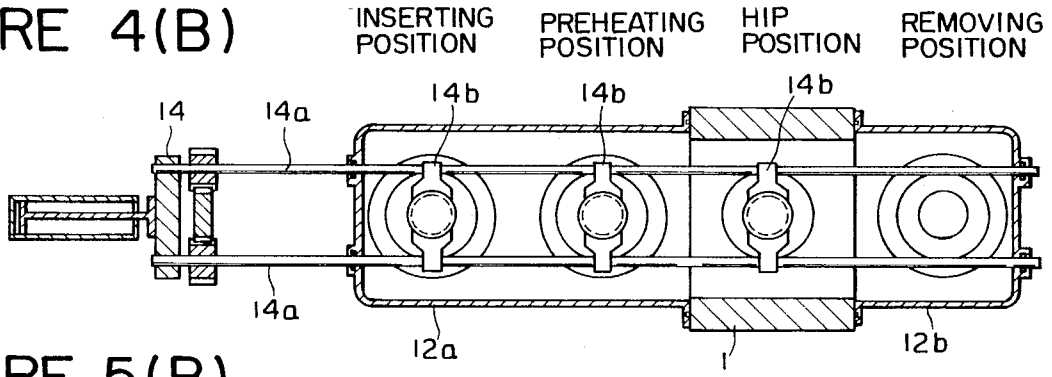
FIG. 4(B) is a cross sectional plan view of transfer.

In a fourth embodiment shown in FIG. 4(A) and FIG. 4(B), three auxiliary stations 32A, 32B and 32D are disposed adjacent to a main station 31, and in addition to an inserting auxiliary station 32A and a removing auxiliary station 32B, a preheating auxiliary station 32D for applying preheating processing as pre-processing to a material 5 to be processed prior to pressing is added. Thus, the stations 32A, 32D, 31 and 32B are arranged in said order. The same reference numerals as those used in the third embodiment indicate the same members as those shown in the third embodiment. The main station 31, inserting auxiliary station 32A and removing auxiliary station 32B are the same as those of the third embodiment, and therefore, only the construction of the preheating auxiliary station 32D will be explained. Since an operating chamber 11D in the preheating auxiliary station is provided to preheat a material 5 to be processed prior to pressing, the top of the operating chamber 11D is closed, and a preheater 4a is housed therein through a heat insulating layer 3a, which is nearly the same kind as the heat insulating layer 3 and heater 4 in the high pressure vessel 2 of the main station 31. Other constructions of the fourth embodiment are similar to those of the third embodiment except that a movable cover member 8e for openably closing an opening 11a at the lower end of the operating chamber 11D by an elevating device 13D and a moving member 7e provided on the upper surface of the movable cover member 8e are provided.

The press cycle of the fourth embodiment is a cycle of insertion, preheating, pressing and removal which is merely different from that of the third embodiment, which is a cycle of insertion, pressing, cooling and removal. Therefore, such difference therebetween will be mainly described. Where the state shown in FIG. 4(A) is a state wherein in the main station 31, a material 5c to be processed has already been pressed, and a movable cover member 8a is moved down to remove the material 5c to be processed from the vessel 2, in the inserting auxiliary station 32A, inserting operation of a new material 5a to be processed for next pressing has been completed, whereas in the preheating auxiliary station 32D (there is provided an energizing device though not shown), a material 5b to be processed to be pressed next which has already been preheated in the operating chamber 11D is removed from the operating chamber 11D to assume the illustrated position by the downward movement of the movable cover member 8e. Thus, from this state, three sets of clamp holders 14b, 14b in the transfer members 14a, 14a are made corresponding to support members 6a, 6b, 6c for the materials 5a, 5b, 5c to be processed in the stations 32A, 32D, 31, respectively, through the movement of the transfer members 14a, 14a, the clamp holders 14a, 14b are brought into engagement with the support members 6a, 6b, 6c through the rotation of the transfer members 14a, 14a, and the transfer members 14a, 14a are moved by one pitch rightwards as viewed in the drawing. Accordingly, the already pressed material 5c to be processed is fed onto the movable cover member 8c of the removing auxiliary station 32B, the already preheated material 5b to be processed is moved onto the movable cover member 8a of the main station 31, and a 5a to be processed to be pressed next is moved onto the movable cover member 8e of the preheating auxiliary station 32D.

Subsequently, the movable cover members 8e, 8a, 8c of the preheating auxiliary station 32D, main station 31 and removing auxiliary station 32B are moved up, whereby in the main station 31, the preheated material 5b to be processed is subjected to pressing, and in the removing auxiliary station 32B, an already pressed material 5c to be processed is subjected to removal via the operating chamber 11B. In the preheating station 32D, the movable cover member 8e is moved up and closed in the opening 11a of the operating chamber 11D, the operating chamber 11D is cut off and separated from the internal space 32a, and required preheating of a material to be processed 5a is carried out through the preheater 4a. Also in this case, an atmosphere as a preheater is protected, and therefore, even a preheater which to promotes oxidization at a high temperature can be used. During that period, in the inserting auxiliary station 32A, inserting operation for a new material to be processed is carried out. Accordingly, after completion of pressing in the main station 31, completion of preheating in the preheating auxiliary station 32D and completion of inserting operation in the inserting auxiliary statio 32A, the movable cover members 8*a*, 8*b*, 8*e* are moved down to again produce the FIG. 4(A) state.

According to the fourth embodiment, it is possible to incorporate not only hot isostatic pressing for a material 5 to be processed but preheating operation for a material to be processed required in advance into the press cycle and to complete the same. Thus, a separate preheating device need not be provided externally of the high pressure vessel, and a series of cycles can be obtained with high efficiency to further enhance productivity. Moreover, the preheating is carried out under the same circumstance as that within the high pressure vessel and the movement thereof is carried out within the sealed tank, and therefore, efficient, uniform and stabilized preheating is assured, heating time in the high presure vessel 2 can be reduced, and the whole apparatus to including the preheating assembly can be designed so as to be compact.

Embodiment 5

Figure 5A:
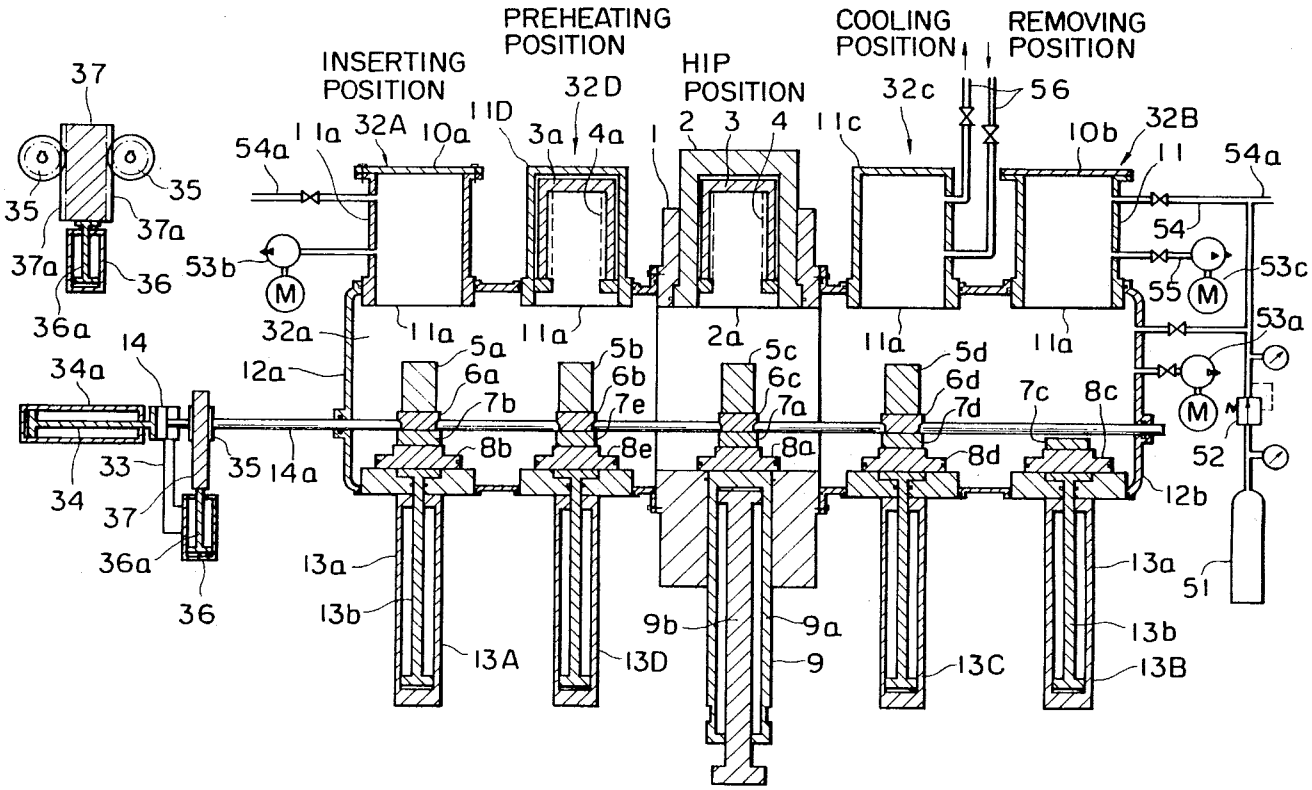
FIG. 5(A) is a longitudinal sectional front view of a fifth embodiment.
Figure 5B:
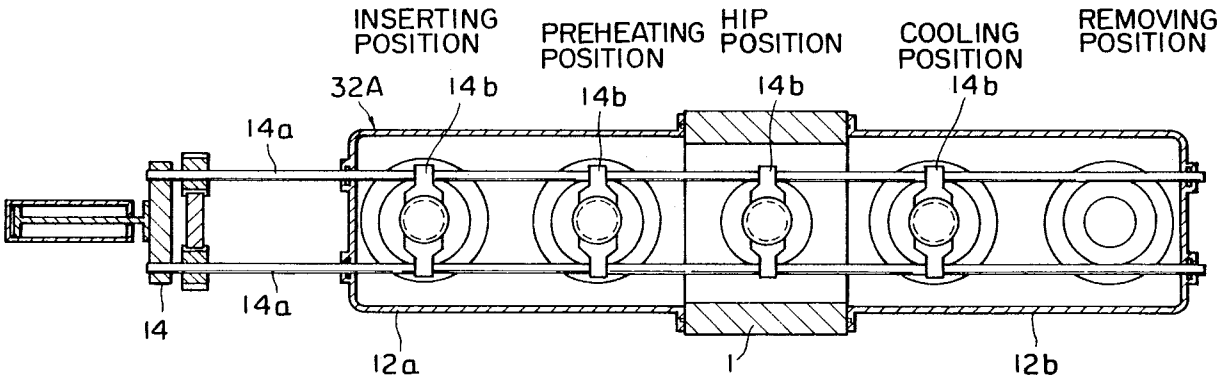
FIG. 5(B) is a cross sectional plan view of a transfer operation, FIG. 6(1*a*) and (1*b*) illustrate operation of the first embodiment, FIG. 6(II*a*) (II*b*) illustrate operation of the first and second embodiments, FIG. 6(III) illustrates operation of the fourth and fifth embodiments.

In a fifth embodiment shown in FIG. 5(A) and FIG. 5(B), four auxiliary stations 32A, 32B, 32C and 32D are disposed adjacent to a main station 31, and the cooling auxiliary station 32C in the third embodiment and the preheating auxiliary station 32D in the fourth embodiment are serially incorporated into a press cycle. Thus, the inserting auxiliary station 32A, preheating auxiliary station 32D, main station 31, cooling auxiliary station 32C and removing auxiliary station 32B are arranged in said order. The same reference numerals as those used in the previous embodiments indicate the same members as those shown therein. Since the construction of the stations 31, 32A, 32B, 32C and 32D is exactly the same as that of the previous embodiments, the description therefor will not be set forth. Needless to say, the sealed tanks 12*a*, 12*b* interrupt in common all the stations from outside, and internal spaces thereof are communicatingly covered and four sets of clamp holders 14*b*, 14*b* engageable with the support member 6 of the material 5 to be processed in the transfer members 14*a*, 4*b* are provided as shown in FIG. 5(B).

The press cycle of the fifth embodiment is a cycle of insertion, preheating, pressing, cooling and removal. Since the operating contents in the preheating and cooling stations are obvious in the fourth embodiment, only the essential portions of a series of cycles will be described in connection with FIG. 5(A). In FIG. 5(A), in a state wherein in the main station 31, a material 5*c* to be processed has already been pressed and then removed from the vessel 2, the material being moved down to the illustrated position, in the cooling auxiliary station 32C cooling of a material 5*d* to be processed pressed prior to a material 5*c* to be processed has been completed, in the preheating auxiliary station 32D preheating of a material 5*b* to be processed to be pressed next has been completed, and in the inserting auxiliary station 32A inserting operation of a material 5*a* to be processed to be molded next to next has been completed. Accordingly, if in this state, four sets of clamp holders 14*b*, 14*b* of the transfer members 14*a*, 14*a* are brought into engagement with the support members 6*a*, 6*b*, 6*c*, 6*d*, of the materials 5*a*, 5*b*, 5*c*, 5*d* to be processed, respectively, to move rightwards as viewed in the drawing by one pitch by the transfer members 14*a*, 14*a*, the already cooled material 5*d* to be processed is transferred to the removing auxiliary station 32B, the already pressed material 5*c* to be processed to the cooling auxiliary station 32C, the material 5*b* to be processed preheated for pressing next to the main station 31, and the material 5*a* to be processed newly inserted for pressing next to the preheating auxiliary station 32D, respectively. Therefore, a series of press cycles of insertion, preheating, pressing, cooling and removal are repeated in a fully automated manner so that removal of the already cooled material 5*d* to be processed in the station 32B, cooling of the already pressed material 5*c* to be processed in the station 32C, pressing of the already preheated material 5*b* to be processed in the station 31, preheating of the newly inserted material 5*a* to be processed in the station, and insertion of a new material 5 to be processed in the station 32A may be carried out.

In accordance with the fifth embodiment, in the hot isostatic pressing operation with respect to the material 5 to be processed, a series of operations including insertion and preheating required prior to pressing and cooling and removal required after pressing are carried out in a fully automated manner with extremely high efficiency and without dead time and loss time principally in terms of the fact that the already pressed material 5 to be processed can be discharged outside the vessel immediately after completion of pressing in the high pressure vessel 2. In addition, in the all the steps, movement of the material 5 to be processed is made within the sealed tanks 12*a*, 12*b*, and therefore, processing operation can be performed under the uniform and stabilized environment to provide enhancement of productivity and enhancement of quality, and moreover, compact design of the apparatus can be easily achieved.

While in the above-described embodiments, the openings 2*a* and 11*a* of the high pressure vessel 2 and operating chamber 11 are positioned at the lower end, it should be noted that these openings can be reversed in position so that the openings 2*a* and 11*a* are positioned at the upper end to provide the same effect. Furthermore, while in the embodiments noted, a vertical type is used, it will be to understood that a lateral type can be used. While in the embodiments, a serial arrangement is used, it will be further noted that a circular loop arrangement can be used. Moreover, prior processing and posterior processing to be applied to the material 5 to be processed prior to or subsequent to pressing comprise preheating and cooling, and in addition, heating and cooling can be also carried out stepwise by the serial juxtaposition of a plurality of the same auxiliary stations.

Figure 6:
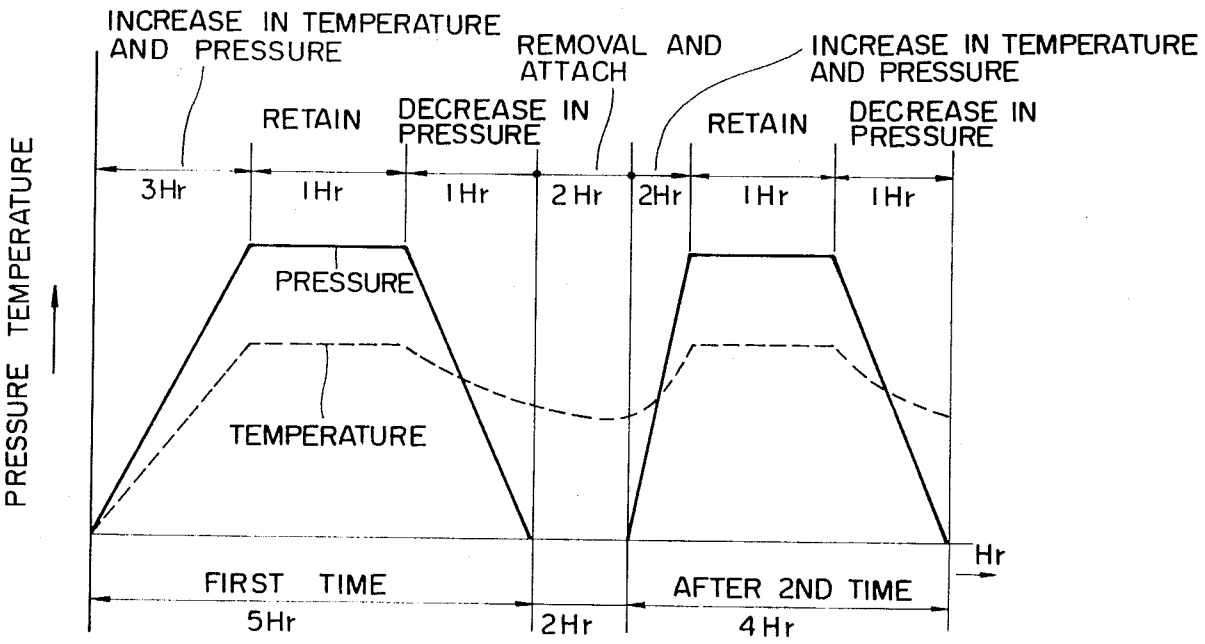
Figure 6:
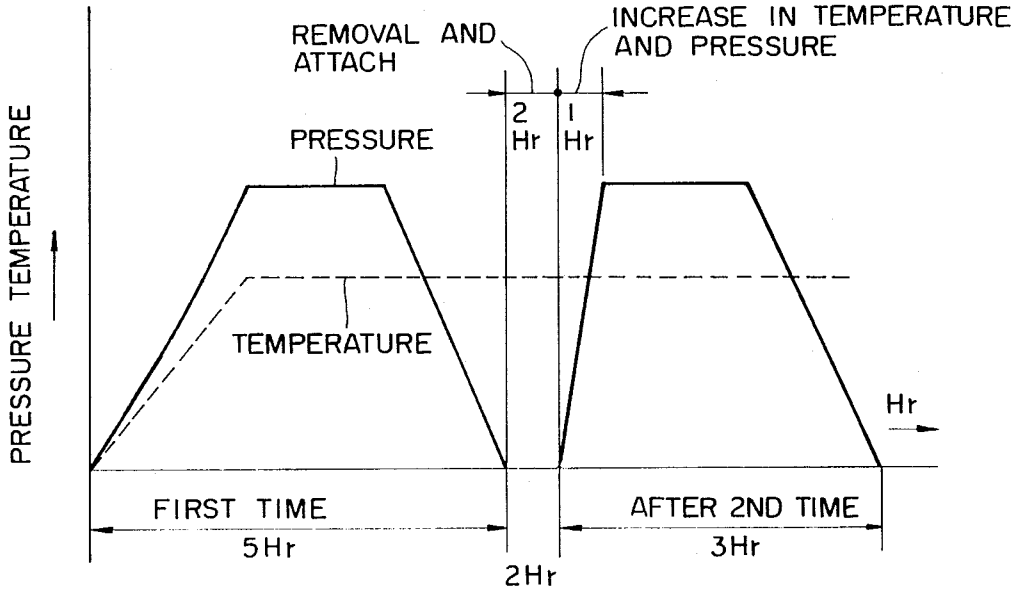
Figure 7:
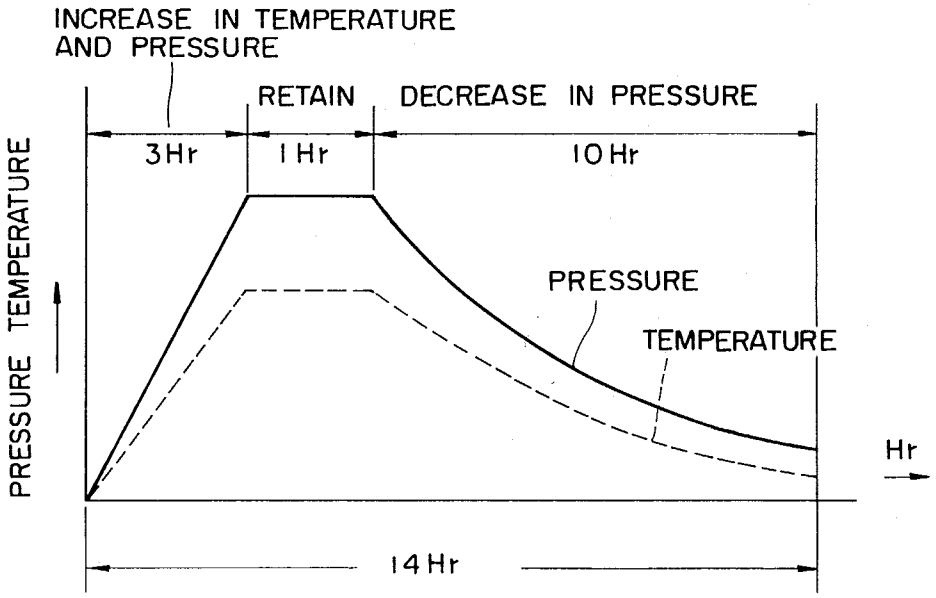
FIGURE 7 PRIOR ART

The hot isostatic pressing apparatus utilizing the high pressure vessel in accordance with the present invention is excellent insofar as such enables to industrial mass production for the first time. FIGS. 6 and 7 are graphic representations in the necessary operating time of the prior art and the present invention is shown in a process manner. In FIG. 7 which shows the prior art, the ordinate indicates the pressure and temperature, the the abscissa indicates the time, the solid line indicates the pressure curve, and the dotted line indicates the temperature curve. According to the prior art, in the high pressure vessel 2, it takes about three hours to increase pressure and temperature to a predetermined level. The retaining time for pressing at said pressure and temperature is about one hour. In removal from the vessel, it takes about ten hours to lower the temperature to an oxidizing preventive temperature (about 300° C.) of the heater as previously mentioned. The pressed article is removed from the container 2 after a lapse of said period of time, and therefore, the productivity is extremely low, the time occupied by the same vessel is extended and repetitive use thereof is impossible.

On the other hand, in the present invention, FIG. 6 Ia shows the state where the heater is OFF after processing in the above-described first embodiment, FIG. 6 Ib the state where the heater is ON, FIG. 6 IIa shows the state where the heater is OFF after processing in the above-described embodiments 2 and 3, FIG. 6 IIb the state where the heater remains ON, and FIG. 6 III shows those in the above-described embodiments 4 and 5. In FIGS. 6 Ia, Ib, IIa, IIb and III, the left half shows the required time for the first time, and the right half shows the required time thereafter. In the first embodiment, it takes about three hours for increasing the temperature and pressure for the first time, and it takes about one hour for retaining pressing. However, in removal of a pressed article from the vessel when the heater is OFF, it can be removed immediately merely by lowering pressure, and therefore, the time is reduced to about one hour. It requires two hours to insert and remove a material to be processed since one auxiliary station is used jointly. In the case where rapid increase in temperature is allowed, when the heater remains ON continuously in FIG. 6 Ib, time for increasing temperature and pressure is reduced to about one hour, depending on the properties of a material to be processed. In the above-described embodiments 2 to 5, the exclusive-use auxiliary station is used, and therefore, the time required for insertion and removal of the material to be process is reduced to about one half-hour, and after the second time, the time for increasing temperature and pressure in the high pressure vessel 2 is reduced to about two hours depending on the remaining temperature when the heater is OFF, and to about one hour when the heater is ON continuously. In FIG. 6 III, since a material to be processed is preheated, pressing a time period of about one half hour will suffice. It will be apparent that when the already pressed material 5 to be treated is removed from the high pressure vessel 2, a waiting time period is not required as was the case in the past, and so, progress of the press cycle with high efficiency and repetitive use of the high pressure vessel 2 for a short period of time is made possible to considerably enhance the productivity. This effectively results from the fact that the internal spaces of the stations are interrupted from outside by the common sealed tank and the same environmental atmosphere as that of the interior of the high pressure vessel 2 is formed. At the same time, the material 5 to be processed can be transferred and processed inside, and therefore, there occurs no change in quality and no damage occurs to the material to be processed, thus being effective in maintaining a stabilized and highly reliable quality. Moreover, since the interior of the operating chamber in the auxiliary station is in communication with the interior of the tank and is isolated by the movable cover, the pre- and post process can be independently and easily carried out under the environment suitable therefor, which can be advantageous.

Moreover, unlike the prior art apparatus which lacks unity including many handling operations such as that inserting means and removing means are exposed to the outside in the vicinity of the high pressure vessel, and cooling and preheating devices are remotely located, the present invention provides an arrangement wherein the main and auxiliary stations are adjacently positioned by as short distance as possible, the internal spaces are covered by the sealed tanks, and drive means and the like are collectively disposed, whereby the apparatus of the present invention can be designed in compact. The present invention is greatly advantageous so as to be that hot isostatic pressed products by the high pressure vessel can be industrially produced in volume.

Invention (II)

Figure 9:
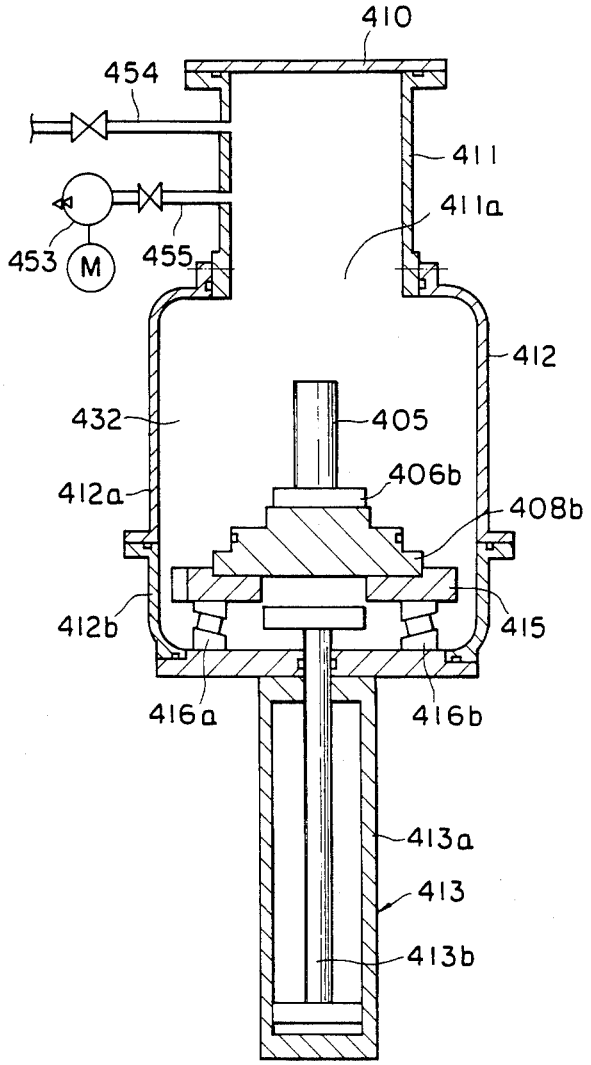

In the invention (II), a main station 431 (FIG. 10) and an auxiliary station 432 (FIG. 9) are the same in construction as those of the invention (I) described above, which will not be therefore described further.

Figure 8:
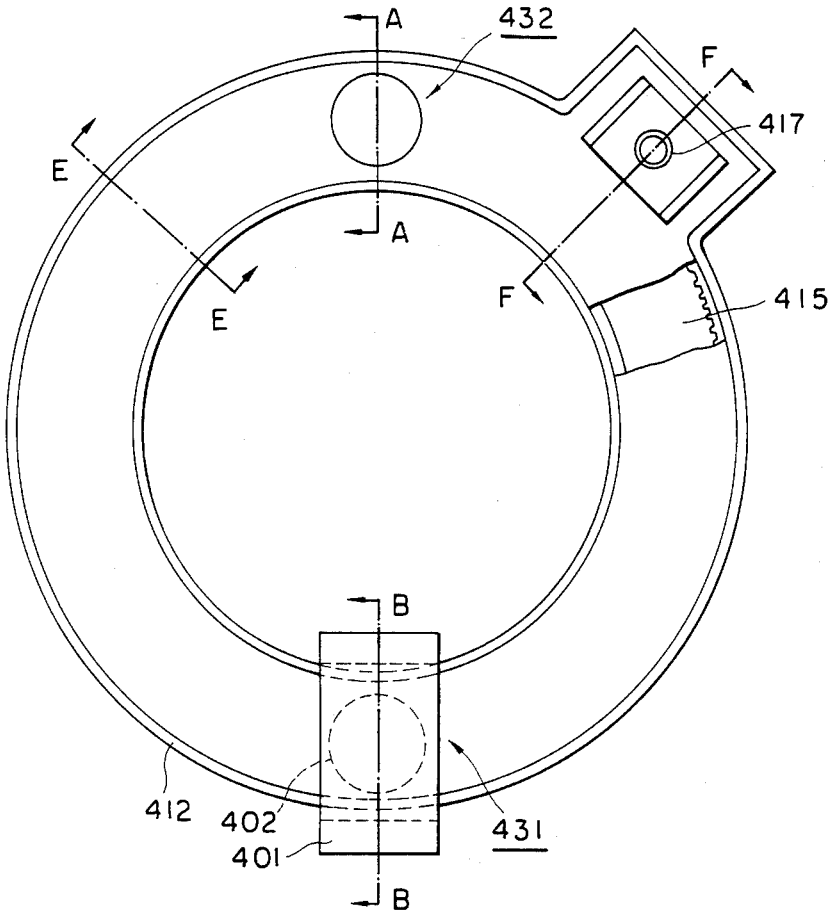

The stations 431 and 432 are arranged on the same circumference as shown in FIG. 8.

In the auxiliary station 432, a rotatable table 415 is provided for preparation in carrying a material to be processed 405 towards the main station 431.

A loop-shaped sealed tank 412, which is composed of an upper tank 412*a* and a lower tank 412*b*, is provided to interrupt internal spaces in the main and auxiliary stations 431 and 432 from outside and surround them in a communicating manner.

Movable cover members 408*a*, 408*b* are placed on the rotatable table 415 and are overlapped on the member 406*a*, in which case, if the material to be processed 405 is not yet pressed, the elevating device 409 is extended through a hole 415*a* formed in the rotatable table 415 to move upwardly the movable cover member 408*a* which is then closed over the opening 402*a* of the high pressure vessel 402. Thus, the material to be processed 405 is charged into the vessel 402 through the support and moving member 406*a* and the material to be processed 405 is subjected to hot isostatic pressing under the predetermined conditions of high pressure and high temperature. If the material to be processed 405 has already been pressed, the rotatable table 405 is rotated to transfer the already processed material to be processed 405 towards the auxiliary station 432.

EMBODIMENTS OF THE INVENTION (II)

Embodiment 1

FIGS. 8 to 12 illustrate a first embodiment of the invention (II), which is similar to that of the invention (I), and therefore, only the differences therebetween will be described. The movable cover member 408*a* is placed on the rotatable table 415, and the support and moving member 406*a* of a material to be processed 405 is provided on the upper surface of the movable cover member 408*a*.

As shown in FIG. 8, the main station 431 and auxiliary station 432 are arranged on the same circumference. A movable cover member 408*b* is placed on the rotatable table 415 corresponding to the auxiliary station 432, the movable cover member 408*b* having a moving member 406*b* of the material to be processed 405 provided on the upper surface thereof, and an internal space in communication with an internal space of the main station 431 is provided between the operating chamber 411 and the elevating device 413, the internal space being brought into communication through the loop-like sealed tank 412.

Figure 11:
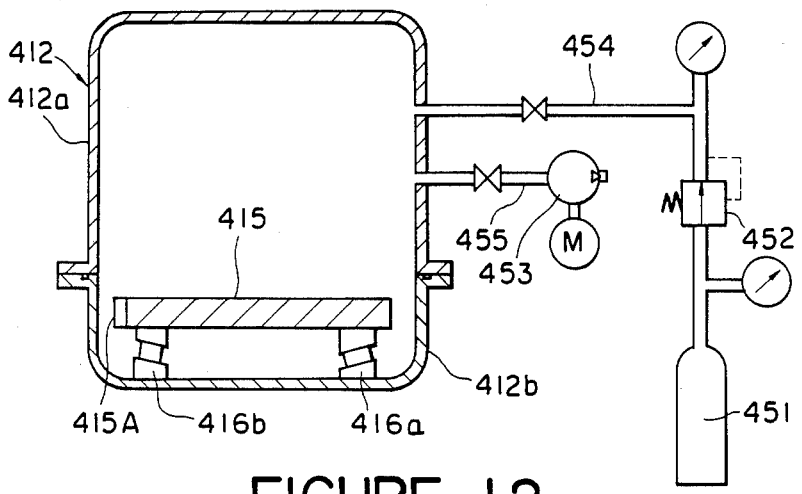

The sealed tank 412 for surrounding internal spaces of the main station 431 and auxiliary station 432 to protect them from outside is of a loop-like configuration in the form of a combination of upper and lower tanks 412*a* and 412*b*. Active or inert gas is supplied through a gas cylinder 451, a reducing valve 452 and a pipe line 454, as shown in FIG. 11, to the sealed tank 412 whereby the required gas atmosphere can be created over the whole area within the tank, and a vacuum pump likewise creates a vacuum state individually in the whole area in the tank and in the operating chamber 411 through a pipe line 455.

Within the sealed tank 412, the rotatable table 415 is rotatably provided on the horizontal surface through inner and outer bearings 416*a*, 416*b*, the rotatable table 415 being formed with holes 415*a*, 415*b* for the elevating devices 409, 413.

Figure 12:
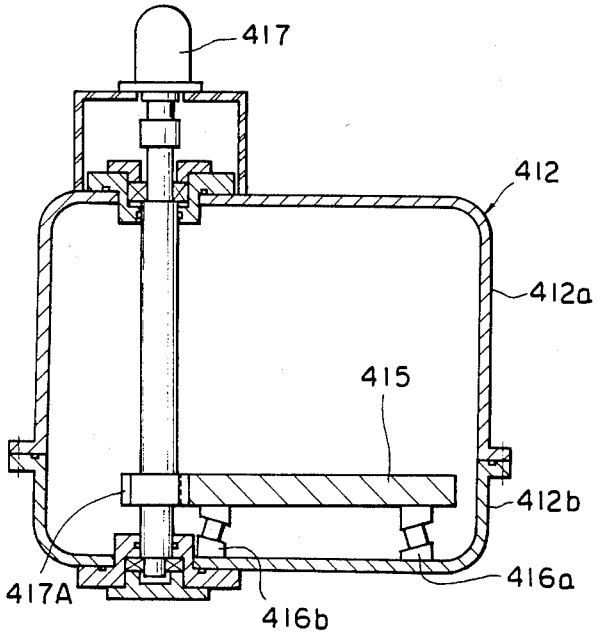

The rotatable table 415 is formed with a tooth portion 415A in an outer peripheral surface thereof, the tooth portion 15A being meshed with a pinion gear 417A, which is in turn driven by a motor 417 shown in FIG. 12. Accordingly, when the motor 417 is stopped, the rotatable table 415 is rotated on the horizontal surface by means of the bearings 416*a*, 416*b*, and the table 415 is stopped at a position where the holes 415*a*, 415*b* face to the elevating devices 409, 413, respectively.

It is noted that the drive means for the rotatable table 415 can be of the chain transmission type and thus other than the motor and gear.

Embodiment 2

Figure 10:
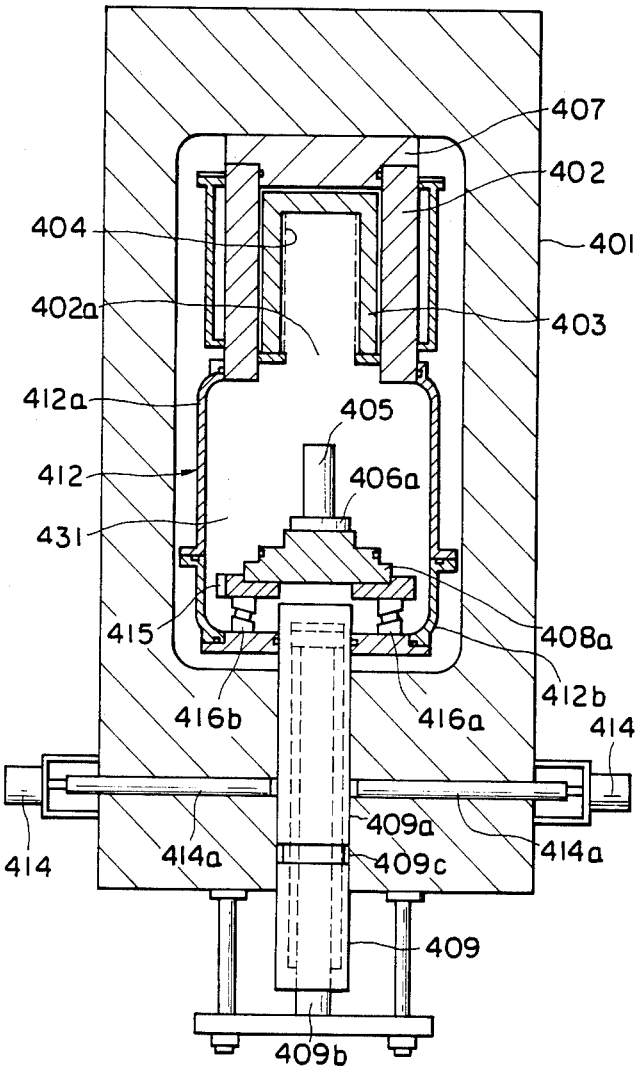
Figure 13:
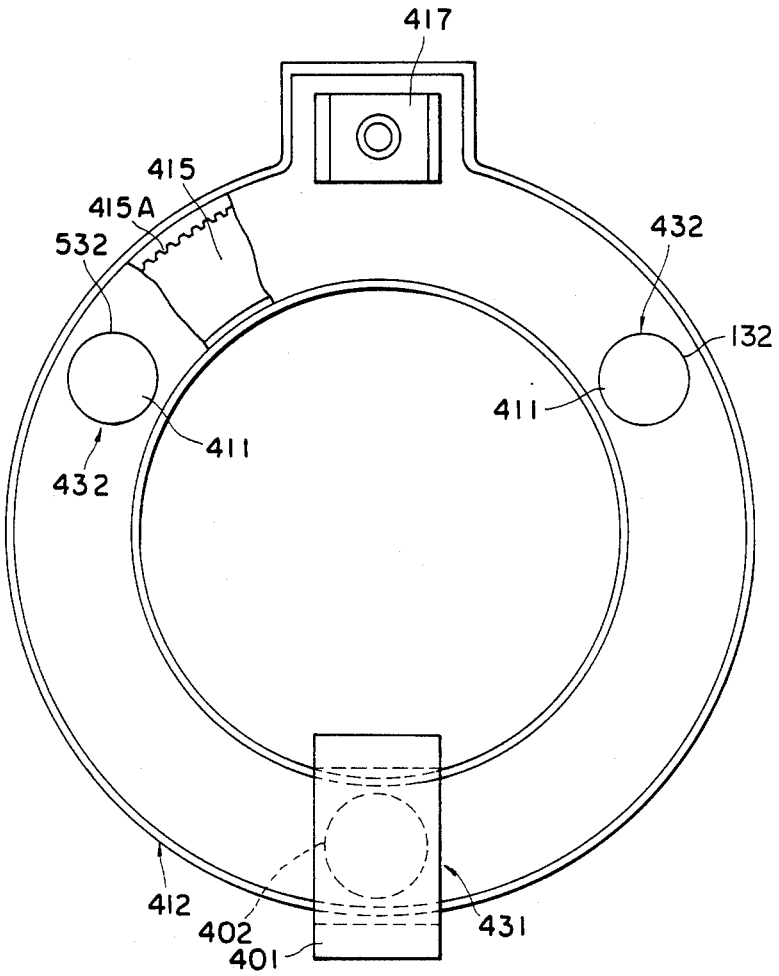

Referring to FIG. 13, two auxiliary stations 432 are arranged in an equally spaced relation on the same circumference with respect to the main station 431. The HIP apparatus, which has been described in detail referring to FIG. 10, is provided on the main station 431. One of the auxiliary stations 432 serves as an inserting station 432 for a material to be processed 405, whereas the other serves as a removing station 432 for the processed material to be processed 405. That is, in the first embodiment of the invention (II), the auxiliary station was in the form of an inserting and removing station, but in the second invention, it is separated individually. The construction of the inserting station 432 and removing station 432 is the same as that described in detail referring to FIG. 9.

In parts other than those described above, in the second embodiment, members common to those of the aforementioned first embodiment have the same construction and same reference numerals, which are therefore omitted from description to avoid duplication.

Accordingly, in the second embodiment, movable cover members are respectively placed on rotatable tables 415 corresponding to the stations 431, 432, 433. Upward and downward movement of a material to be processed by expansion of an elevating device through a moving member attached to the movable cover member causes synchronously continuous insertion operation of a material to be processed, HIP processing, and removal of an already processed material.

Embodiment 3

Figure 14:
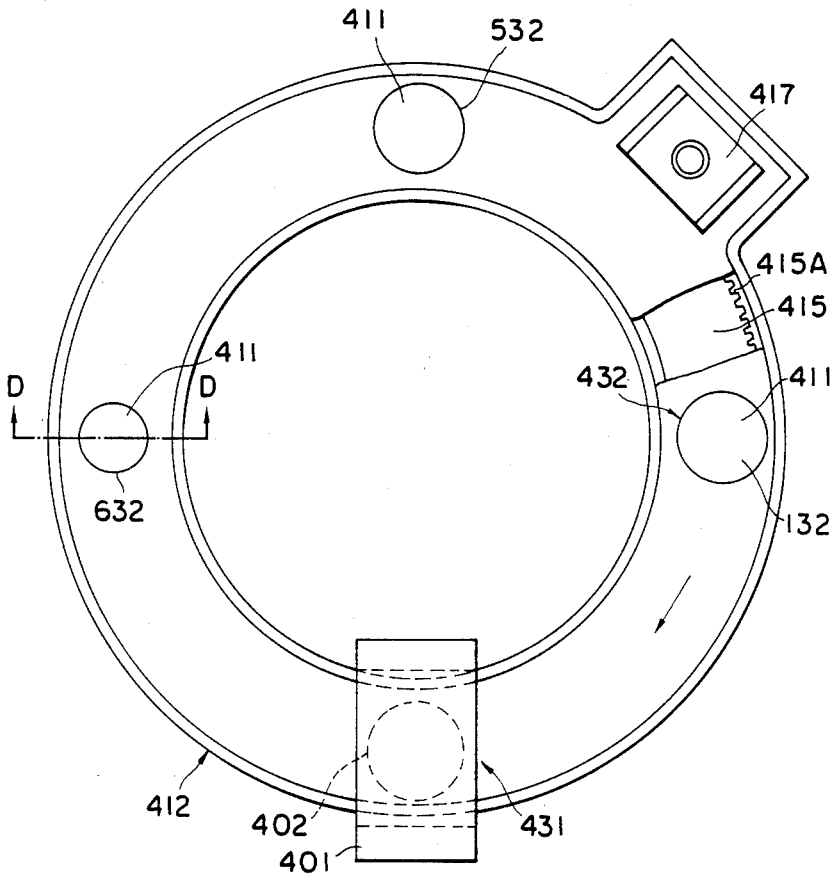

Referring to FIG. 14, three auxiliary stations 432, which comprise an inserting station 432, a cooling station 632 and a removing station 532, are arranged on the same circumference at intervals of 90°. In the third embodiment, a material to be processed is charged through a movable cover member or the like onto a rotatable table 415 within a sealed tank 412 from the inserting station 432 is transferred to the main station 431 by the turning of the rotatable table 415, where it is subjected to HIP processing, after which the material to be processed is turned and transferred to the cooling station 532 and then removed from the removing station 532. This operation is continuously carried out by the repetitive operation of rotation and stopping of the rotatable table 415 and by the repetitive elevating operation of elevating devices provided corresponding to the stations 431, 432, 532, 632.

Embodiment 4

Figure 15:
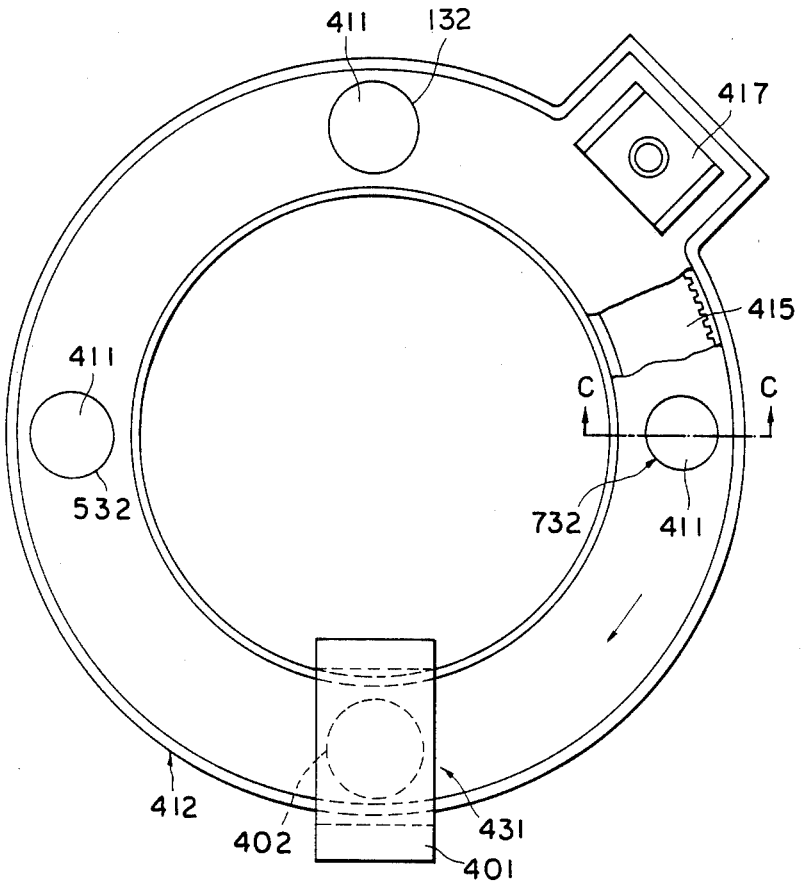

An arrangement shown in FIG. 15 is the same as that of the third embodiment shown in FIG. 14 in that three auxiliary stations 432 are arranged at intervals of 90° on the same circumference but are different therefrom in that the auxiliary station 432 comprises an inserting station 432, a preheating station 732 and a removing station 532.

Figure 17:
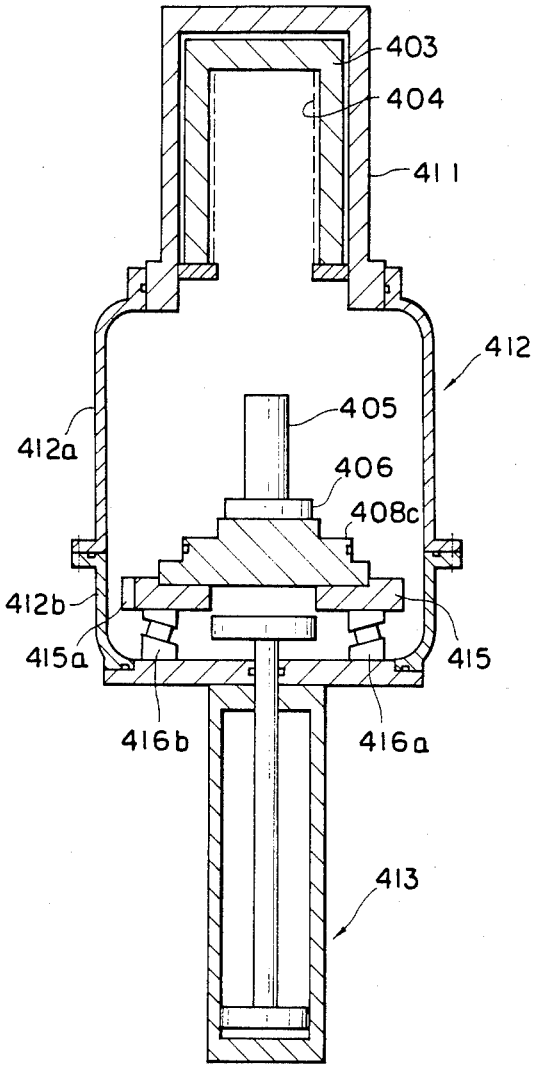
Figure 18:
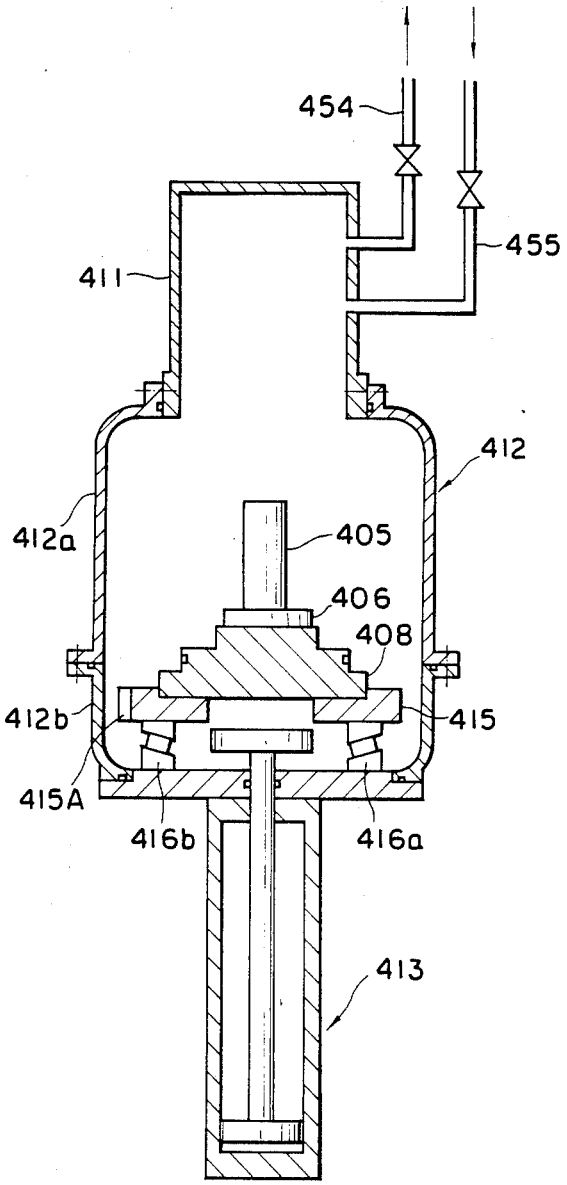

More specifically, the preheating station 732 is provided between the inserting station 132 and the main station 431. An operating chamber 111 of the preheating station 732 is provided with a heat insulating layer 403 and a heater 404 and the like as shown in FIG. 17, and the material 405 to be processed is preheated prior to the HIP processing.

Embodiment 5

Figure 16:
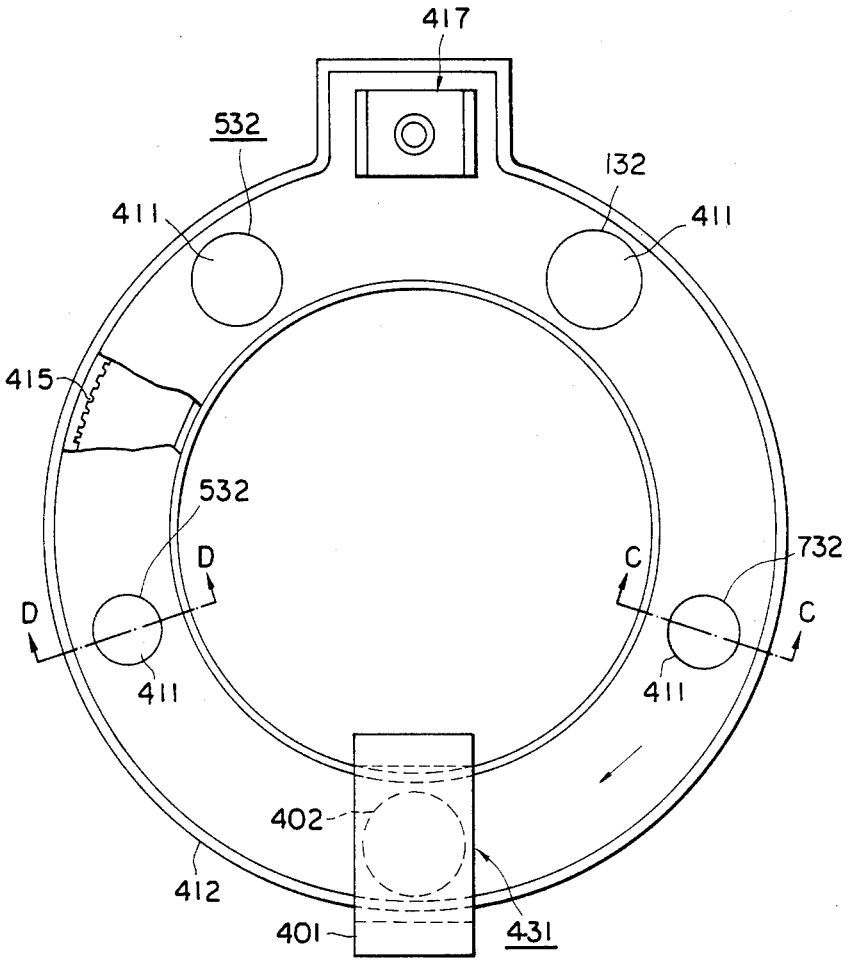

Referring to FIG. 16, four auxiliary stations 432 are arranged in an equally spaced relation at intervals of 72° on the same circumference with respect to a main station 431. The auxiliary stations 432 comprise an inserting station 432, a preheating station 732, a cooling station 632 and a removing station 532. The preheating station 732 is equidistantly provided on the same circumference between the inserting station 432 and the main station 431 for the HIP processing, and the cooling station 632 between the removing station 532 and the main station 431 for the HIP processing, respectively. The steps of inserting, HIP processing and cooling of a material to be processed are continuously carried out by the repetitive operation of turning and stoppage of the rotatable table 415 and by the elevating operation of elevating devices provided on the respective stations.

A series of operations from insertion to removal of a material to be processed are basically the same as those of the above-described embodiments 1 to 5. To make assurance doubly certain, a series of operations by way of the fifth embodiment as a typical example will be described hereinafter with reference to FIGS. 19 to 22.

Figure 19:
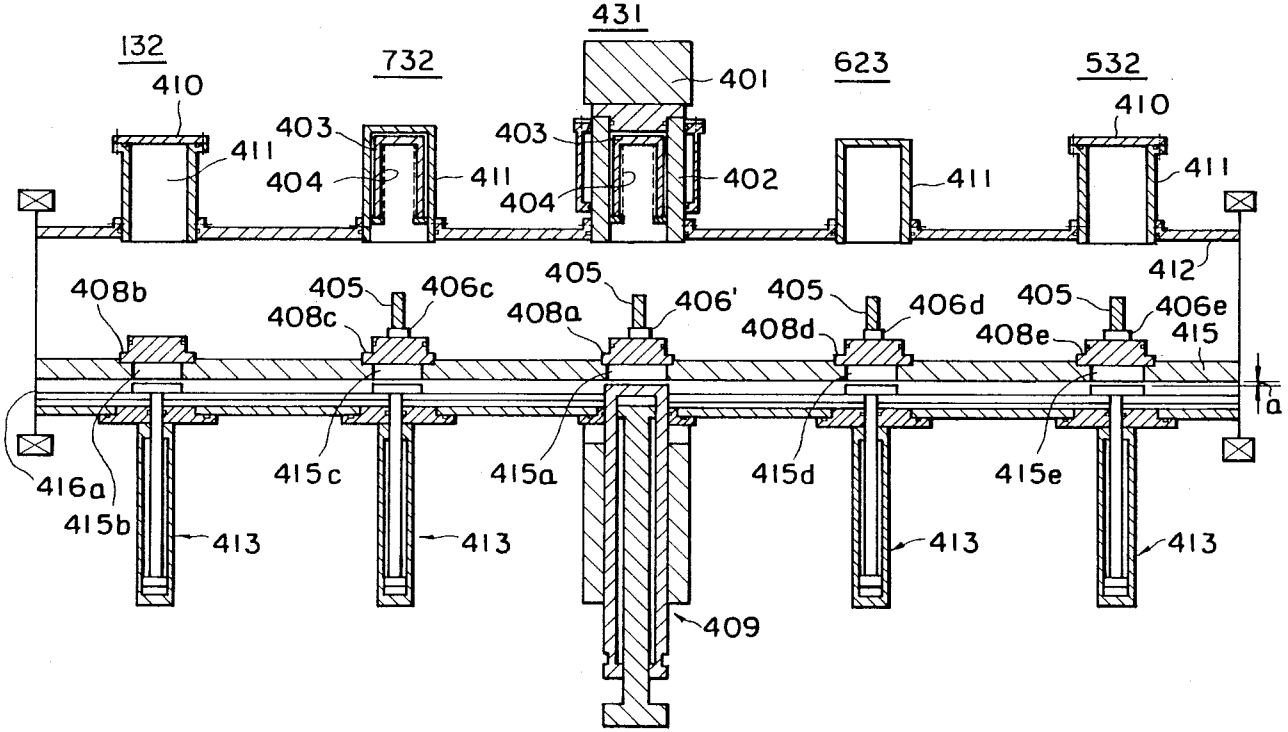

FIGS. 19 to 22 show in a developed form a loop-like sealed tank 412 and a rotatable table 415 rotatably provided in a horizontal plane within the tank. FIG. 19 shows the step before a material to be processed (the fifth material to be processed in the illustrated embodiment; and a material to be processed in the removing station has already been processed) is inserted into the inserting station 432.

As may be apparent from FIG. 19, holes 415*a*–415*e* are respectively formed at positions corresponding to the stations 431, 432, 532, 632, 732 of the rotatable table 415. Movable cover members 408*a*–408*e* are placed on the table corresponding to the holes 415*a*–415*e*, the movable cover members being moved up and down by the elevating devices 409 and 413, and an end of the elevating device is positioned at the lower portion of the holes 415*a*–415*e* through a clearance (a) in order to avoid an interference with the table 415 and the elevating devices 409, 413 to secure the turning of the table 415.

Figure 20:
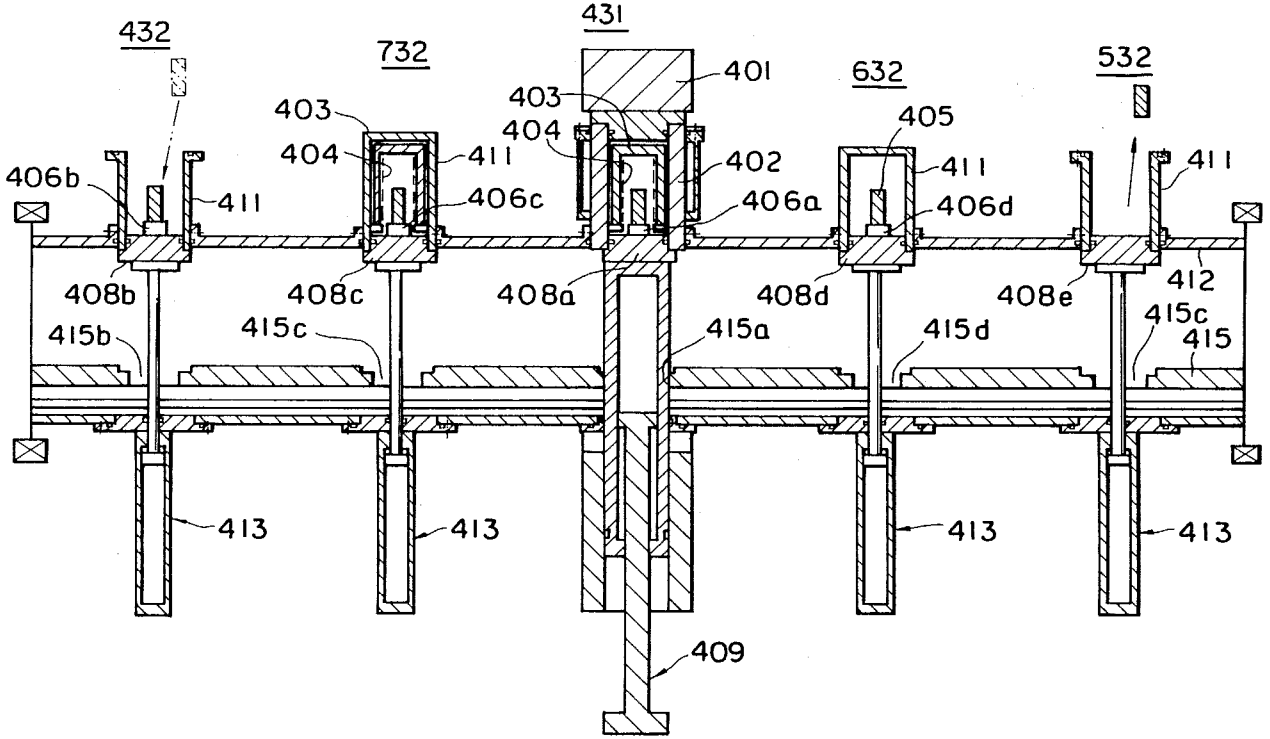

In insertion of a material to be processed, the elevating devices 409, 413 of the stations 431, 432, 532, 632, 732 are moved up, as shown in FIG. 20, to close openings of the operating chamber 411 and high pressure vessel 402 corresponding to the movable cover members 408*a*–408*e*. In the inserting station 532, a material to be processed is supplied to the operating chamber 411, and during that period, various operations are carried out at the same time which operations include preheating of a material to be processed in the preheating station 732, pressing of the preheated material to be processed in the HIP station 431, cooling of the already pressed material to be processed in the cooling station 632, and removal of the already cooled material to be processed (product) in the removing station 532.

Figure 21:
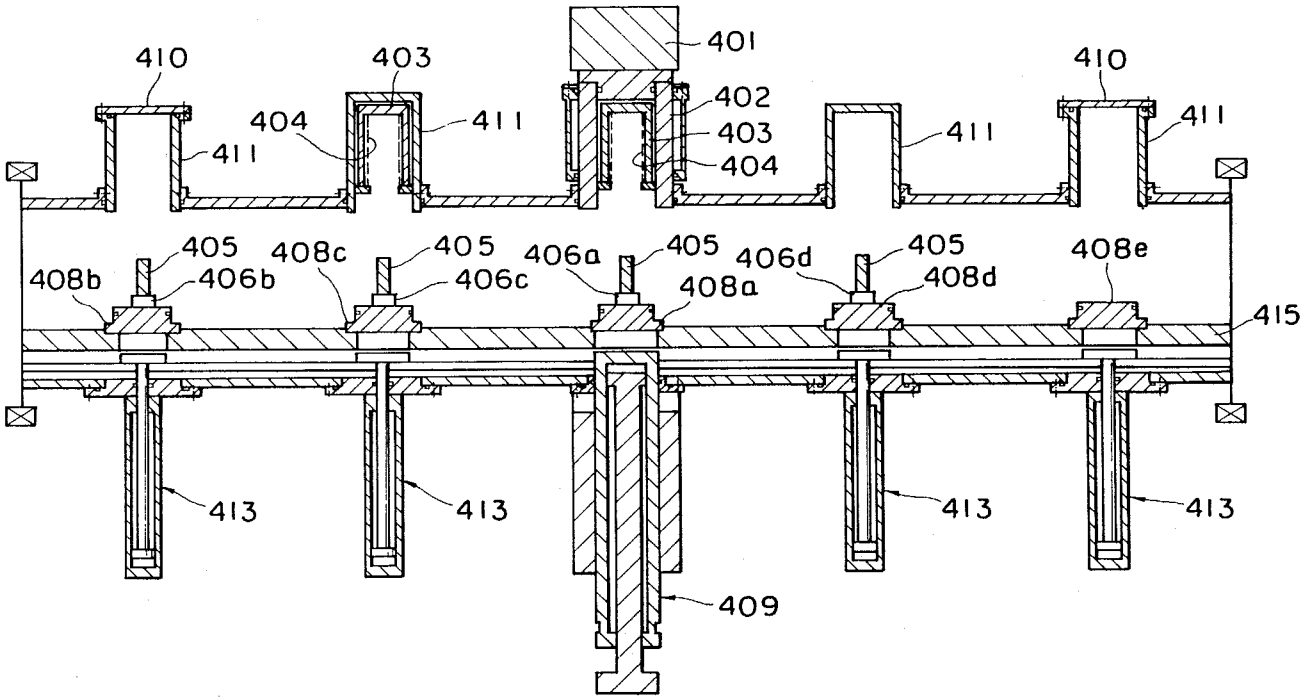
Figure 22:
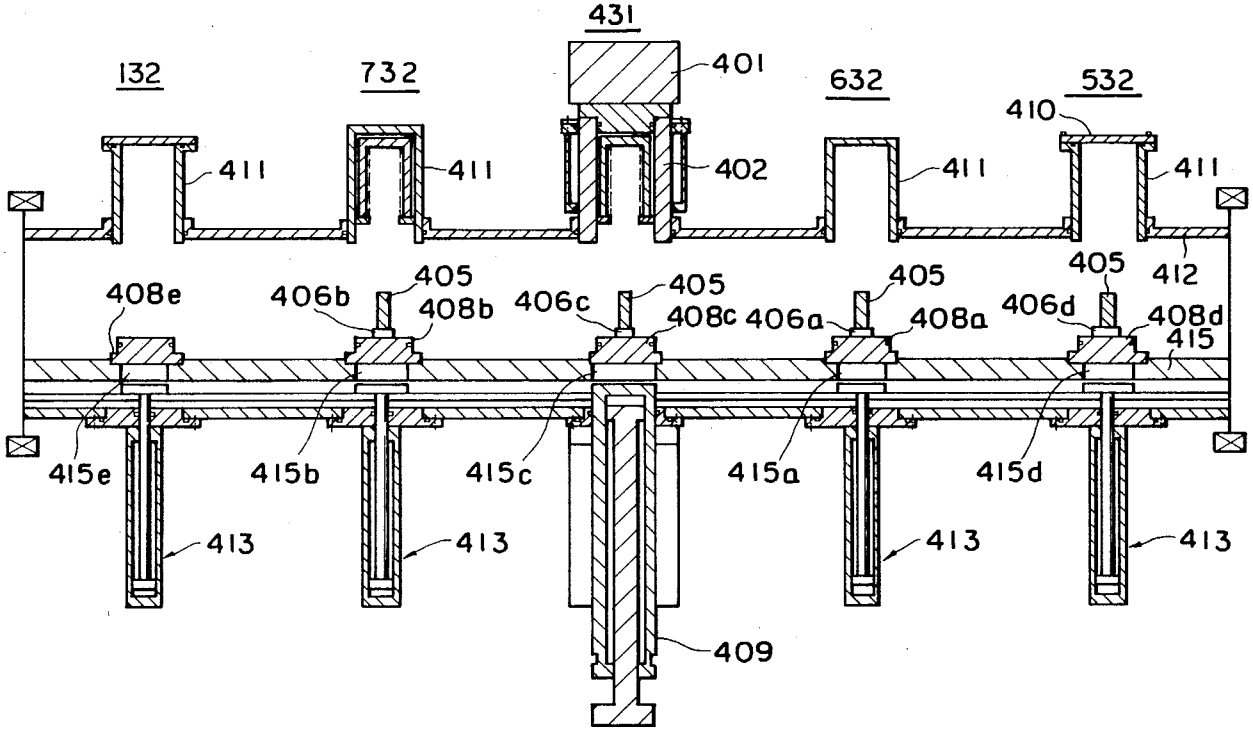
Figure 23A:
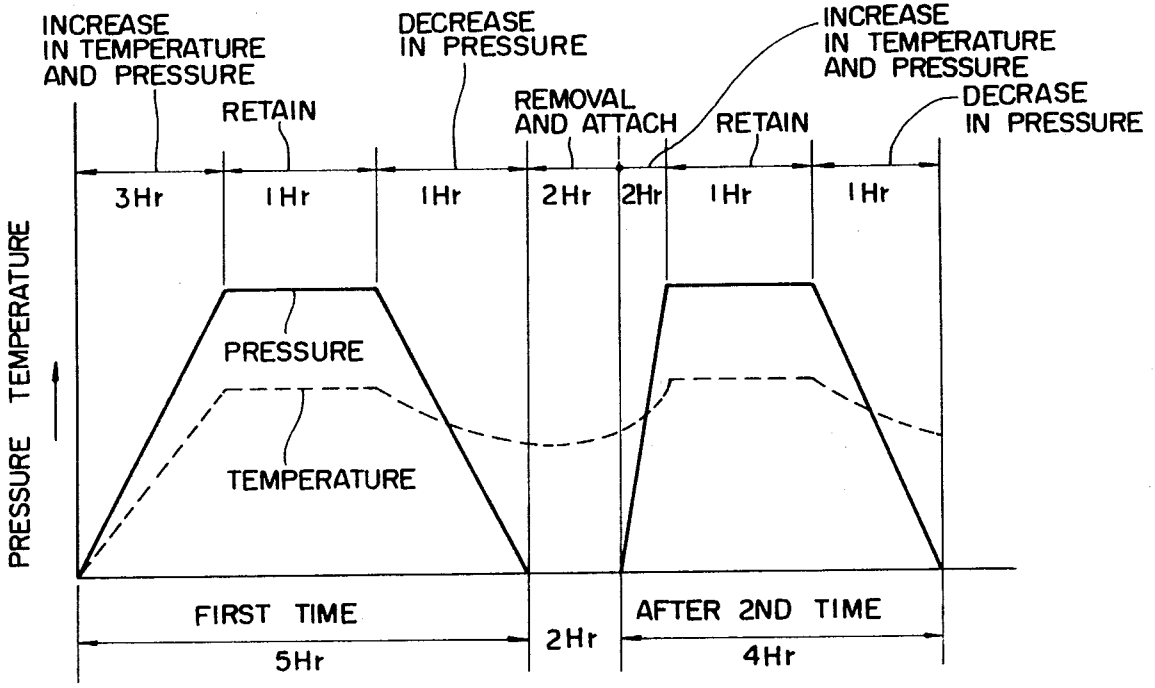
Figure 23B:
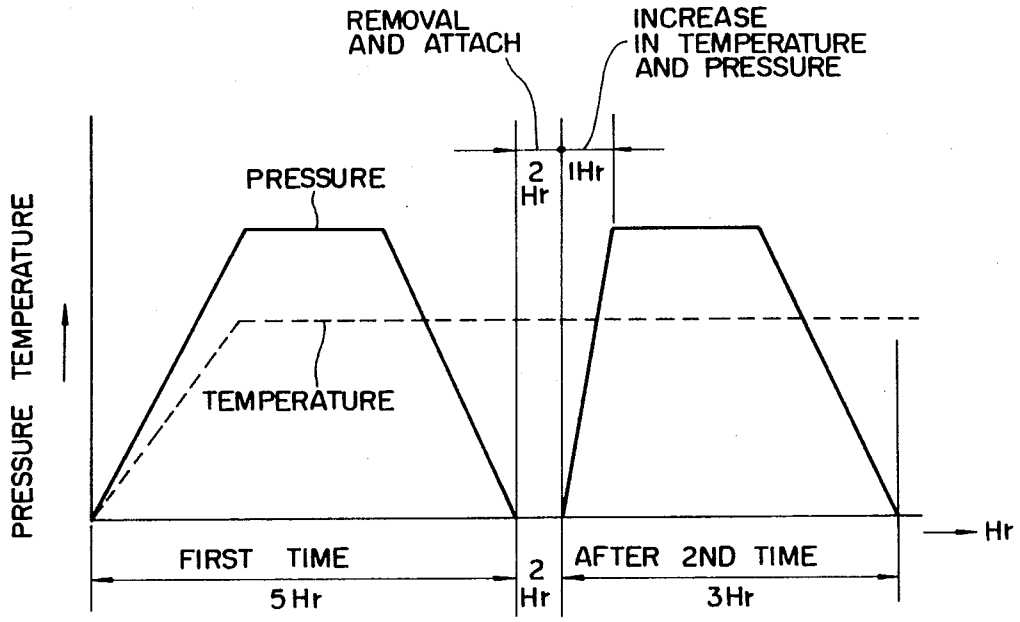
Figure 23C:
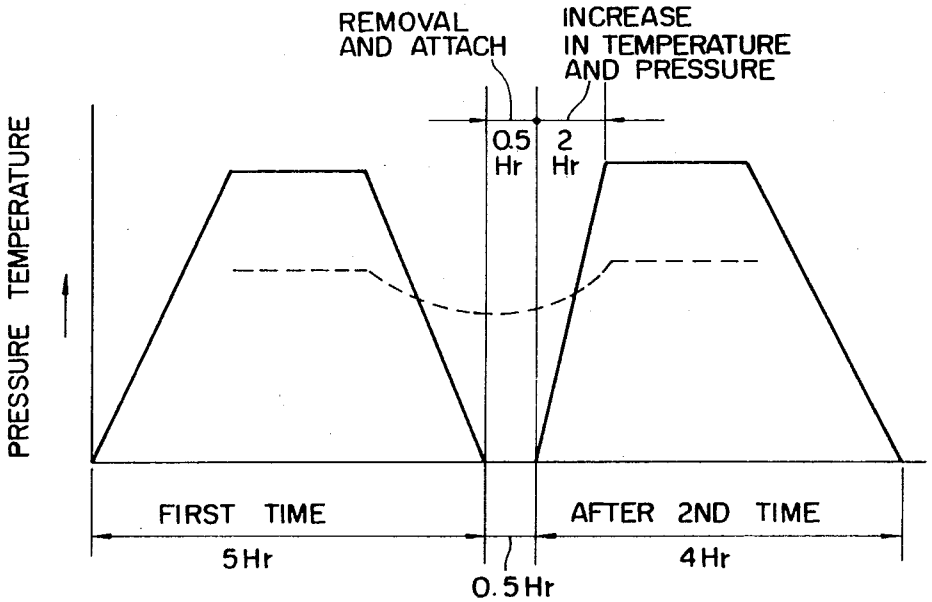
Figure 23D:
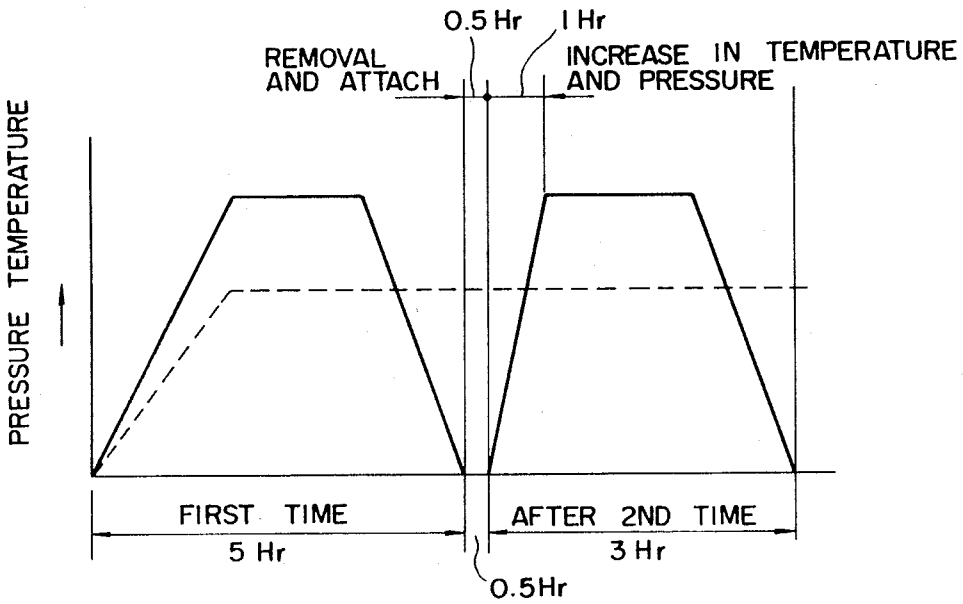
Figure 23E:
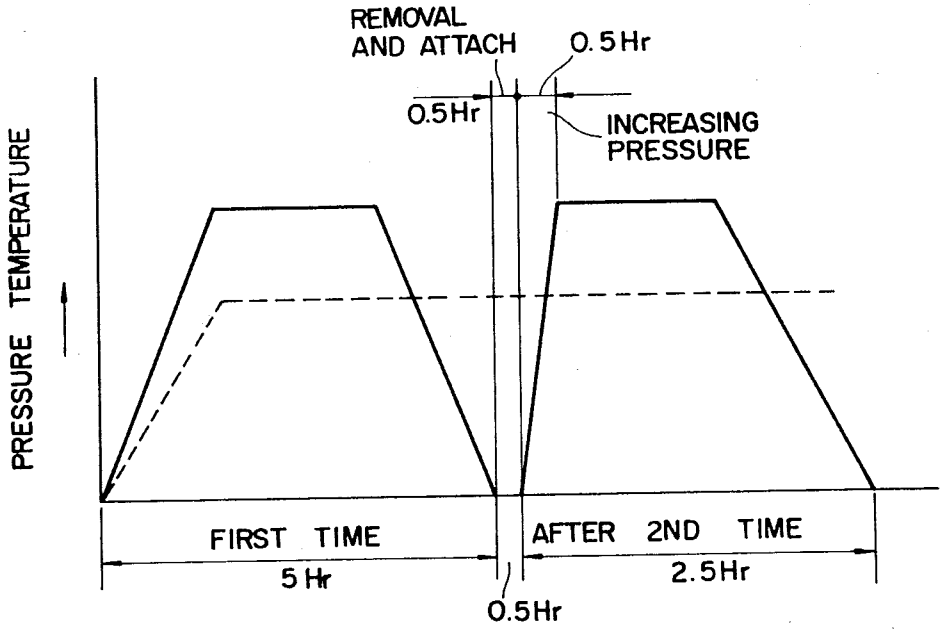

Next, as shown in FIG. 21, the elevating devices 409, 413 in the respective stations are all moved down to return to and place the movable cover members 408*a*–408*e* together with the moving members 406*a*–406*e* on the rotatable table 415, after which the rotatable table 415 is rotated to transfer at the same time all the materials to be processed to the respective stations for the next steps as shown in FIG. 22, thus assuming the same state as that of FIG. 19.

Figure 24:
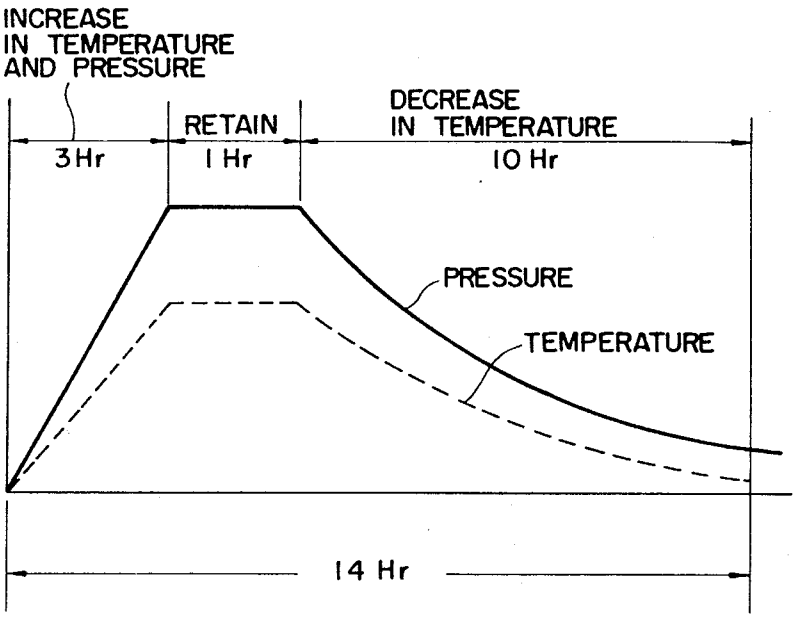
FIGURE 24 PRIOR ART

The effects obtained by the invention (II) are as graphically illustrated in FIGS. 23*a*–*d* as compared with those of prior art shown in FIG. 24. However, these effects are the same as described in the invention (I) in connection with FIGS. 6 and 7, and therefore, detailed description thereof will be omitted.

In the invention (II), however, since the sealed tank is in the form of a loop, within which the rotatable table is provided and a material to be processed or the like is transferred for each station, the transfer thereof is smooth and stabilized to prevent a material to be processed from being dropped.

Invention (III)

Figure 25:
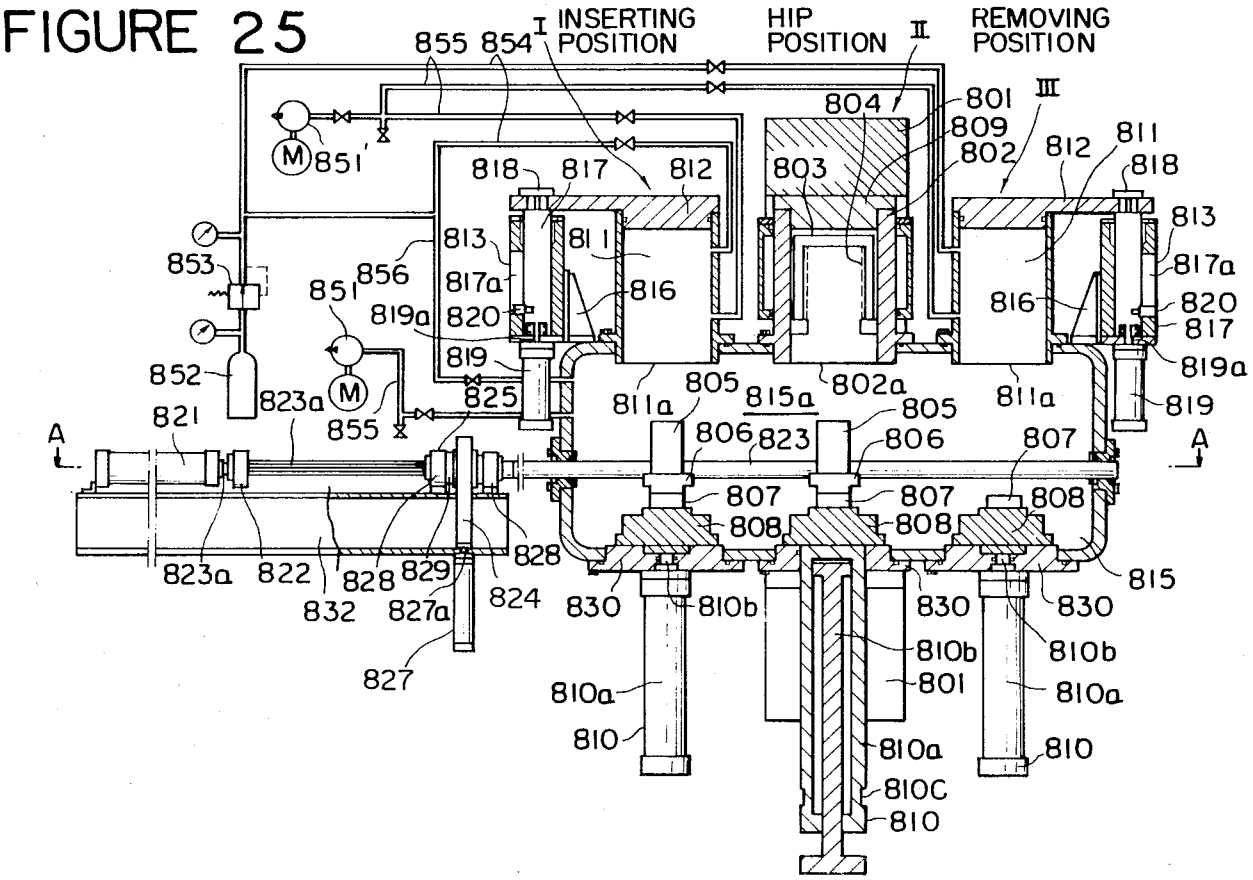
Figure 26:
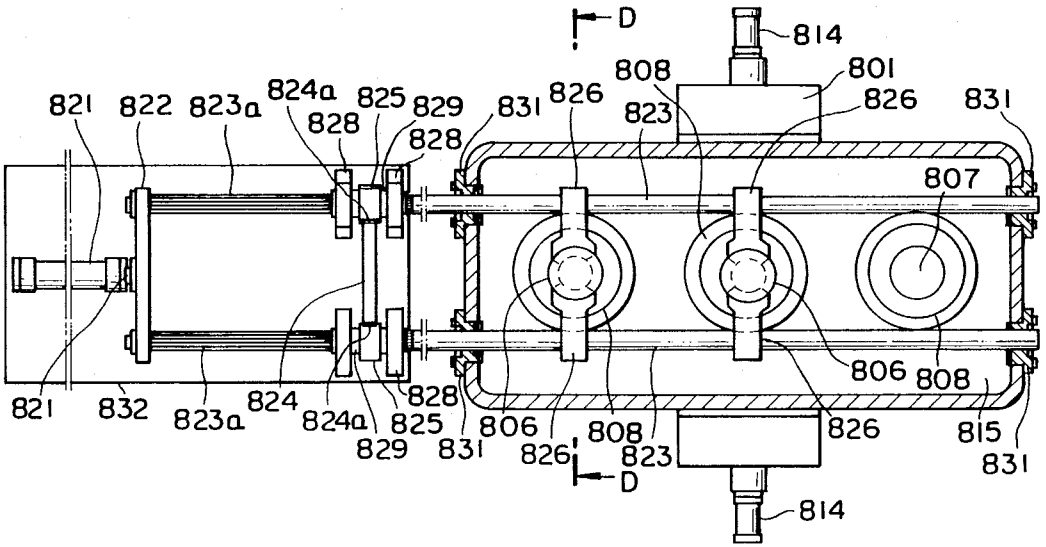
Figure 28:
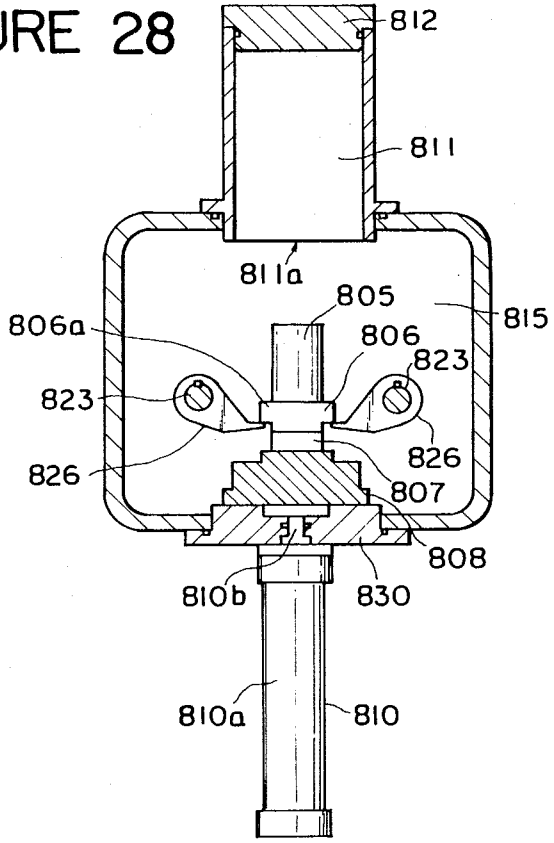
Figure 27:
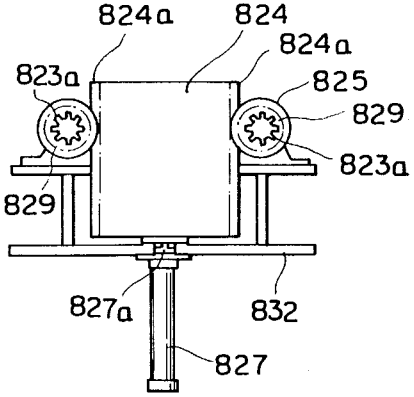

According to the invention (III), as shown in FIGS. 25, 26, 27 and 28, a plurality of operating stations according to operating steps applied to a material 805 to be processed, that is, a first station I, a second station II and a third station III in FIG. 25, are serially juxaposed on one side (upper side in FIG. 25) of a sealed tank 815 forming a closed operating space 815*a*. The first station I comprises a station for inserting a material to be processed, said station I being a station body composed of an operating chamber 811 provided at the upper end thereof with an opening and closing upper cover 812, the operating chamber 811 having an inlet and outlet 811*a* for a material 805 to be processed provided at the lower end thereof, said inlet and outlet 811*a* being open to an operating space 815*a*. The second station II serves as a forming station for applying hot isostatic pressing to a material 805 to be processed, said second station II being a station body composed of a known high pressure vessel 802 in the HIP apparatus. The vessel 802 is interiorly provided with a heater 804 through a heat insulating layer 803*a* in a known manner, and to which vessel are attached a high pressure gas generator, a vacuum device, a vessel cooler, a heater energizing device and the like though not shown. An upper cover 809 is provided on the upper end of the vessel 802 through a press frame 801, and at the lower end of the vessel 802, and inlet and outlet 802*a* for a material to be processed 805 is open in communication with the operating space and likewise the operating chamber 811 of the first station I. The third station III serves as a removing station for removing outside a material 805 to be processed heated and pressed within the high pressure vessel 802 of the second station II, said removing station being a station body composed of an operating chamber 811 provided at the upper end with an opening and closing upper cover 812, the operating chamber 811 likewise having an inlet and outlet 811*a* for a material to be processed 805 at the lower end therof, the inlet and outlet 811*a* being open in communication with the operating chamber 815*a*. In this manner, a plurality of operating stations I, II, III (three stations in the illustrated embodiment, but more than two stations can be provided as necessary) are serially juxaposed in order of operating steps to be applied to a material to be procesed 805 on one side of the sealed tank 815 forming a closed space 815*a*, and the inlet and outlets 811*a*, 802*a*, and 811*a* for the material to be processed of the above stations are directed at the closed space 815*a* and open in communication therewith, whereby operating spaces to be transferred for the next steps can be obtained upon termination of each step in a manner isolated from outside and in an extremely compact manner under collective conditions of operating steps, thus obtaining the shortest transfer route of a material to be processed, which material is formed of a blank sensitive to atmospheric environment and temperature environment. Accordingly, time and labor required for the purpose of transfer can be materially shortened and saved. In addition, opening and closing covers 808 capable of completely closing the inlets and outlets 811*a*, 802*a*, 811*a*, respectively, are supported on a base seat 807 or the like capable of placing and supporting the material to be processed 805 through a receiving base 806 as shown, at positions whose centers are the same as those of said inlets and outlets, as shown in FIG. 25, on the other side (lower side in FIG. 25) of the sealed tank 815 corresponding to the side where said stations are installed. Said covers are movable up and down and openable by the elevating device 810. A pair of transfer shafts 823, 823 which extend through the sealed tank 815 along the group of the opening and closing covers 808 are axially retractably provided, as shown in FIGS. 25, 26 and 28, directly above the opening and closing covers 808. Said transfer shafts 823 are provided rotatably about an axis. Gripping disengageable pawls 826, 826 capable of gripping and releasing, by normal and reverse rotation about an axis, the receiving base 806 of the material 805 to be processed on each base seat 807 of said opening and closing covers 808 are provided at positions opposed to the opening and closing covers 808 in the first and second stations I and II except the third station III, which is the removing station of the material 805 to be processed, as may be apparent from FIGS. 25 and 28, on the transfer shafts 823. Accordingly, the automatic transfer of the material 805 to be processed between the station I, II and III can be carried out within the closed operating space 815*a*. More specifically, in the state shown in FIGS. 25 and 26, pressing operation of the material 805 to be processed within the high pressure vessel 802 in the second station II is terminated, the inlet and outlet 802*a* of the vessel 802 is closed during the pressing, the opening and closing cover 8 supporting the material 805 to be processed through the base seat 807 and receiving base 806 is moved down by the elevating device 810, and at the same time, even in the first station, the opening and closing upper cover 812 is opened to insert a new material 805 to be processed onto the base seat 807 together with the receiving base 806 and the opening and closing cover 808 is likewise moved down by the elevating device 810. In this state, the shaft 823 on the righthand in FIG. 28 is rotated clockwise whereas the lefthand shaft 823 is rotated counterclockwise whereby the paired set of opposed disengageable pawls 826, 826 and 826, 826 are turned on the moved-down opening and closing covers 808, to engage and hold the receiving bases 806 of the materials 805, 805 to be processed at their symmetrical position. Accordingly, the receiving bases 806 can be also held so that the lower surfaces thereof may form a smaller gap than that of the upper surfaces of the base seats 707. Next, both the transfer shafts 823 are moved straight toward the third station III on the righthand in the figure by one pitch in the illustrated state whereby the previously pressed material 805 to be processed is moved opposite the opening and closing cover 808 in the third station III together with the receiving base 806, and a new material 805 to be processed inserted and set in the first station I is moved to a position opposite the opening and closing cover 808 in the second station II. At this position, both the transfer shafts 823, 823 stop, and if both shafts 823 are turned in a direction opposite to that of the previous case, the set of disengageable pawls 826, 826 and 826, 826 are all disengaged from the receiving bases 806, 806, and the materials 805, 805 to be processed are supported on the base seats 807, 807 of the opening and closing covers 808, 808 in the stations II and set free. Thus, if the opening and closing covers 808 are then elevated and closed over the in- and outlet 802*a* of the second station II and in- and outlet 811*a* of the third station III by the elevating devices 810, 810, respectively, the previously already pressed materials 805 to be processed are carried into the operating chamber 8911 isolated from the closed space 815*a*, the next new material 805 to be processed is sealed and set into the high pressure vessel 802, and in the third station III, the already pressed material 805 to be processed is removed outside whereas in the second station II, pressing under superhigh pressure is performed. At that time, both the transfer shafts 823, 823 are returned to the position shown in FIG. 25 during the period of the above-described operations to wait for removal of a next already pressed material 805 to be processed and for the receiving of a new material 805 to be processed. As described above, the operations in the operating stations I, II and III, movement of materials 805 to be processed in and out of the stations and movement thereof between the stations are repeated within the operating space 815*a* closed by the sealed tank 815 in a fully automated manner by the vertically movable opening and closing covers 808 and transfer shafts 823. In addition, since the operations are carried out in the closed operating space 815*a*, if said space is maintained under the required atmospheric environment, those elements which are liable to be oxidized under the atmospheric environment or to be changed in quality or the like, materials to be processed 805 possibly sensitive to variation in thermocondition and other members of the apparatus can be handled without any inconvenience, and quick, easy and safe operations are made possible by the shortest transfer route isolated from outside.

EMBODIMENTS OF THE INVENTION (III)

Embodiment 1

Figure 29:
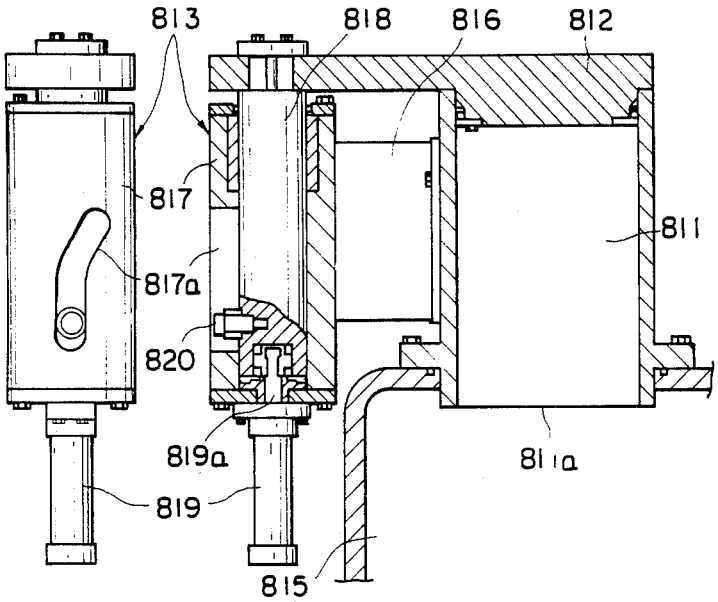
Figure 30:
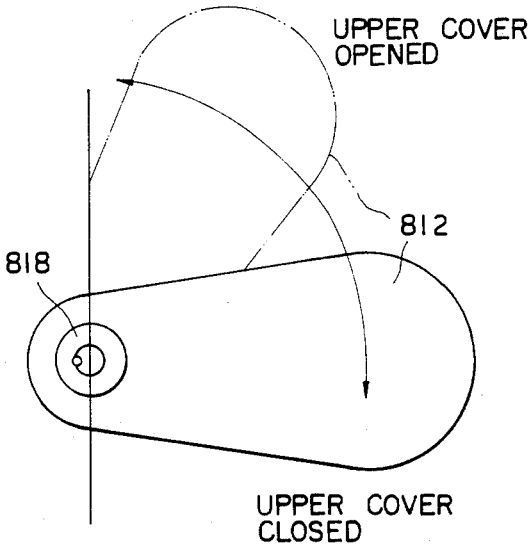

Embodiments shown in FIGS. 25 to 30 show a three-station type example in which transfer device of the invention (III) is applied to HIP apparatus. Here, a first station I serves as an inserting station for a material to be processed 805, a second station II as a forming station for pressing a material to be processed 805 into a block by superhigh pressure of hot isostatic pressure, and a third station III as a removing station for an already pressed material to be processed 805. The first and third stations I and III comprise a cylindrical operating chamber 811 upper and lower portions of which are open, the upper opening being opened and closed by an opening and closing cover 812. The opening and closing construction can be designed freely. In the illustrated embodiment, there is provided an opening and closing device 813 as shown in FIGS. 25, 29 and 30, in a sealed tank 815*a* operating chamber 811, a pivotal shaft 818 supporting one end of the opening and closing cover 812 is inserted rotatably and vertically movably into a guide sleeve 817 held through a mounting member 816, a piston rod 819*a* of a drive cylinder 819 is connected to the lower end of the pivotal shaft 818, and a slide pin 820 provided on a part in the periphery of the pivotal shaft 818 is slidably brought into engagement with a cam groove 817*a* formed in the periphery of the guide sleeve 817 whereby the piston rod 819*a* of the drive cylinder 819 is moved up and down to rotate and vertically move the pivotal shaft 818 through the slide pin 820 and cam groove 817*a* for automatic opening and closing. Both the stations I and II are designed so that a pipe line 855 is connected from a vacuum pump 851' as shown in FIG. 25 to provide suction and vacuum in order that the atmosphere within the operating chamber 811 is placed under the vacuum atmosphere or active or inert gas atmosphere as necessary. Necessary gas is supplied from a gas cylinder 852 through a reducing valve 853 and a pipe line 854. The sealed tank 815 comprises a rectangular tank formed of an airtight material. Above the sealed tank 815, a first station I, a second station II and a third station III are arranged, in said order, serially and in a manner such that centers thereof are at the same intervals, as shown. The opening chamber 811, high pressure vessel 802 and operating chamber 811 in the stations I, II and II have their lower portions secured to the upper surface of the tank 815. Inlets and outlets 811*a*, 802*a*, 811*a* at the lower end are all open in communication with a closed operating space 815*a* of the tank 815. Also in the operating space 815*a* of the tank 815, a pipe line 855 from a separate vacuum pump 851 is connected and a reducing valve 853 and a pipe line 856 are connected from a gas cyliner 852 in order to provide a vacuum atmosphere or active or inert an gas atmosphere as necessary. At positions corresponding to the inlets and outlets 811*a*, 802*a*, 811*a* for the material to be processed 805 in the stations I, II, III, base seats 830 are installed on the underside of the tank 815, a drive cylinder 810*a* as an elevating device 810 and a piston rod 810*b* are installed on the underface of the base seat 830, the opening and closing covers 808 connected to the rod 810*b* are disposed so as to be movable up and down on the upper surface of the base seats 810, and a base seat 807 on which a receiving base 806 supporting a material 805 to be processed 805 is placed and supported is formed on the top surface of the cover 808. In the elevating device 810 in the second station II, the drive cylinder 810*a* is connected to the opening and closing cover 808, and the piston rod 810*b* is made as the fixed side to cope with superhigh pressure in the high pressure vessel 802. A pair of transfer shafts 823, 823 for transfer of a material to be processed between the stations are juxtaposed parallel to each other through bearings 831, 831 so that the transfer shafts extend through the tank 815 in a spaced relation so as not to interefere with the opening and closing covers 808 may be provided retractably in an axial direction along the group of the opening and closing covers 808 and rotatably about an axis. In the transfer shafts 823, gripping disengageable pawls 826 that may be engaged or disengaged by rotation are fixedly mounted with respect to a flange 806*a* of the receiving base 806 of a material 805 to be processed at positions opposed to the opening and closing covers 808 of the first and second stations I, II except the final station III, whereby the material 805 to be processed is supported through the receiving base 806 so that it may be transferred. A mechanism to provide axial retractable motion of the transfer shafts 823 and rotational motion about an axis and in a direction opposite each other can be designed freely. In the illustrated embodiment, each end of the transfer shafts 823 which extend externally of the tank is formed with a spline portion 823*a*, as shown in FIGS. 25 to 28, said one end having an end rotatably connected to and supported on a cross head 822 supported on a piston rod 821*a* of a transporting cylinder 821 mounted on a base 832, and a spline sleeve 829 movably retained on the base 832 through bearings 828, 828 is fitted in the spline portion 823*a* of the shaft 823. A pinion 825 is mounted on the sleeve 829, and rack portions 824*a*, 824*a* formed on both sides of a rack 824 supported on a piston rod 827*a* of a turning cylinder 827 mounted on the base 823 are meshed with the pinions 825, whereby both the transfer shafts 823 may be synchronously retractably moved in an axial direction by the transporting cylinder 821, the pair of pinions 825, 825 are rotated in a direction opposite each other through the upward and downward movement of the rack 824 by the turning cylinder 827, and at the same time, the shafts 823 may be rotated about the axis. It is noted that the illustrated spline fit can be replaced by the key fit construction. In FIG. 25, an engaging portion 810*c* is provided in the periphery of the drive cylinder 810*a* of the elevating device 810 of the opening and closing cover 808 for opening and closing the inlets and outlet 802*a* of the high pressure vessel 802 in the second station II because when the cylinder move upwards so that the cover 808 assumes its closed position and, a clamp device 814 disposed at right angles to the engaging portion 810*c* engages the press frame 801 to secure the closed position.

According to the above-described embodiment, the interior of the operating space 815*a* of the sealed tank 815 is placed in the same vacuum state or active or inert gas atmosphere as that of the high pressure vessel 802 in the second station II, and the opening and closing cover 808 in the first station I is moved up to interrupt the operating chamber 11 from the operating space 815*a* to open the cover 812 and to place and set the material 805 to be processed together with the receiving base 806 on the base seat 807 of the opening and closing cover 808. Thereafter, the opening and closing cover 808 is moved down together with the material 805 to be processed to rotate the disengageable pawls 826 in the pair of transfer shafts 823 to grip the flange 806*a* of the receiving base 806. Movement of the transfer shafts 823 by one pitch causes transfer of the former to the position of the opening and closing cover 812 in the second station II. Then, the disengageable pawls 826 are released from their gripping to support the material 805 to be processed and receiving base 806 on the base seat 807 of the opening and closing cover 808 of the second station II. Next, the opening and closing cover 808 is moved up to close the inlet and outlet 802*a* of the high pressure vessel 802 and the material to be processed 805 can be charged and set in the vessel 802 together with the receiving base 806. Accordingly, while the hot isostatic pressing is applied to the material 805 to be processed in the second station II, the transfer shafts 823 are withdrawn, and in the first station, the opening and closing cover 808 is moved up to close the inlet and outlet 811*a* of the operating chamber 811 and open the cover 812 whereby a raw material 805 to be processed can be inserted and set. When the pressing operation is completed in the second station II, the cover 808 is immediately moved down to carry the already pressed material 805 to be processed to the position of the transfer shaft as shown in FIG. 25. Similarly, in the first station I, the cover 808 is moved down to carry a new material to be processed 5 to the position of the transfer shaft, and subsequently, the disengageable pawls 826 of the transfer shafts 823 are rotated to grip the receiving bases 606 of the materials to be processed 805. Then, the transfer shafts 823 can be moved by one pitch to move the material 805 to be processed to the position of the opening and closing cover 808 of the second station II and to move the already pressed material 805 to be processed to the position of the opening and closing cover 808 of the third station III. Accordingly, at this position, the disengageable pawls 826 are released from gripping, and in the second station II, charging and setting operation of a new material 805 to be processed into the high pressure vessel 802 is carried out, and in the third station III, movement of the already pressed material 805 to be processed into the operating chamber 811 is carried out, which operations are both carried out together with the closure of the inlets and outlets 802*a*, 811*a* by the upward movement of the opening and closing covers 808. In the third station III, the already pressed material 805 to be processed moved into the operating chamber 811 isolated from the operating space 815*a* is removed by the opening of the upper opening and closing cover 812. During that period, the pair of the transfer shafts 823 are withdrawn to their original position, and inserting operation of a new material 805 to be processed in the first station I can be carried out in a simultaneously progressing manner. A series of transfer motions can be carried out automatically by the motion of the disengageable pawls 826 through the upward motion of the opening and closing covers 808 in the stations I, II, III, the retractable motion of the pair of transfer shafts 823 in an axial direction, and the turning motion about the axis of the opening and closing covers 808 at the down position. In addition, such operation can be rapidly attained within the operating space 815*a* not affected by the external atmospheric pressure by the vertical movement in the shortest transfer route, horizontal movement and small turning motion about the axis. Only in the case of the HIP apparatus, in insertion and removal of a material to be processed into the high pressure vessel, even if the heater 804 is in an energized state and in a high temperature state, is it possible to form a non-oxidized atmosphere isolated from outside, and therefore, the already pressed material 805 to be processed can be immediately removed without waiting for cooling to occur for the already pressed material 805 to be processed. At the same time, it is possible to extremely shorten the press cycle and to transfer a material to be processed in a safe manner, thus facilitating enhancement of productivity as a whole.

Embodiment 2

Figure 31:
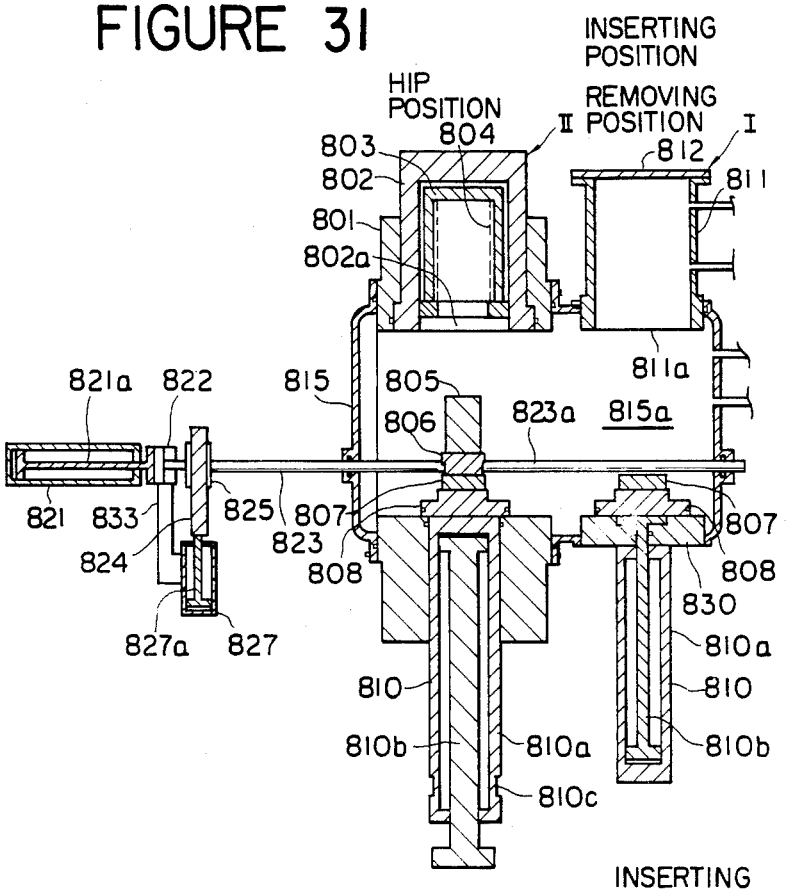
Figure 32:
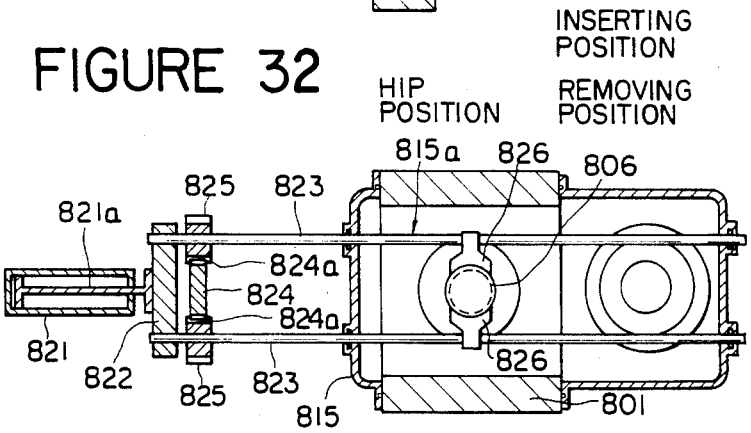

A second embodiment of the invention (III) shown in FIGS. 31 and 32 is of a two-station type. This second embodiment is similar to the above-described first embodiment, and therefore, only the differences therebetween will be described. A first station I serves as an inserting and removing station for a material 805 to be processed, and a second station II serves as a pressing station by way of a high pressure vessel 802. Thus, the first station I also serves as a final station, which therefore comprises only one set of disengageable pawls 826 in a pair of transfer shafts 823. In this embodiment, an opening and closing cover 812 at the upper portion of an operating chamber 811 in the first station I is not of an automatic opening and closing type but can be opened and closed manually. In a mechanism for axial movement and rotation for the pair of transfer shafts 823, a turning cylinder 827 of a rack 824 is supported on a cross head 822 by a supporting member 833. Further, pinions 825, 826 are directly mounted on the shafts 823 without provision of a sprocket on the transfer shafts 823 to mesh with the rack 824. In this case, the transfer motion is similar to that of the first embodiment except that in the first station I, the already pressed material 805 to be processed is removed, after which a new material 805 to be processed is inserted. It will be noted that the type of the first embodiment can be easily modified into the two-station type without need for further explanation. This will be all true for a multiple type station which will be described hereinafter.

Embodiment 3

Figure 33:
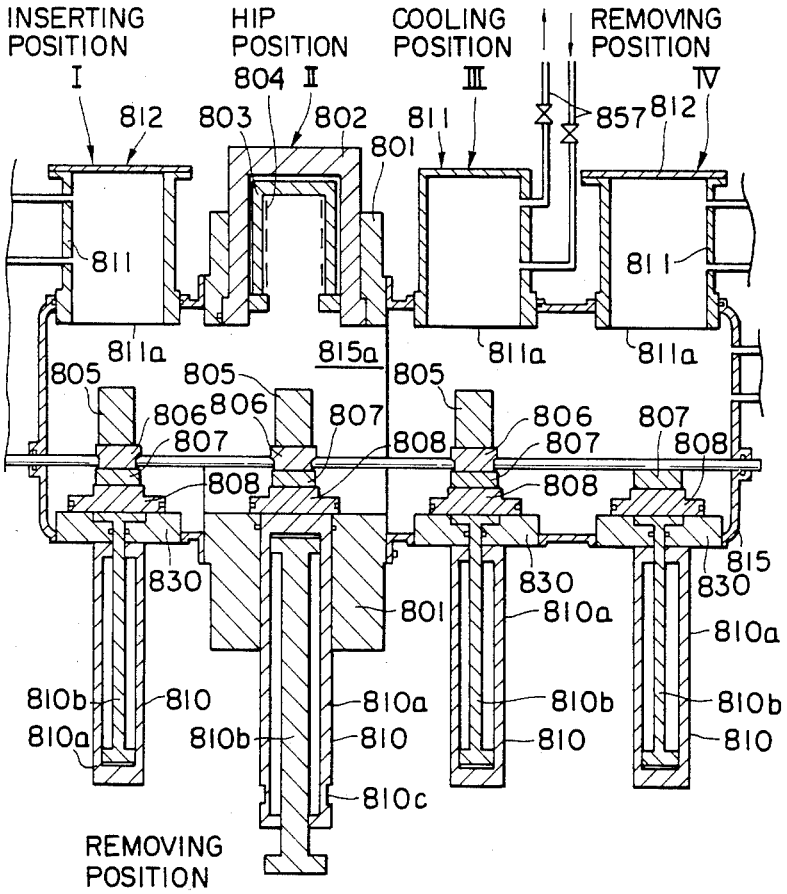

A third embodiment shown in FIG. 33 is of a four-station type, in which a first station I serves as an inserting station for a new material 805 to be processed, a second station II as a pressing station by way of a high pressure vessel 802, and a third station III as a station in which the material 805 to be processed pressed in the second station is immediately cooled to facilitate post-handling. An operating chamber 811 in the station III has a top closed with only a lower end formed with an inlets and outlet 811*a*, and a coolant supply and discharge line 857 is in communication with the operating chamber 811. Accordingly, the already pressed material 805 to be processed is removed from the second station II and then carried to the position of the opening and closing cover 808 of the third station III by the transfer shafts 823 and the cover 808 is moved up to isolate the operating chamber 811 from an operating space 815*a* and retain the material to be processed within said chamber to cool the material to be processed quickly and positively. Thus cooled material to be processed is transferred to the fourth station IV, namely, the removing station for removal thereof. By the employment of this type, cooling processing required later for a material 805 to be processed can be incorporated into a series of transfer cycle, and external cooling equipment need not be provided, cooling effect is stabilized and made even, and further the productivity of the press cycle can be increased. In this case, three sets of disengageable pawls 826, which are provided on the pair of transfer shafts 823, are provided opposed to the positions of the opening and closing covers 808 of the stations I, II, III except the position of the opening and closing cover 808 of the final fourth station IV.

Embodiment 4

Figure 34:
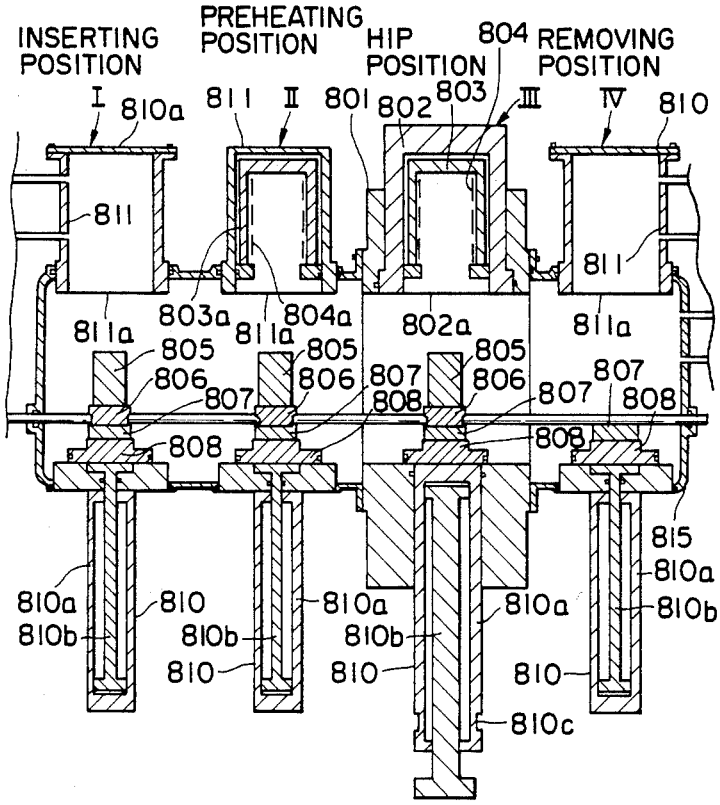

An embodiment shown in FIG. 34 is also of a four-station type, in which there is provided a station for applying preheating, as processing prior to pressing, to a material to be processed. A first station I serves as an inserting station for a material 805 to be processed, a second station II as a preheating station, a third station III as a pressing station, and a fourth station IV as a removing station. In the second station II for preheating, an operating chamber 11 has an upper portion closed with only a lower end formed with an outlet 811*a*, and the operating chamber 811 is interiorly provided with a preheater 804*a* through a heat insulating layer 803*a*. This preheating construction is about the same as that of the high pressure vessel 802. A material 805 to be processed inserted in the inserting station I is moved to the second station II by transfer shafts 823 and disengageable pawls 826 and transferred to an opening and closing cover 808 of the station II, after which the opening and closing cover 808 is moved up to close an inlet and outlet 811*a* of the operating chamber 811 and the material 805 to be processed prior to pressing charged into the chamber is subjected to preheating and thereafter transferred to the pressing third station III. According to this embodiment, preheating required for a a material 805 to be processed is incorporated into a series of transfer cycle, and external preheating equipment need not be provided. The preheating can be carried out easily under the same environment as that of the interior of the high pressure vessel. A preheater 804*a*, which is possible be oxidized at a high temperature, can be used under the environmental atmosphere without any inconvenience, and uniform and stabilized preheating can be obtained. Also, the heating time period in the high pressure vessel in the third station III is shortened, to series of press cycles is shortened and the productivity is enhanced.

Embodiment 5

Figure 35:
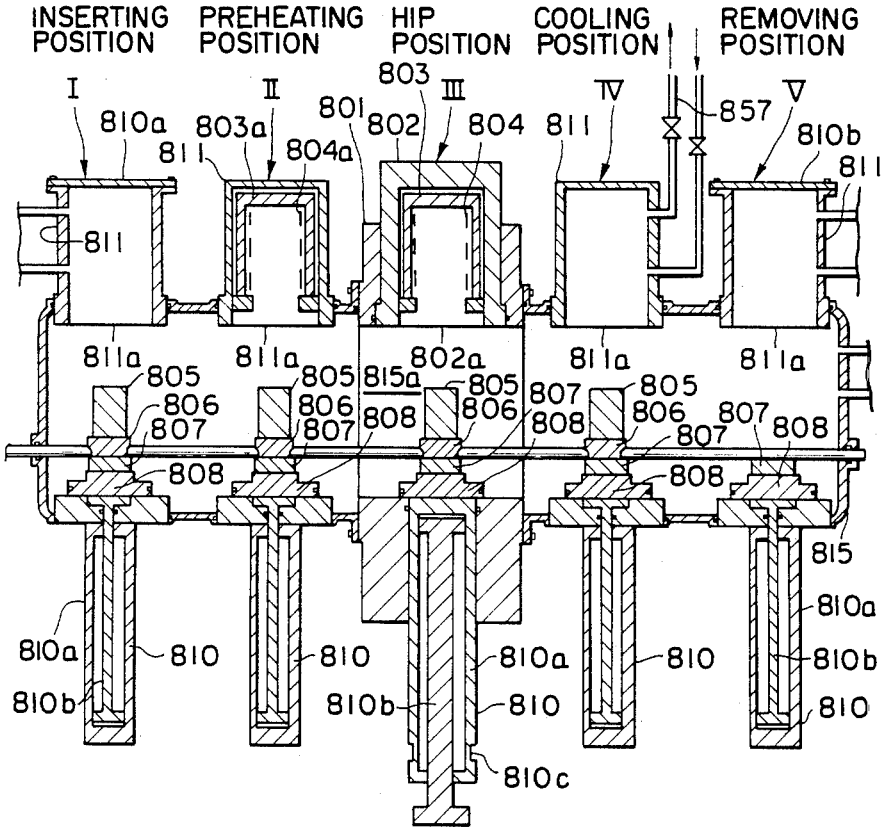
Figure 36:
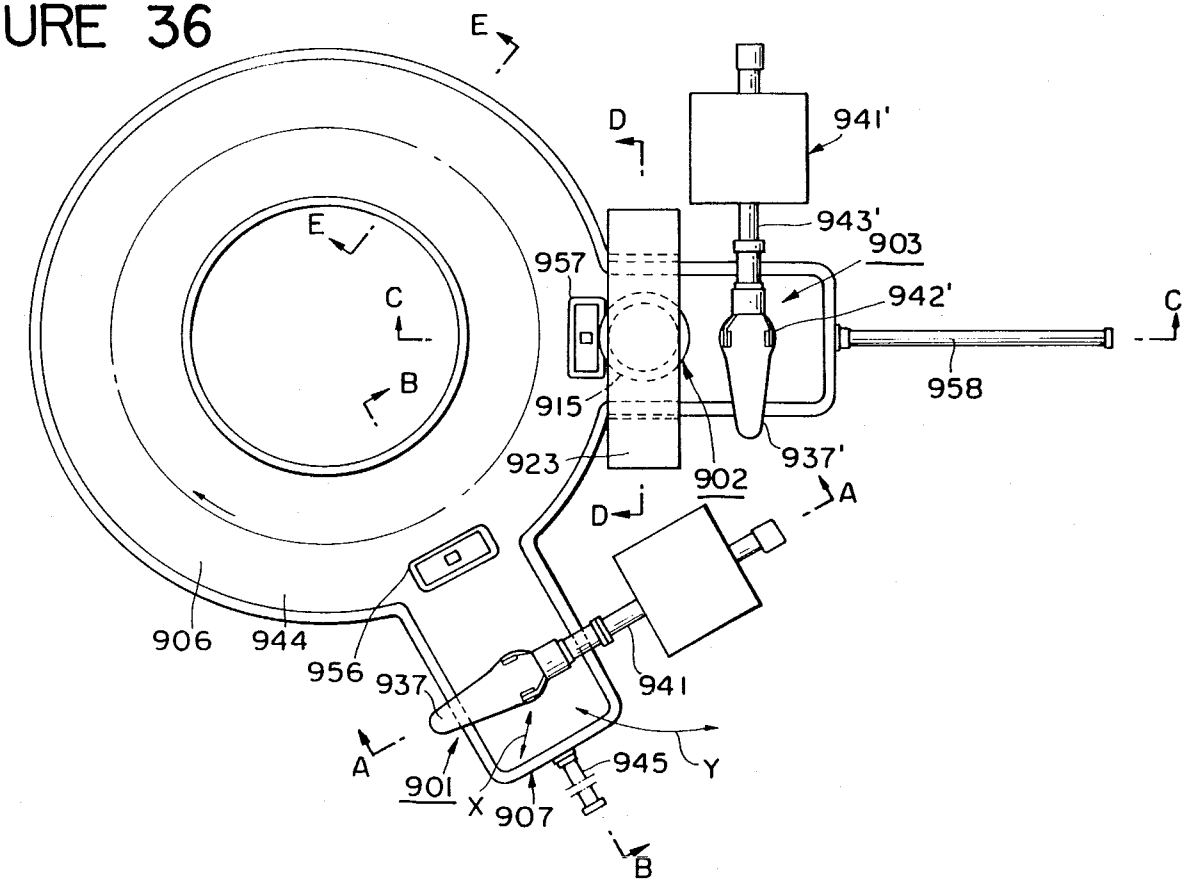

An embodiment shown in FIG. 35 is of a five-station type, in which a first station I serves as an inserting station for a new material 805 to be processed a second station II as a preheating station for applying preheating to the material 805 to be processed, a third station III as a pressing station by way of a high pressure vessel 802 for a preheated material 805 to be processed, a fourth station IV as a cooling station for immediately cooling the material 805 to be processed pressed in the third station III, and a fifth station V as a removing station for a material 805 to be processed cooled in the fourth station IV. The construction of a preheating chamber 811 and a cooling operating chamber 811 in the second and fourth stations II and IV is the same as that of the third and fourth embodiments previously described. Needless to say, also in this embodiment, a press cycle of insertion, preheating, pressing, cooling and removal of a material 805 to be processed progress smoothly, accurately and efficiently by a pair of transfer shafts 823 and disengageable pawls 826 and vertically movable opening and closing covers 808.

While in the above-described embodiments, the inlets and outlets 802*a*, 811*a* for the material 805 to be processed in the stations I to IV are all open downwardly, it should be noted that these can be reversed in direction so that the transfer equipment is positioned at the upper portion.

According to the invention (III), in pressing as well as other operations required for material 805 to be processed of metal as well as various other materials to be processed, the pair of transfer shafts 823 provided within the operating space 815*a* closed by the sealed tank 815, the disengageable pawls 826 to arranged in a fixed spaced relation with the transfer shafts, the plurality of operating stations I–IV by operating steps positioned with the transfer shafts 823 placed therebetween, and the in- and outlets 802*a*, 811*a* for the material to be processed in said stations I–IV are used, and the group of opening and closing covers 808 provided with supporting construction (such as base seats 807) for the material to be processed are provided, whereby the successive automatic transfer of the material to be processed between the stations can be accomplished extremely effectively. Moreover, such transfer is carried out within the closed operating space 815*a* which is isolated from outside and under the vacuum, active or inert gas atmosphere, as necessary, and therefore, material 805 to be processed formed of material which is laibale to be changed in surface or quality by the temperature and environmental atmosphere can be transferred under safe and stabilized conditions. In this case, the supporting construction of a material 805 to be processed is added to the opening and closing cover 808 itself to impart axial movement and rotation to the pair of transfer shafts 823 whereby the transfer route is made to be the shortest route between the stations by their vertical movement and horizontal movement, and the automatic transfer thereof is effected with extreme high efficiency for obtainment of quick processing without dead time. Vertical movement and opening and closing of the opening and closing covers 808 within the operating chamber 811 in the stations are extremely advantageous in various operations because of the isolation under the atmosphere and thermoconditions which are the same as or different from that of the closed space 815*a*. Furthermore, the station equipment can be collectively provided in the sealed tank 15 according to the operating steps, and therefore, a series of necessary operations can be advantageously collected in a compact fashion. The scope of use of the apparatus is extremely great for those other than the hot isostatic pressing apparatus shown in the embodiments, and more particularly, the apparatus is excellent as the transfer equipment for a material to be processed of material which is liable to be affected by thermo-environment and atmospheric environment.

Invention (IV)

According to the invention (IV), in an inserting station 901, an opening of an operating chamber 931 is closed by a movable cover member 919, and under this state, a material 921 to be processed prior to processing carried by a manipulator 941 is inserted into the operating chamber 931 under a state in communication with the air.

Figure 37A:
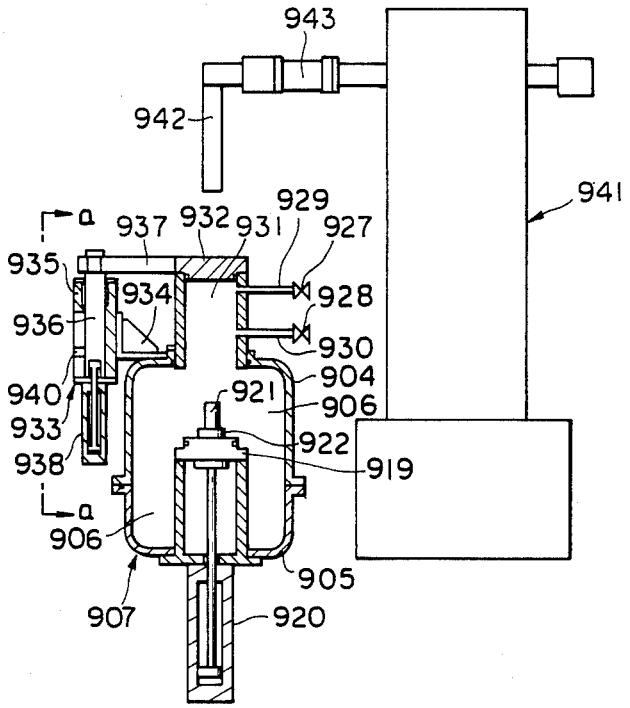
Figure 37B:
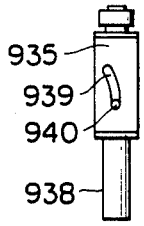

Thereafter, an opening and closing cover 932 is closed as shown in FIGS. 37(*a*) and 37(*b*) to thereby independently seal the operating chamber 931 to place it under the same atmosphere as that of a communication chamber 906 of a sealed tank 907, after which the movable cover member 919 is moved down by an elevating device 920 to be positioned within the communication chamber 906 of the sealed tank 907 for preparation of transfer with respect to a preheating furnace 944.

Figure 38:
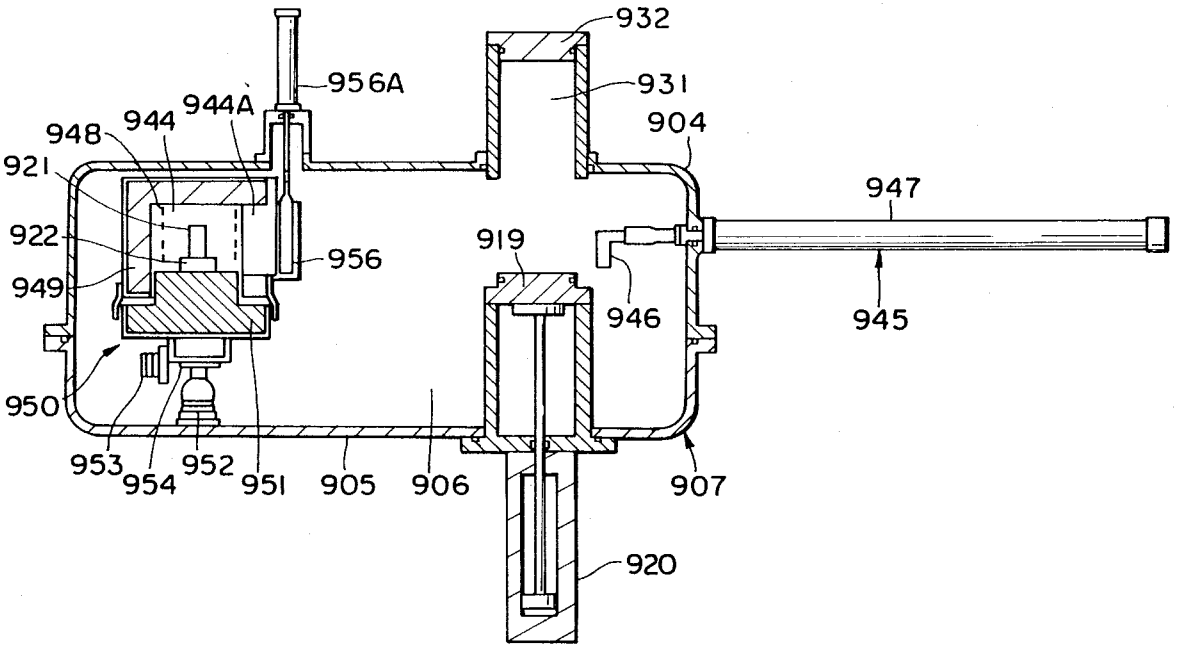

Then, a material 921 to be processed together with a supporting base 922 is fed to transfer means 950 of the preheating furnace 944 through the extending operation of transfer means 945 indicated as a manipulator, as shown in FIG. 38. This operation is repeatedly carried out whereby a plurality of materials 921 to be processed are placed on the transfer means 950 of the preheating furnace 944 for required preheating prior to pressing through energization of a heater 948.

In this preheating, radiant heat or the like is diffused into the communication chamber 906 of the sealed tank 907, and such heat is prevented from being filled in the operating chambers 931, 931' and high pressure vessel 915 by door means 956, 957 provided in communication portions between a main station 902 and the inserting station 901 of the preheating furnace 944.

Figure 39:
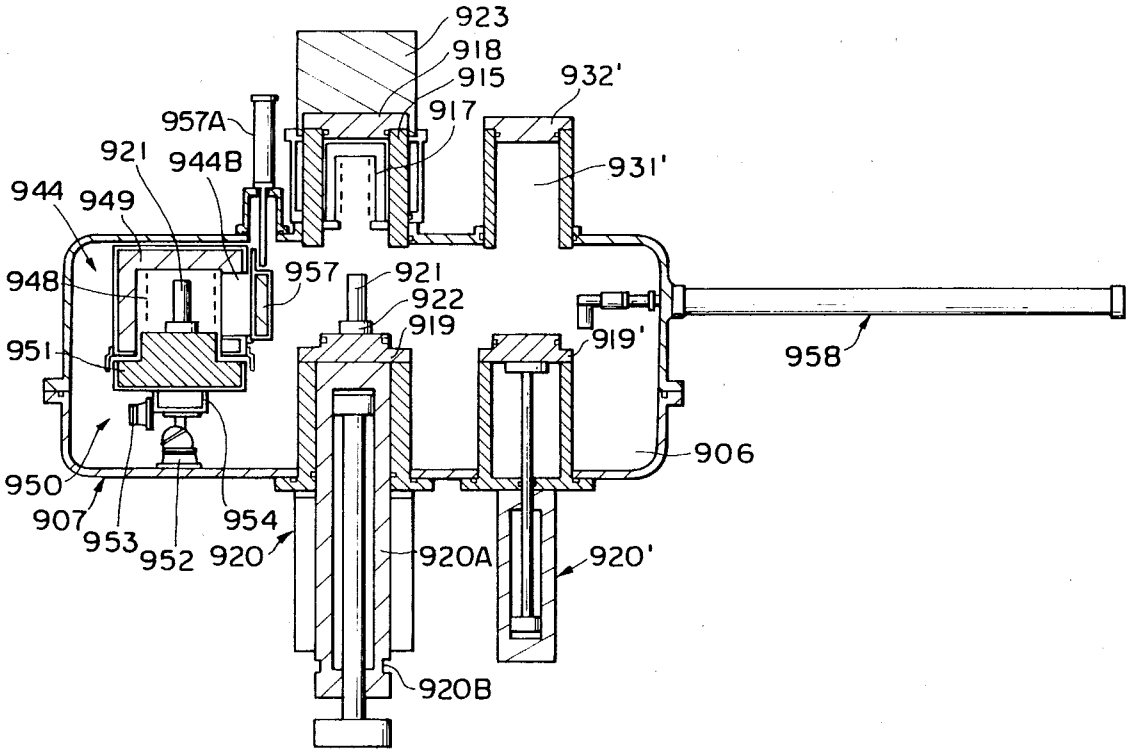
Figure 40:
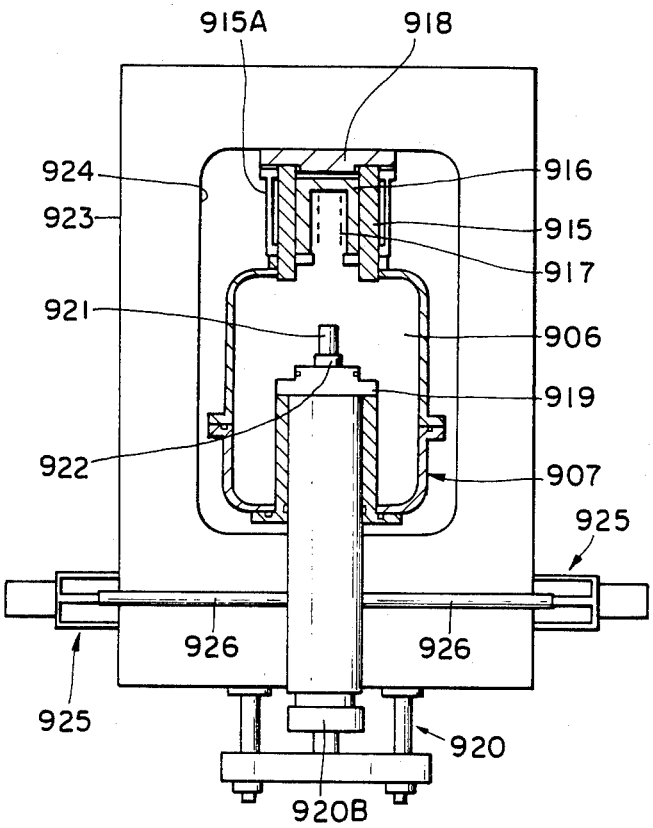
Figure 41:
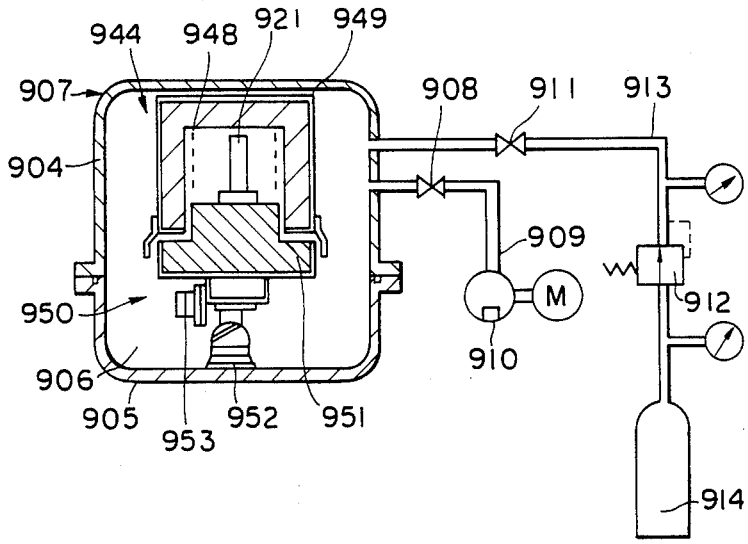
Figure 42:
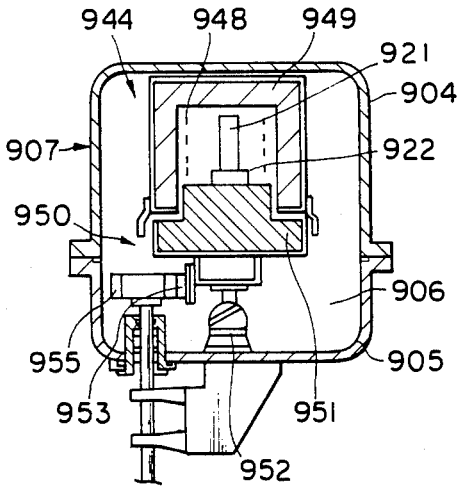

When the preheating operation of the materials 921 to be processed in the preheating furnace 944 is completed, the door means 957 is opened as shown in FIG. 39 and the materials 921 to be processed within the preheating furnace 44 together with the supporting base 922 are transferred by transfer means 958 indicated as a manipulator onto a movable cover member 919 placed corresponding to the lower portion of the high pressure vessel 915 in the main station 902, and the materials 921 to be processed are charged into the vessel 915 by raising the elevating device 920 at the same time the opening of the high pressure vessel 915 of the movable cover member 919 is closed.

Accordingly, under this state, the materials 921 to be processed are subjected to pressing by hot isostatic pressing by the heating of a heater 917 provided within the high pressure vessel 915 through a heat insulating layer, superhigh boosted pressure of fluid or gas medium sealed into the high pressure vessel 915 as is known, though not shown, and under the vacuum or, active or inert gas atmosphere within the high pressure vessel 915.

At this time, the communication chamber 906 of the sealed tank 907 can be placed under the same atmosphere as the environmental atmosphere within the high pressure vessel 915, whereby the cycle time can be considerably shortened without waiting until a temperature is lowered to a heater oxidizing preventive temperature after termination of pressing in the vessel 915.

The already processed materials 921 to be processed transported (delivered) to the removing station 903 are charged into the independent operating chamber 931' at the same time the operating chamber 931' of the movable cover member 919' is closed by raising the elevating device 920', and the cover 932' is opened to remove the materials to be processed under the atmospheric state. In this case, a plurality of materials 921 to be processed are prepared and stored in the preheating furnace 944, and the preheated materials 921 to be processed are continuously transferred to the main station 902 provided with the high pressure vessel 915 for pressing and cooling after pressing, and the materials are finally removed.

In an arrangement wherein a cooling furnace 960 is provided within the sealed tank 907 between the main station 902 and the removing station 903, the speeds of transfer means 959 of the cooling furnace 960 and transfer means 950 of the preheating furnace 944 are adjusted to provide preheating time and cooling time most suitable for material and shape and the like of materials to be processed 921.

EMBODIMENTS OF THE INVENTION (IV)

Embodiment 1

FIGS. 36 to 42 show a first embodiment according to a first aspect of the invention (IV).

Hereinafter, a series of operations in the first embodiment will be schematically described.

Materials 921 to be processed are inserted into the operating chamber 931 in the inserting station 901; the opening and closing cover 932 of the operating chamber 931 is closed to exchange of the atmosphere thereof into the same atmosphere as that of the communication chamber 906 of the sealed tank 907; the materials 921 to be processed are held through the downward movement of the movable cover member 919; the materials 921 to be processed are transferred to the preheating furnace 944 by the transfer means 945; the door means 956, 957 are closed; the preheating furnace is preheated by the heat generated by the heater 948; the materials 921 to be processed are transferred to the main station; are inserted into the high pressure vessel 915 through the movable cover member 919; the press axial force is clamped by the press frame 923 or the like; the materials 921 to be processed are subjected to hot isostatic pressing within the high pressure vessel 915; are moved down through the movable cover member 919; are transferred to the removing stations 903; are inserted through the movable cover member 919 into the operating chamber 931'; the operating chamber 931' is brought into communication with the atmosphere to remove materials to be processed 921; the operating chamber 931' is closed by the opening and closing cover 932' to exchange the atmospheric gas into the same atmosphere as that of the sealed tank 907; and the movable cover member 919' is moved down.

Embodiment 2

Figure 43:
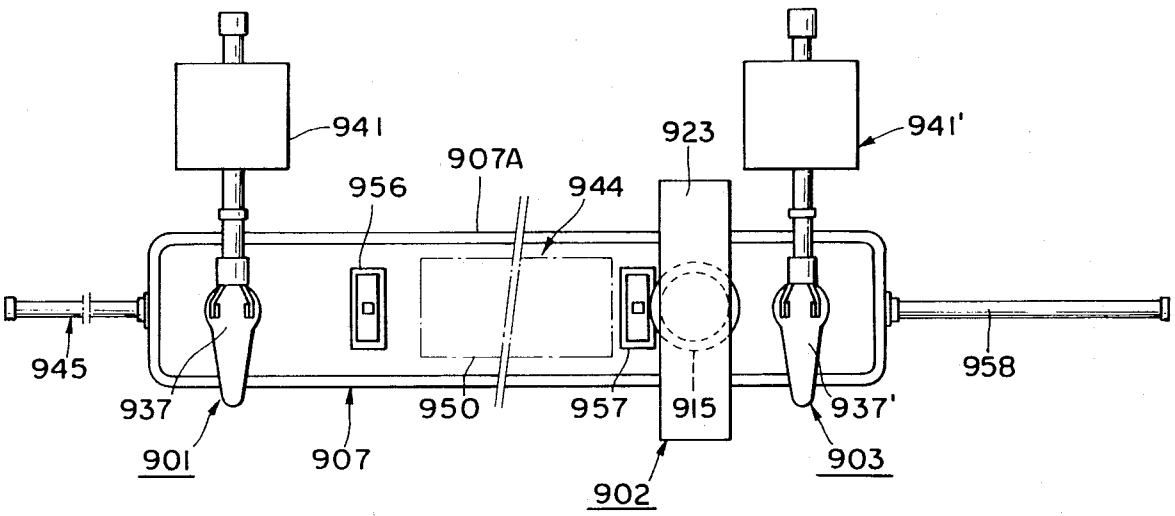

FIG. 43 shows a second embodiment, in which a sealed tank 907 between an inserting station 901 and a main station 902 is of a straight passage type, and a preheating furnace 944 having transfer means 950 such as a coveyor is housed in the straight passage 907A, and other constructions are the same as those of the above-mentioned first embodiment.

Embodiment 3

Figure 44:
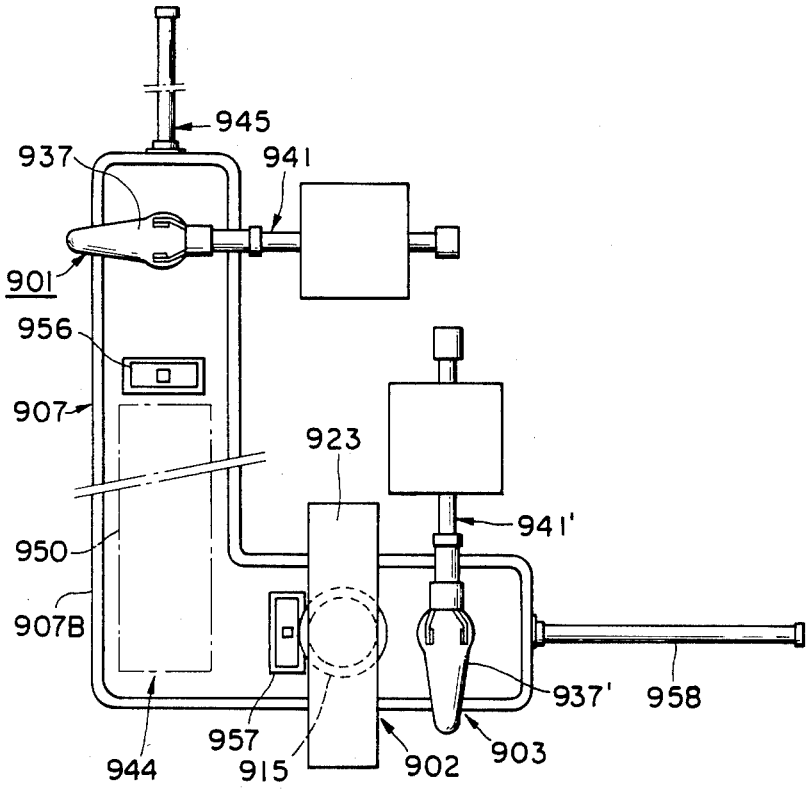

FIG. 44 shows a third embodiment, in which a sealed tank 907 between an inserting station 901 and a main station 902 is of a so-called L-shaped curved passage type 907B, and a preheating furnace having transfer means such as a conveyor is housed in the curve passage portion 907B, and other constructions are the same as those of the first and second embodiments as described above.

It will be once again noted that the above-described Embodiments 2 and 3 are also in accordance with the first aspect of the invention (IV).

Embodiment 4

FIGS. 45 to 48 show embodiments according to a second aspect of the invention (IV), which is different from the above-described first embodiment in that a plurality of materials to be processed are accommodated within a communication chamber 906 of a sealed tank 907 between a main station 902 and a removing station 903, and a cooling furnace 960 having transfer means 959 for transferring them towards the inserting station 903 is additionally provided. Other basical structures are the same as those of the embodiments according to the first aspect of the invention (IV), and only the differences therebetween will be described hereinafter.

Figure 45:
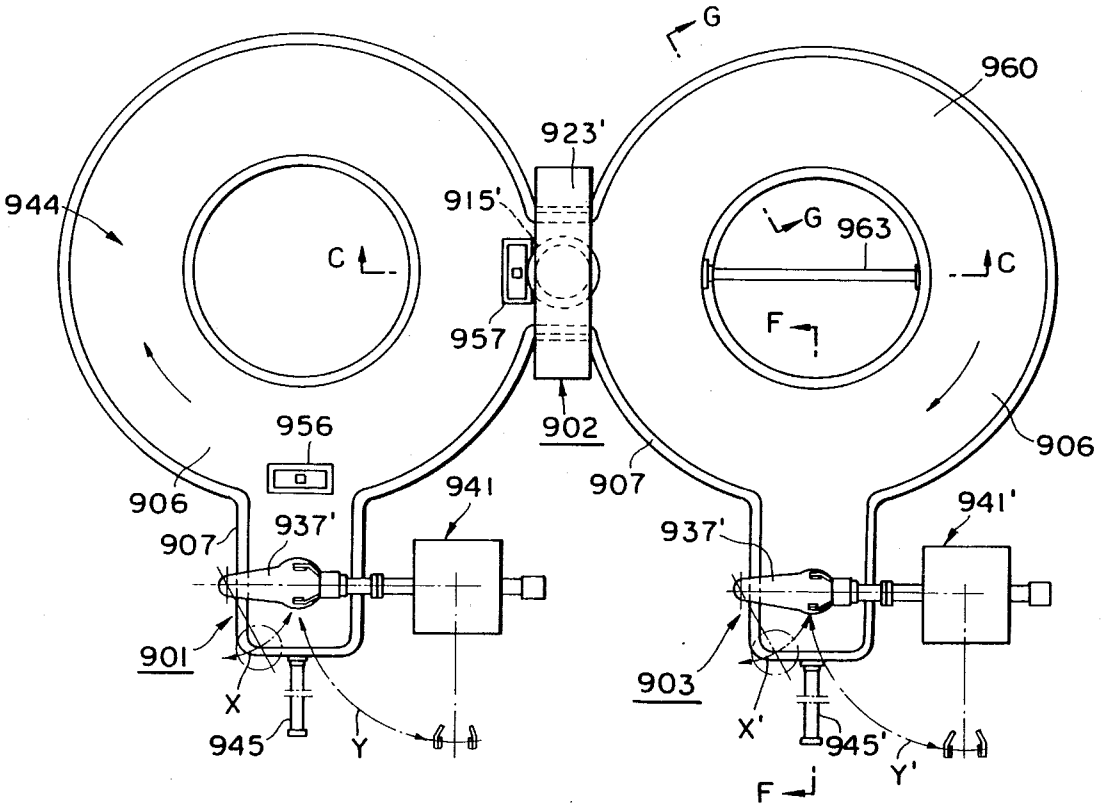

In FIG. 45, in a rotary type preheating furnace 944, rotary type cooling furnaces 960 are juxtaposed with HIP apparatus sandwiched therebetween, and transfer means 963 are provided comprising an openable chuck element 961 and a drive portion 962 for forward and backward movement thereof to transfer materials 921 to be processed from the preheating furnace 944 to the main station 902 and from the main station 902 to an inlet of the cooling furnace 960.

Figure 46:
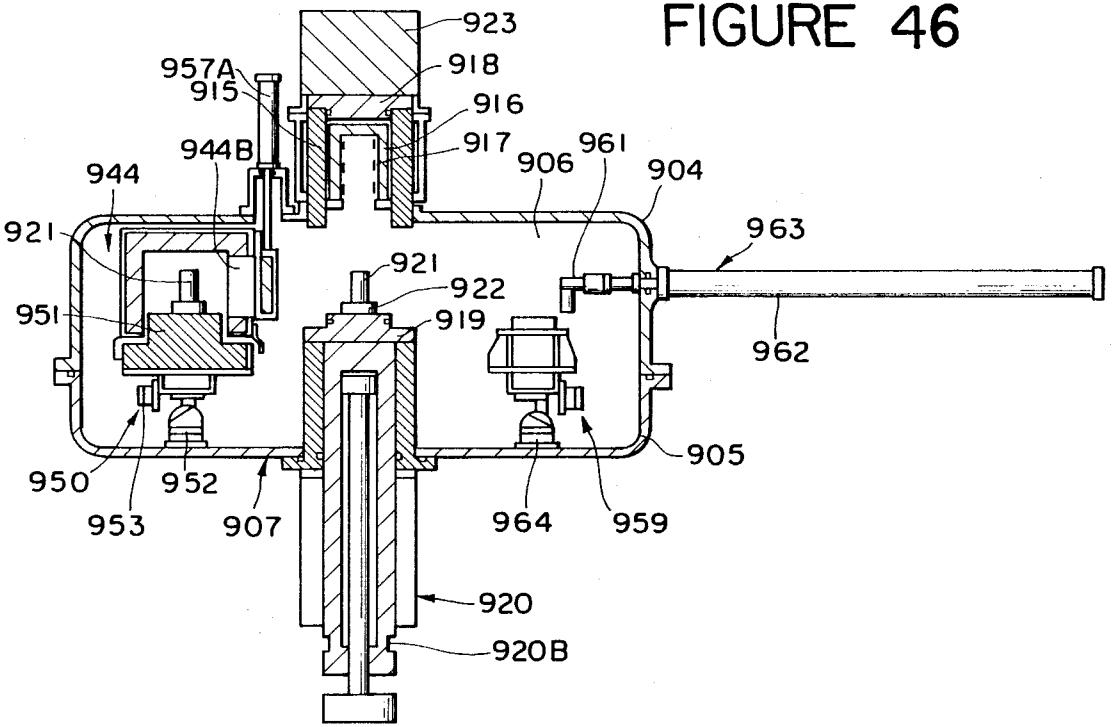
Figure 47:
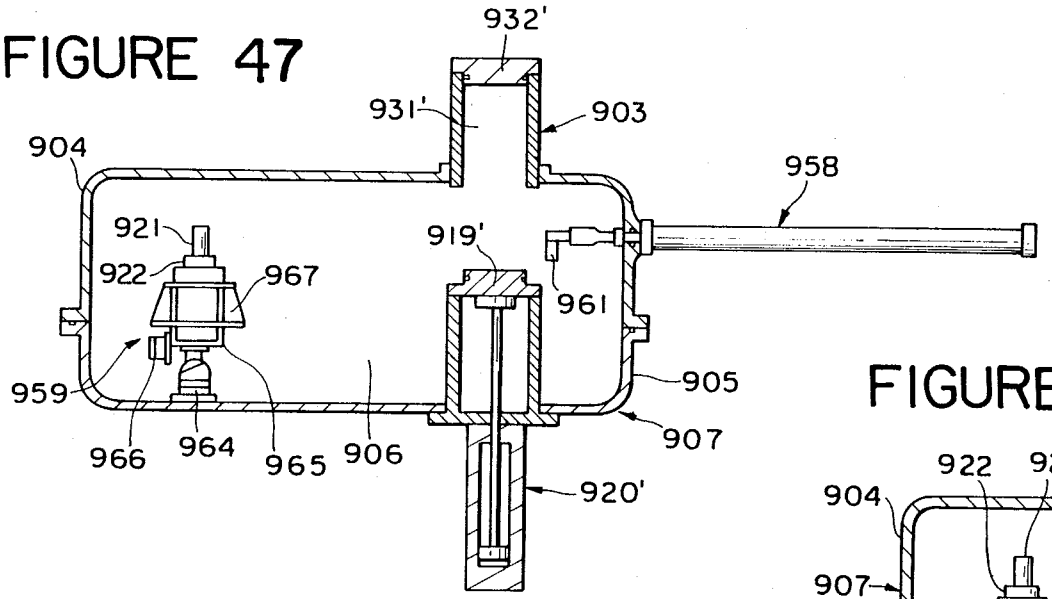
Figure 48:
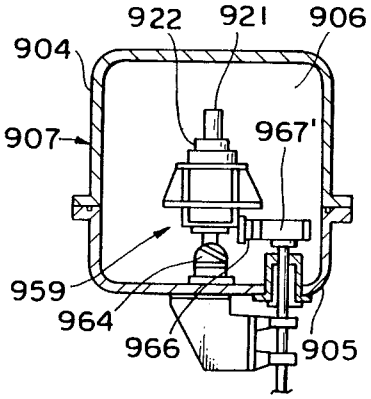
Figure 49:
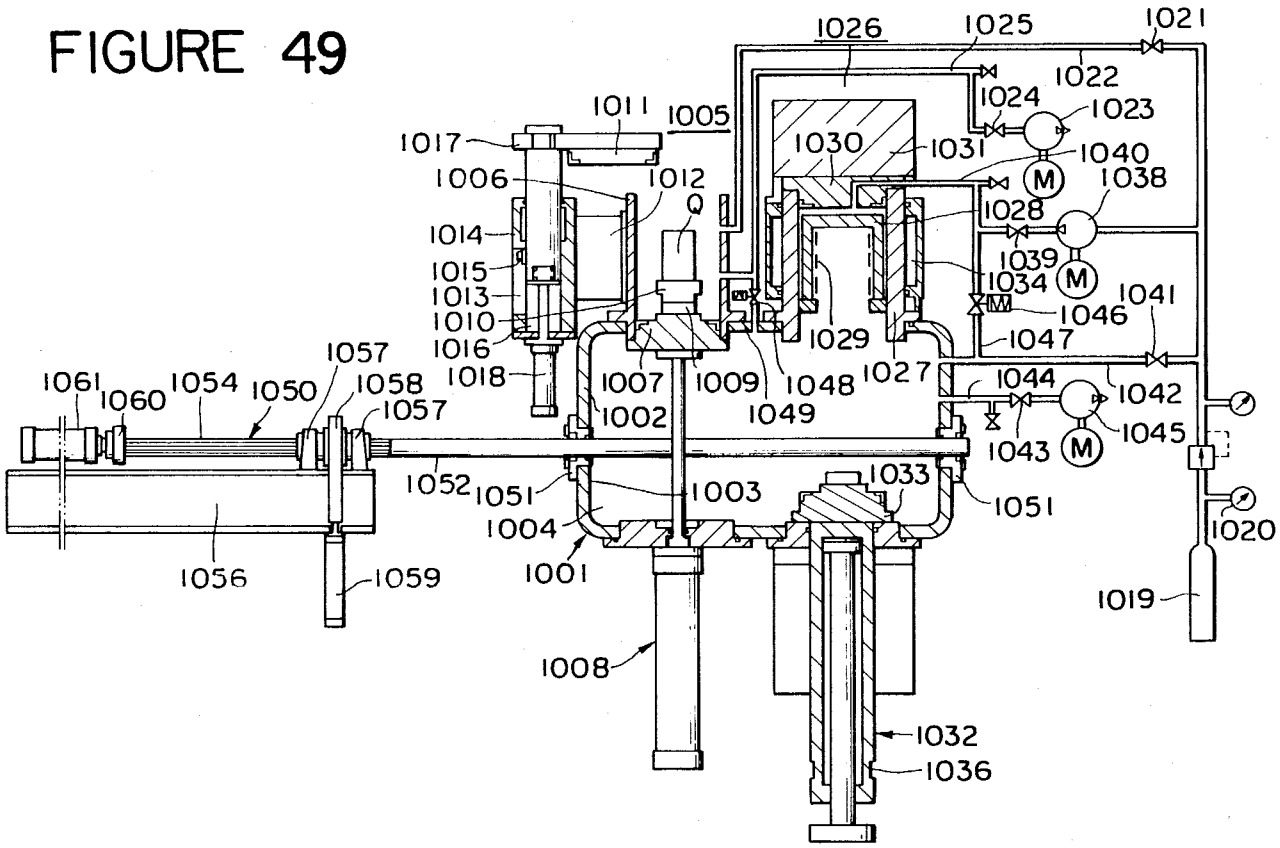
Figure 50:
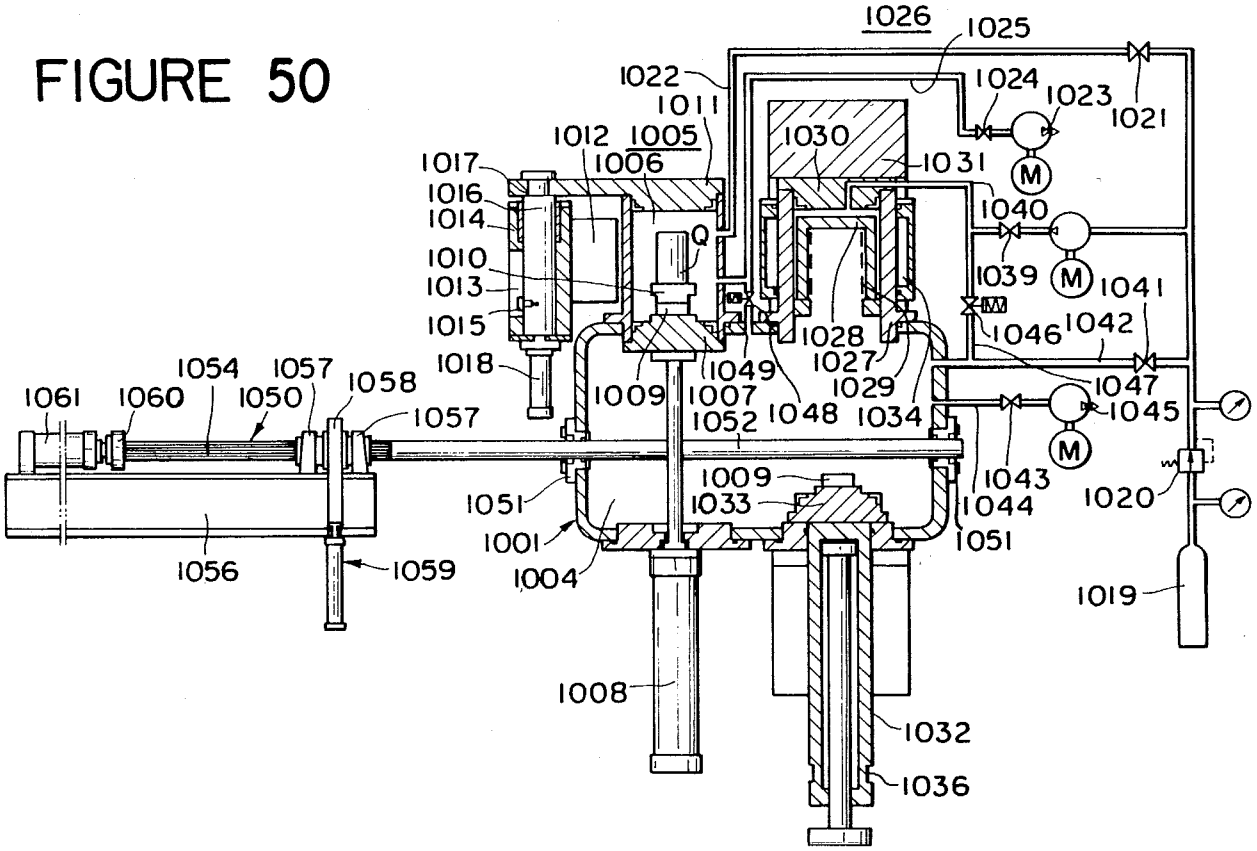
Figure 51:
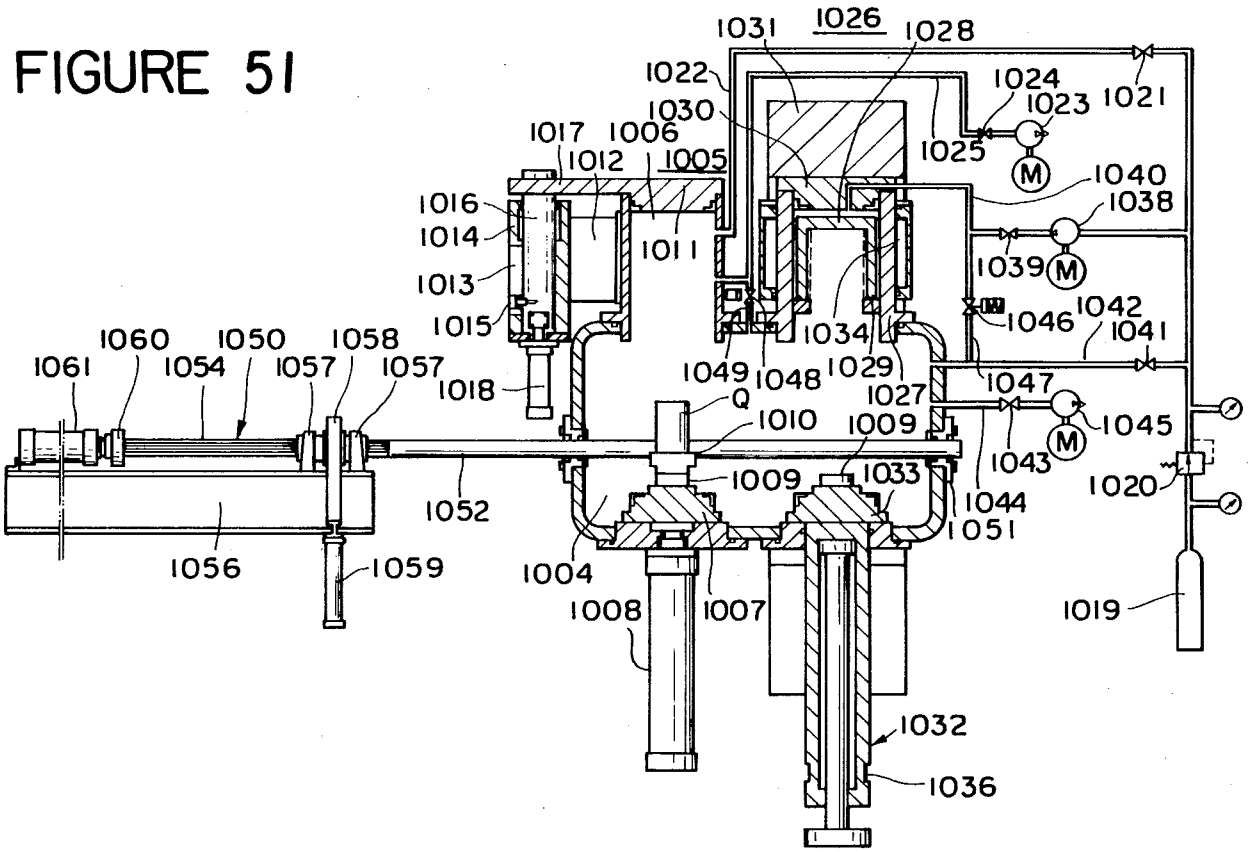
Figure 52:
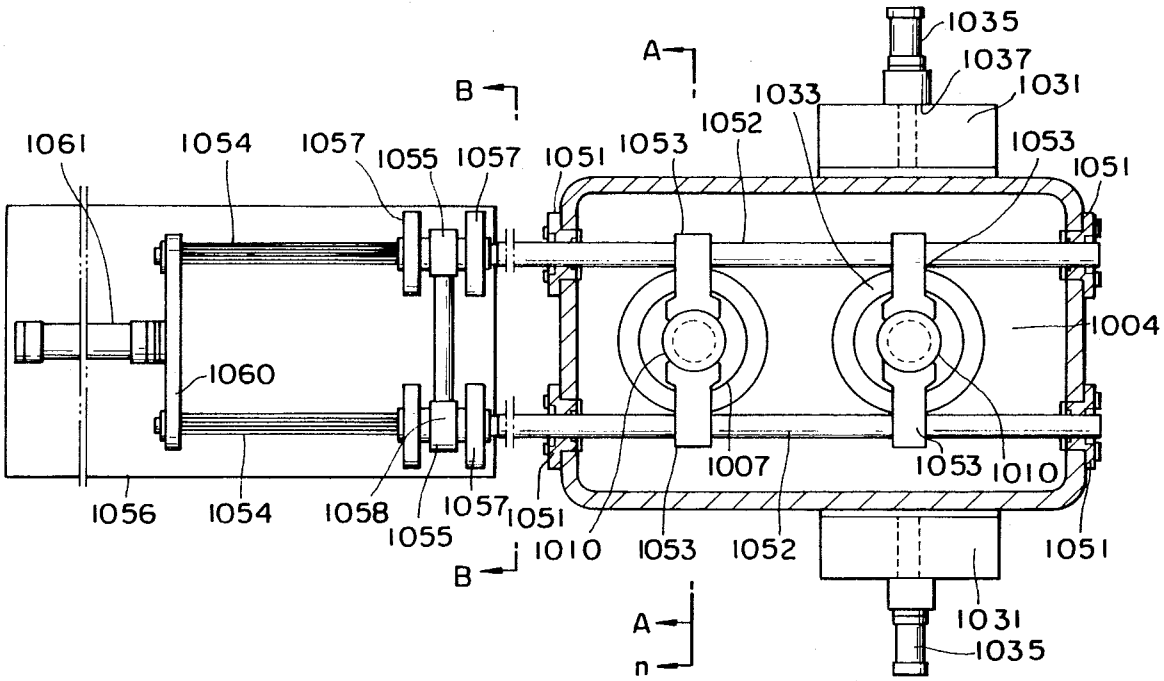
Figure 54:
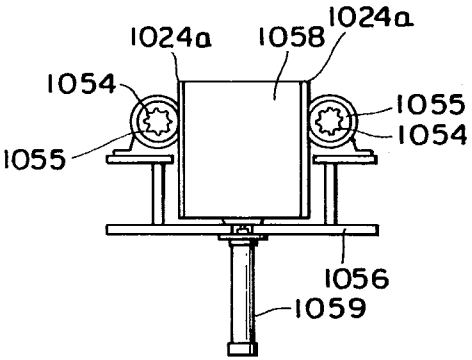
Figure 53:
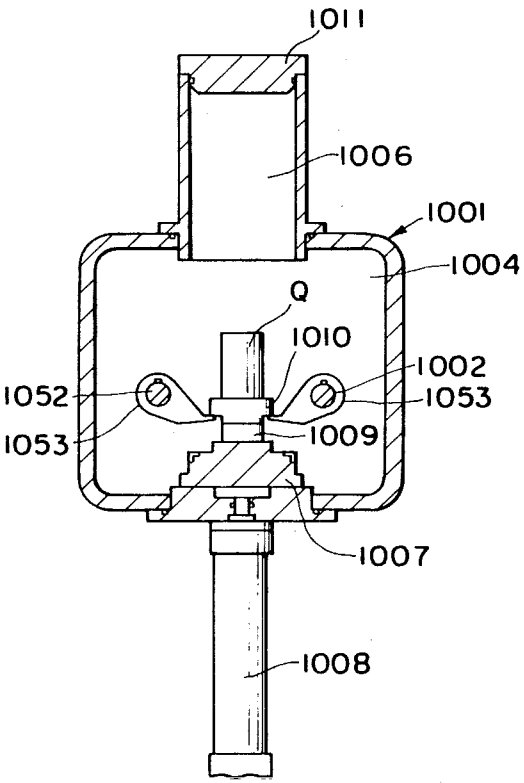

In the cooling furnace 960, a ring gear 966 is provided on a support base 965 rotatably mounted through a ring-like bearing 964 on the lower tank of the seled tank 907 as shown in FIGS. 46 to 48, and a rotatable table 967 is mounted on the support base 965. With this, in the illustrated embodiment, the transfer means 959 of the same construction as that of the transfer means 950 of the preheating furnace 944 described above is formed, and a pinion gear 967' is meshed with the ring gear 966.

Further, a plurality of materials 921 to be processed can be placed on the cooling furnace 960, the materials 921 to be processed are cooled within the sealed tank 907 during the transfer, and the materials 921 to be processed already cooled are transferred to the removing station 903 through the transfer means 958.

Accordingly, in the embodiment shown in FIG. 45, the steps of supplying the already preheated materials 921 to be processed to the main station 902 to pressing the same are the same as those of the aforementioned first embodiment. This embodiment is different from the aforementioned first embodiment in that a step is incorporated of transferring the materials 921 to be processed to the cooling furnace 960 by the transfer means 959 between the main station 902 and the removing station 903 and cooling the materials 921 to be processed during the delivery thereof to the removing station 903.

It will be noted that the cooling furnace 960 is not limited to the rotary type as shown but can be of the straight passage type or curved passage type, as in the preheating furnace in the second and third embodiments.

According to the first aspect of the invention (IV), the internal spaces of the inserting station, main station and removing station are isolated from outside by the sealed tank having common communication portions and are brought into communication with each other, the operating chambers and high pressure vessels in the stations are closed and opened by the removable cover members, and the removal of the pressed materials to be processed may be effected without a waiting period as encountered heretofore by the vacuum or necessary gas atmospheric conditions of the sealed tank. Therefore, it is natural that the effects similar to those obtained by the invention (I) can be obtained.

In addition, the preheating furnace is provided on the so-called front surface of the main station, and the preheating furnace is capable of performing the anteprocessing of pressing in the main station, which can shorten the HIP processing cycle.

Particularly, in the preheating furnace, the materials to be processed can be gradually increased in temperature, and for example, in pressing ceramics which requires a long period of time for HIP processing prior to HIP processing, the cycle time can be shortened in the pre-preheating step.

Moreover, according to the second aspect of the invention (IV), in addition to the various advantages noted above, the cooling furnace is provided on the sealed tank between the main station and the removing station whereby processing suitable for the kind, shape and the like of materials to be processed by the adjustment of time period of the preheating furnace and cooling furnace can be made.

The aforesaid arrangement is suitable for pressing, for example, ceramics, ziroconia, high-speed steel, etc. which need be gradually cooled.

Invention (V)

EMBODIMENTS OF THE INVENTION (V)

Embodiment 1

Operation of a first embodiment of the invention (V) is carried out in manner similar to that of the inventions (I) and (II), and the details thereof will not be discussed.

In the first embodiment of the invention (V), an inserting station, a preheating station, a pressing station and a removing station are serially arranged in said order.

It will be noted that a cooling station can be provided between the pressing station and the removing station.

FIGS. 49 to 54 show a first embodiment of the invention (V), in which a sealed tank 1001 is composed of an upper tank 1002 and a lower tank 1003, and an internal communication chamber 1004 is isolated from outside.

An auxiliary station indicated at 1005 serves as an inserting and removing station. An operating chamber 1006 is airtightly provided in the upper tank 1002 of the sealed tank 1001, a cylinder type elevating device 1008 for moving up and down a movable cover member 1007 is provided, directly below the operating chamber 1006, on the lower tank 1003, and a moving member 1010 is placed on the movable cover member 1007 through a support base 1009.

An opening and closing cover indicated at 1011 is provided to open and close an upper opening of the operating chamber 1006. In this embodiment, a cylindrical member 1014 having a cam portion 1013 is mounted through a bracket 1012, a rod 1016 having a roller 1015 fitted in the cam portion 1013 is inserted into the cylindrical member 1014, and an opening and closing cover 1011 is mounted on the rod 1016 through an arm 1017. The rod 1016 is moved up and down by means of a turning cylinder 1018, and the arm 1017 is turned by the cam portion 1013 and roller 1015.

Accordingly, the operating chamber 1006 has its lower opening airtightly opened and closed by the movable cover member 1007 through the extension of the elevating device 1008, and the operating chamber 1006 has its upper opening airtightly opened and closed by the opening and closing cover 1011 through the extension of the turning cylinder 1018.

Gas from a gas cylinder 1019 can be supplied to the operating chamber 1006 through a passage 1022 via a reducing valve 1020, a stop valve 1021, and the like, and a passage 1025 having a stop valve 1024 is connected thereto through a vacuum pump 1023.

In a main station indicated at 1026, a high pressure vessel 1027 for hot isostatic pressing is airtightly mounted on the upper tank 1002 of the sealed tank 1001.

The vessel 1027 is interiorly provided with a heater 1029 through an inverted-cup shaped heat insulating member 1028, and upper and lower openings of the vessel 1027 are covered with cover members.

In this embodiment, an upper cover 1030 is supported on a press frame 1031 having a square opening, and a lower cover comprises a movable cover member 1033 which is mounted on the elevating device 1032 of the extension cylinder type so that it may be moved up and down.

Reference numeral 1034 designates a cooling chamber, and 1035 is a lock mechanism which is engageable with an engaging portion 1036 formed in a tube of the elevating device 1032. That is, when the lower opening of the vessel 1027 is airtightly covered by the movable cover member 1033 through the extension of the elevating device 1032, the rod 1037 of the lock mechanism 1035 is extended and engaged with the engaging portion 1036, whereby high pressure acting on the upper and lower cover members during pressing can be clamped through the press frame 1031.

Active or inert gas from the gas cylinder 1019 can be supplied to the high pressure vessel 1027 through the upper cover 1030 from a passage 1040 having a stop valve 1039 under pressing at high pressure by a compressor 1038.

Gas from the gas cylinder 1019 can be supplied to the sealed tank 1001 through a passage 1042 having a stop valve 1041 and can also be supplied thereto even under the vacuum state by the vacuum pump 1045 through a passage 1044 having a stop valve 1043. The sealed tank 1001 and high pressure vessel 1027 are short-circuited by a passage 1047 having an opening and closing valve 1046. The operating chamber 1006 and the sealed tank 1001 are likewise short-circuited and communicated through a passage 1049 having an opening and closing valve 1048.

A transfer mechanism indicated at 1050 is constructed as follows:

A pair of rods 1052 are horizontally slidably mounted on the sealed tank 1001 through bearings 1051, and pawls 1053 are provided on the rods 1052.

The rod 52 is formed with a spline 1054, and a pinion gear 1055 is placed on the spline 1054, each rod 1052 being slidably and rotatably supported on a mount base 1056 through a bearing 1057.

Further, a rack meshed with the pair of left and right pinion gears 1055 is provided so as to be movable up and down by a cylinder 1059, and a cylinder 1061 is mounted on an end plate 1060 of the rod 1052.

Accordingly, the pawls 1053 can be swung through the rack 1058 and pinion gears 1055 by the extension of the cylinder 1059, the moving member 1010 can be floated and placed on the support base 1009, and the pawls 1053 may be moved between the stations 1005 and 1026 by the extension of the cylinder 1061.

Embodiment 2

In a second embodiment, the aforementioned four stations are arranged on the same circumference. FIGS. 55 to 59 show the second embodiment of the invention (V). This second embodiment is different from the above-described first embodiment in that the sealed tank 1001 is annular and that the transfer means for a material Q to be processed is of a rotary type of a rotatable table. Therefore, only a difference between the first and second embodiments will be described.

Interiorly of the annular-shaped sealed tank 1001 there is rotatably supported a ring-type rotatable table 1063 through inner and outer ring bearings 1062, and a gear 1064 is formed in the outer periphery of the rotatable table 1063.

A pinion gear 1065 is meshed with the gear 1064, the pinion gear 1065 being driven through a normal and reverse motor 1066 mounted on the upper tank 1002.

The rotatable table 1063 is formed with holes 1067 arranged corresponding to the stations 1005, 1026 to allow upward and downward movement of the elevating devices 1008, 1032.

Figure 55:
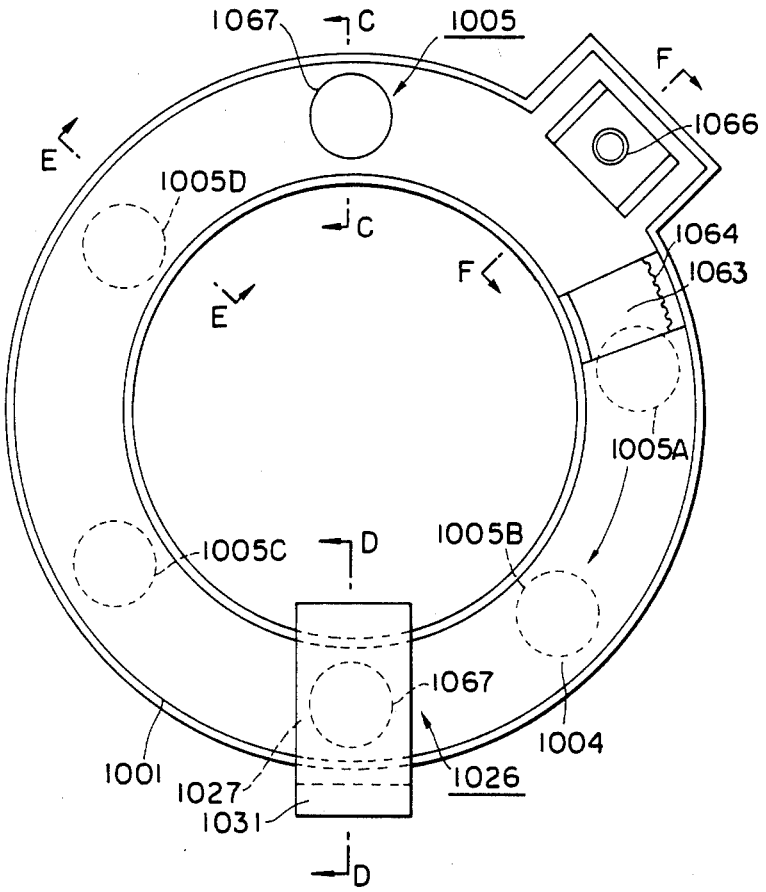
Figure 56:
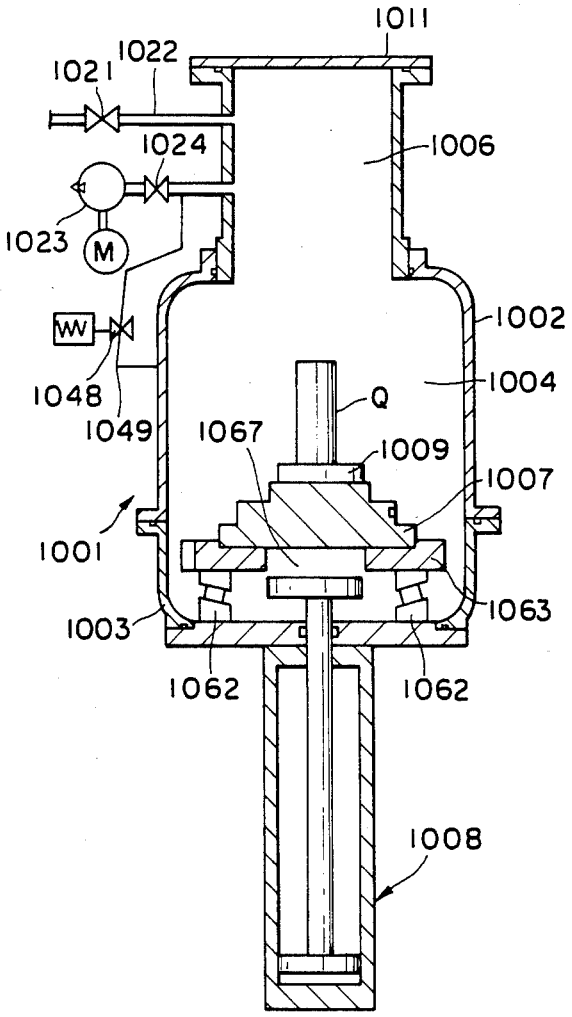
Figure 57:
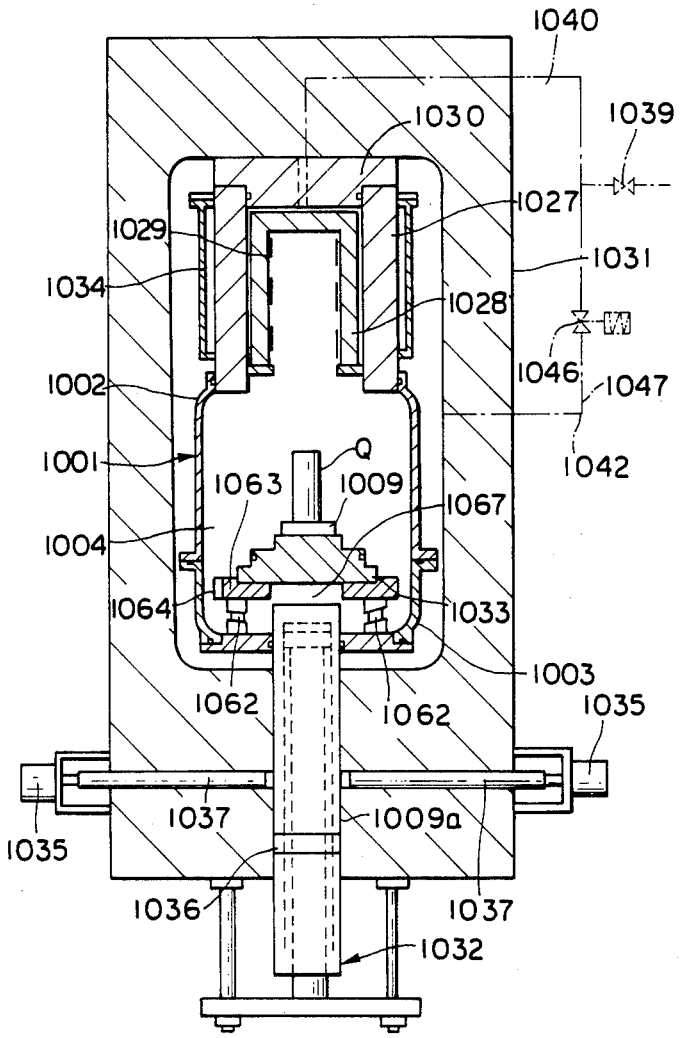
Figure 58:
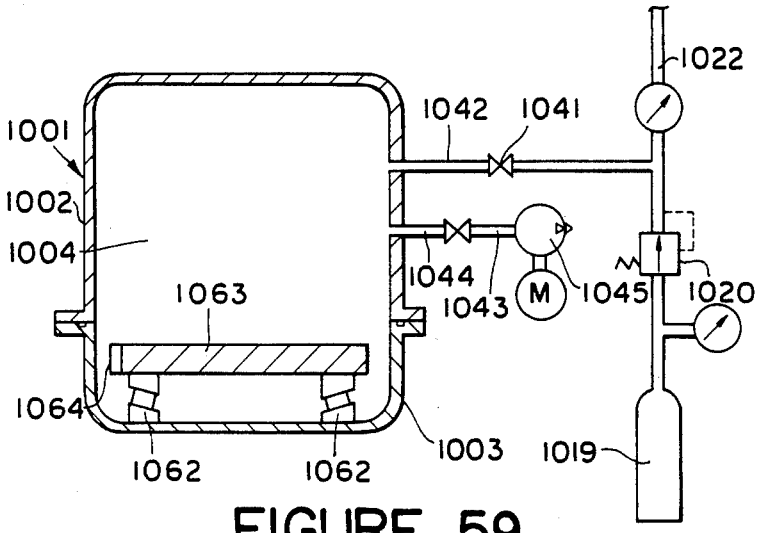
Figure 59:
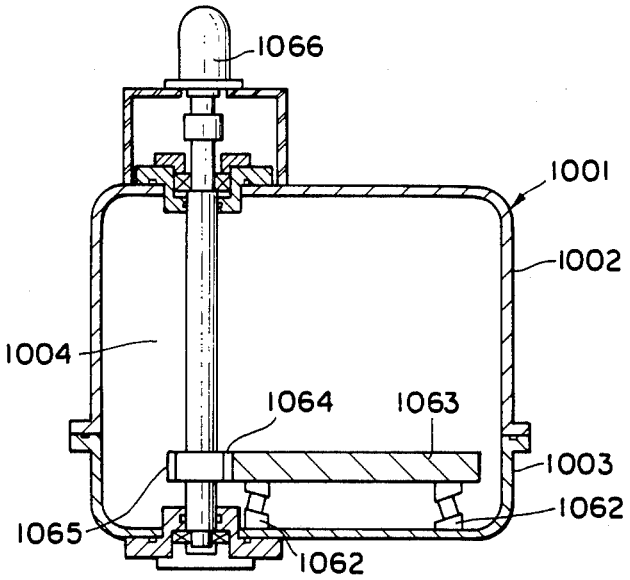

As illustrated in FIG. 55, an inserting station 1005A, a preheating station 1005B, a cooling station 1005C and a removing station 1005D, which constitute the auxiliary station 1005, can be arranged radially at an equal pitch angle together with the main station 1026, as previously mentioned. In this case, particularly, the operating chamber of the preheating station 1005B and the sealed tank 1001 are communicated with each other by the short-circuit passage 1049 having the opening and closing valve 1048.

According to the first and second embodiments of the invention (V), the aforementioned effects can be obtained.

Invention (VI)

EMBODIMENTS OF THE INVENTION (VI)

Embodiment 1

The embodiments of the invention (VI) are applied to a rotary type continuous hot isostatic pressing apparatus.

FIGS. 60 to 63 show a first embodiment of the invention (VI).

Figure 61:
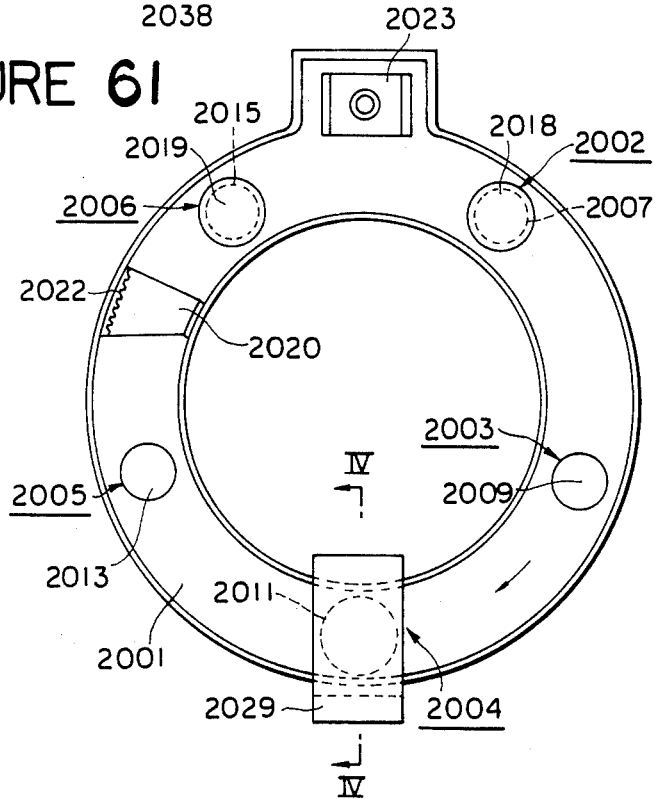
Figure 62:
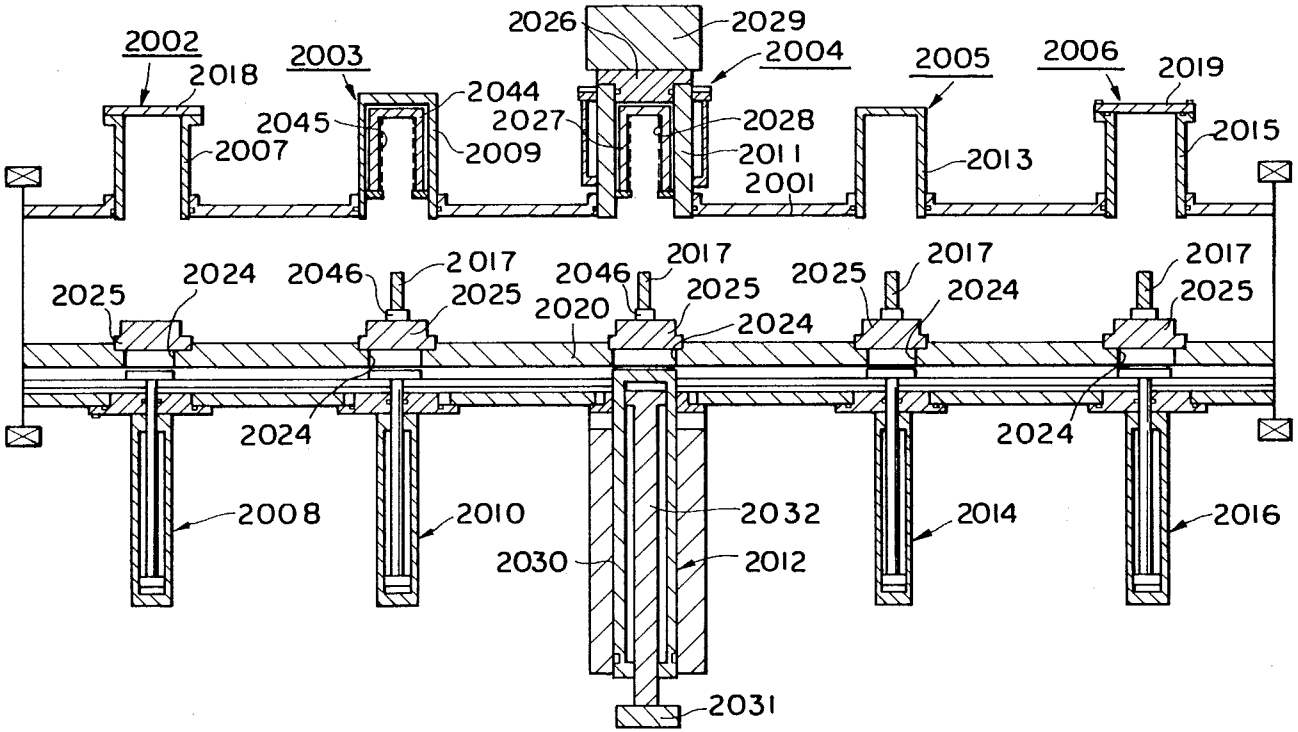

In FIGS. 61 and 62, reference numeral 2001 designates an annular sealed tank. An inserting station 2002, a preheating station 2003, a pressing station 2004, a cooling station 2005 and a removing station 2006 are arranged on the sealed tank 2001 in a peripherally equally spaced relation. Vertically corresponding to the sealed tank 2001 are provided an inserting vessel 2007 and an elevating device 2008 in the inserting station 2002; a preheating vessel 2009 and an elevating device 2010 in the pressing station 2003; a high pressure vessel 2011 and an elevating device 2012 in the pressing station 2004; a cooling vessel 2013 and an elevating device 2014 in the cooling station 2005; and a removing vessel 2015 and an elevating device 2016 in the removing station 2006, respectively. Lower ends of the vessels 2007, 2009, 2011, 2013 and 2015 are brought into communication with the sealed tank 2001, and the inserting vessel 2007 and removing vessel 2015 have opening and closing covers 2018, 2019 mounted thereon so that a material 2017 to be processed may be inserted and removed from the top.

Figure 63:
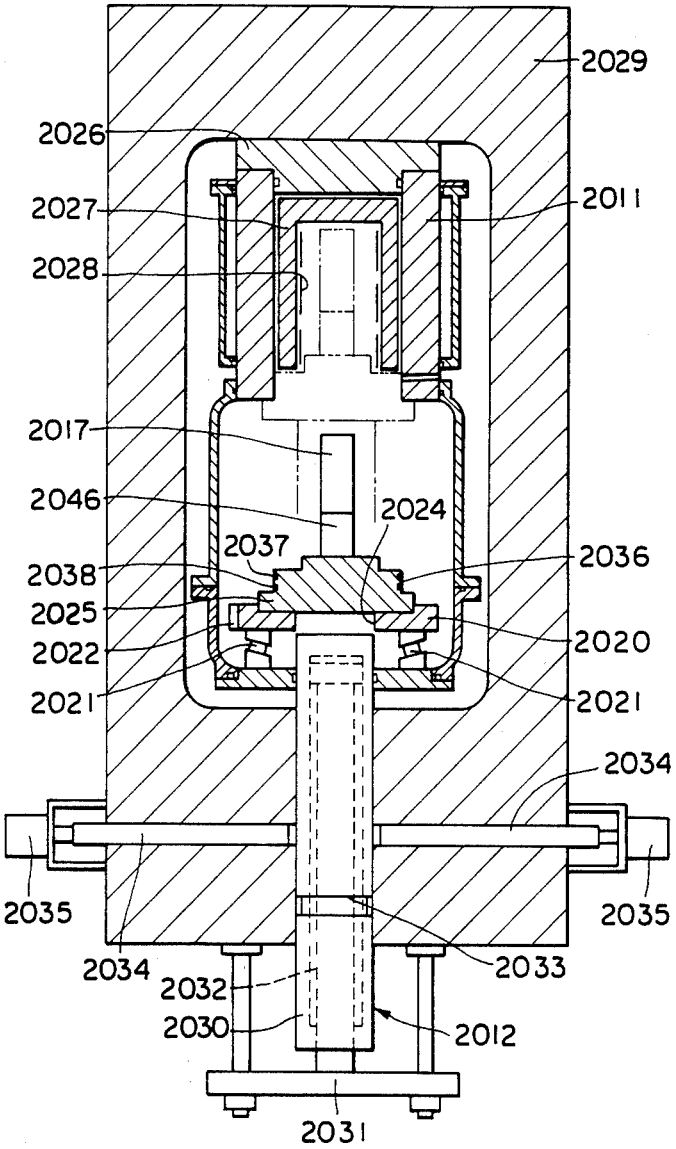

An annular rotatable table indicated at 2020 is rotatably supported within the sealed tank 2001 through a bearing 2021, as shown in FIG. 63, and is intermittently rotated by a motor 2023 through a pinion meshed with a ring gear 2022 formed in the outer circumference thereof. The rotatable table 2020 is formed with holes 2024 corresponding to the pitch of each station 2002–2006, and movable covers 2025 are placed over the holes 2024, respectively, said movable covers 2025 each being fitted in lower openings of vessels 2007, 2009, 2011, 2013 and 2015.

The high pressure vessel 2011 of the pressing station 2004 has a fixed upper cover 2026 as shown in FIG. 63, and has a heat insulating layer 2027, a heater 2028 and the like provided therein, said upper cover 2026 being placed in contact with a rectangular frame-like press frame 2029. The elevating device 2012 comprises a cylinder 2030 vertically slidably provided on the press frame 2029, and a piston rod 2032 slidably fitted in the cylinder 2030 and secured to the press frame 2029 through a bracket 2031. The cylinder 2030 is clamped by a pair of clamp pins 2034 engaged with and disengaged from an engaging groove 2033 in the form of a peripheral groove. The crank pins 2034 are driven forward and backward by a fluid cylinder 2035.

Figure 60:
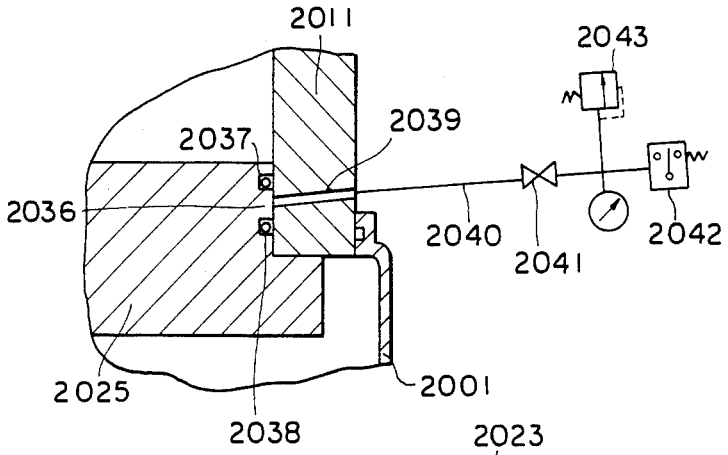

In each of the movable covers 2026, as shown in FIG. 60, a fitting portion 2036 is formed stepwise which fits into a lower opening of each of the vessels 2007, 2009, 2011, 2013, 2015 from the bottom, and two seal members 2037, 2038 are fitted in the outer periphery of the fitting portion 2036 in a vertically spaced relation. The seal members can be more than three in number. On the other hand, the high pressure vessel 2011 is formed at the lower end with a communication hole 2039 so as to be communicated with the exterior from a middle portion of two seal members 2037, 2038, and a pressure switch 2042 is connected in a communicating fashion to the communication hole 2039 through a pipe 2040 and a stop valve 2041. If pressure, for example, of 0.3 $kgf/cm^2$ or so acts on the pressure switch 2042 as a result of a gas leakage caused by a damage of seal members 2037, 2038, such a leakage is detected as being abnormal. The stop valve 2041 is designed to be opened only in the state wherein the movable cover 2025 is mounted on the vessel since a detector is actuated due to internal pressure of the sealed tank 2001 under the state wherein the movable cover 2025 is moved down as shown. Alternatively, the normally open type stop valve 2041 can be used to indicate "detection" only when the movable cover 2025 is mounted on the vessel through the electric interlocking. A safety valve 2043 for protection of the pressure switch 2042 is mounted on the pipe 2040.

A heat insulating layer 2044 and a heater 2045 are provided also within the preheating vessel 2009. Reference numeral 2046 designates a receiving base for a material 2017 to be processed.

Embodiment 2

FIGS. 64 and 65 show a second embodiment of the invention (VI).

In FIG. 64, a cylinder 2047 and a limit switch 2048 are used as a sensor for detection by making use of a pressure difference resulting from a difference of area of the piston 2049. More specifically, in this case, supposing that if pressure in a cylinder chamber 2050 of the cylinder 2047 is zero, it is considered to be normal, and pressure of about 1 $kgf/cm^2$ is maintained in the cylinder chamber 2051. If a gas leakage should occur, the piston 2049 and piston rod 2052 are moved according to a pressure difference and the limit switch 2048 is activated to detect a gas leakage.

If a differential transformer is used in place of the limit switch 2048, a continuous signal is obtained and therefore, occurrence of a leakage degree can also be detected. Reference numeral 2053 designates a safety valve, and 54 a reducing valve.

Alternatively, even if a float switch 55 as shown in FIG. 65 is used as a sensor, it is possible to detect a gas leakage directly.

While in the above-described embodiment, the case in connection with the high pressure vessel 2011 has been illustrated, it should be noted that operation can be practiced similarly also in connection with the inserting vessel 2007, preheating vessel 2009, cooling vessel 2013 and removing vessel 2015. However, in this case, these vessels 2007, 2009, 2013 and 2015 are used under the extremely low pressure, and therefore, maintenance of atmosphere of the sealed tank 2001 should be assured.

Obviously, numerous modifications and variations of the present invention are possible in light of the above teachings. It is therefore to be understood that within the scope of the appended claims, the invention may be practiced otherwise than as specifically described herein.

What is claimed is:

1. A continuous hot isostatic pressing apparatus comprising:

a hot isostatic press and a high pressure vessel having an open end, both being disposed at a main station of said apparatus;

at least one movable support member for supporting at least one work object to be pressed;

a main cover means for sealing said open end of said high pressure vessel and a main member attached to said main cover means for selectively receiving said at least one support member;

main station moving means disposed at said main station for selectively moving said main cover means into and out of sealing engagement with said open end of said high pressure vessel;

at least a first operating chamber having an open end and being disposed at a first auxiliary station of said apparatus;

first auxiliary cover means for sealing said open end of said first operating chamber and a first auxiliary member attached to said first auxiliary cover means for selectively receiving said at least one support member;

first auxiliary moving means disposed at said first auxiliary station for selectively moving said first auxiliary cover means into and out of sealing engagement with said open end of said first operating chamber;

a sealed tank, said open ends of said high pressure vessel and said first operating chamber being disposed therein, said sealed tank isolating said open ends of said high pressure vessel and said first operating chamber from an environment of said apparatus and communicating said open ends of said high pressure vessel and said first operating chamber in a common atmosphere when said main cover means and said first auxiliary cover means are removed therefrom; and a transfer device comprising a movable transfer member mounted on said sealed tank and means for moving said transfer member, said transfer device comprising means for engaging and disengaging said at least one support member and for moving said at least one support member between a position in which said support member rests on said first auxiliary member of said first auxiliary cover means and a position in which said support member rests on said main member of said main cover means.

2. The apparatus according to claim 1, further comprising a second auxiliary station for preheating said at least one work object and arranged adjacent to said main station, said second auxiliary station comprising a second operating chamber, one end of which is open for preheating said at least one work object, a movable cover member for opening and closing said open end, and a member attached to said movable cover member to move said at least one work object in and out of said open end, and wherein said first auxiliary station comprises a cooling auxiliary station.

3. The apparatus according to claim 1, further comprising a second auxiliary station arranged adjacent the main station such that said main station is positioned between said first and second auxiliary stations.

4. The apparatus according to claim 1, further comprising second and third auxiliary stations arranged adjacent the main station, and wherein one of said second and third auxiliary stations comprises a cooling auxiliary station for applying a cooling process as a post-process to said at least one work object after it has been pressed.

5. The apparatus according to claim 1, comprising second and third auxiliary stations arranged adjacent the main station, wherein said auxiliary stations comprise an inserting auxiliary station, a removing auxiliary station, and a preheating auxiliary station for applying preheating processing as a pre-processing step to said at least one work object prior to pressing.

6. The apparatus according to claim 1, further comprising second, third, and fourth auxiliary stations arranged adjacent the main station, wherein said auxiliary stations include a cooling auxiliary station and a preheating auxiliary station serially incorporated into a press cycle.

7. A rotary type continuous hot isostatic pressing apparatus comprising:

a hot isostatic press and a high pressure vessel having an open end, both being disposed at a main station of said apparatus;

at least a first operating chamber having an open end and being disposed at a first auxiliary station of said apparatus, said first operating chamber being provided with openable and closeable means for communicating an interior of said first operating chamber with an outside environment of said apparatus;

at least first and second cover means for sealing said open ends of said high pressure vessel and said first operating chamber, respectively, and first and second members attached to said first and second cover means for selectively receiving work objects to be pressed;

a sealed toroidal tank, said open ends of said high pressure vessel and said first operating chamber being disposed therein, said sealed tank isolating said open ends of said high pressure vessel and said first operating chamber from said outside environment of said apparatus and communicating said open ends of said high pressure vessel and said first operating chamber in a common atmosphere when said first and second cover means are removed therefrom;

an annular table arranged on the same circumference and disposed in said toroidal tank and having at least first and second holes therein, said first and second cover means being selectively disposed on said annular table when not in sealing relation with said open ends of said high pressure vessel and said first operating chamber;

means for driving said annular table in rotation within said tank so as to carry said cover means from one station to another; and at least first and second elevating devices respectively disposed at said first and main stations, said elevating devices being operable through said holes of said annular table to raise and lower said first and second cover means into and out of said sealing engagement with said high pressure vessel and said first operating chamber.

8. The apparatus according to claim 7, further comprising a second auxiliary station for preheating said work objects, at which are provided an operating chamber, one end of which is open and preheats said work objects, a movable cover member for opening and closing and open end of said operating chamber, and a member attached to said movable cover member to move said work objects in and out of said open end, and wherein said first auxiliary station comprises a cooling auxiliary station.

9. The apparatus according to claim 7, further comprising a second auxiliary station arranged in an equally spaced relation with said first auxiliary station on the same circumference with respect to the main station.

10. The apparatus according to claim 7, further comprising second and third auxiliary stations and wherein said second auxiliary station comprises an inserting station, said first auxiliary station comprises a cooling station and said third auxiliary station comprises a removing station arranged on the same circumference at intervals of 90°.

11. The apparatus according to claim 7, further comprising an inserting auxiliary station, a preheating auxiliary station and a removing auxiliary station.

12. The apparatus according to claim 7, further comprising second, third and fourth auxiliary stations arranged in combination with said first auxiliary station in an equally spaced relation at intervals of 72° on the same circumference with respect to the main station.

13. An apparatus for transferring a material to be processed in a closed operating space, said apparatus comprising:

a sealed tank defining a closed operating space;

a plurality of chambers having respective openings in communication with said closed operating space, said chambers being disposed serially along a side of said sealed tank at a respective plurality of operating stations of said apparatus;

a plurality of cover means for selectively sealing said openings of said plurality of chambers and for carrying work objects to be processed into and from said chambers, said cover means, when in a non-sealing position, being disposed serially along another side of said tank in positions corresponding to said openings of said plurality of chambers;

moving means for selectively moving said covers in said closed operating space into and from sealing and non-sealing positions with respect to said openings of said chambers;

a pair of transfer shafts extending longitudinally within said sealed tank and being disposed between said plurality of chambers and said plurality of covers when said covers are in said non-sealing positions, each said transfer shaft being mounted for extension and retraction and for rotation;

gripping pawls disposed on said transfer shafts for moving the work objects from one operating station to another, said pawls being disposed at positions corresponding to each said operating station except a final operating station when said transfer shafts are in a retracted position; and means disposed externally of said sealed tank for extending and retracting said transfer shafts and for rotating said transfer shafts for operation of said pawls.

14. The apparatus according to claim 13, wherein said plurality of stations further comprise an inserting station, a pressing station and a removing station.

15. The apparatus according to claim 13, wherein said plurality of stations further comprise an inserting and removing station, and a pressing station.

16. The apparatus according to claim 13, wherein said plurality of stations further comprise an inserting station, a pressing station, a cooling station and a removing station.

17. The apparatus according to claim 13, wherein said stations further comprise an inserting station, a preheating station, a pressing station and a removing station.

18. The apparatus according to claim 13, wherein said stations further comprise an inserting station, a preheating station, a pressing station, a cooling station and a removing station.

19. A continuous hot isostatic pressing apparatus comprising:

a hot isostatic press and a high pressure vessel having an open end, both being disposed at a main station of said apparatus;

a first operating chamber having an open end and being disposed at an inserting station of said apparatus at which work objects to be processed are introduced into said apparatus;

a second operating chamber having an open end and being disposed at a removing station of said apparatus at which the work objects are removed from said apparatus;

moveable cover means disposed at each of said inserting, removing and main stations for receiving the work objects to be pressed and for sealing said open ends;

moving means disposed at said inserting, removing and main stations for moving said moveable cover means into and out of respective positions of engagement with said first and second operating chambers and said high pressure vessel, whereby said work objects are moved into and out of said respective first and second operating chambers and said high pressure vessel;

a sealed tank, said open ends of said high pressure vessel and said first and second operating chambers being disposed therein, said sealed tank isolating said open ends from an outside environment of said apparatus and communicating said open ends in a common atmosphere when said cover means are removed from said positions of engagement;

a tunnel-like preheating furnace disposed within said sealed tank between said inserting and main stations, said preheating furnace being sized to accommodate therein said work objects, there being door means disposed at first and second ends of said preheating furnace for selectively thermally isolating an interior of said preheating furnace from said common atmosphere in said sealed tank;

transfer means for transferring said work objects within said preheating furnace from said first to said second end; and transfer means for moving the work objects from the inserting station into the preheating furnace, for moving said work objects from the preheating furnace to the main station, and for moving the work objects from the main station to the removing station within the sealed tank.

20. The apparatus according to claim 19, further comprising a communication chamber of said sealed tank forming a cooling furnace disposed between said main station and said removing station, said cooling furnace having transfer means for transferring said work objects, wherein said work objects are successively transferred from the inserting station to the preheating furnace, from the preheating furnace to the main station, from the main station to the cooling furnace, and from the cooling furnace to the removing station.

21. The apparatus according to claim 20, wherein said sealed tank is positioned between said inserting station and said main station and is a straight passage, wherein said transfer means within said preheating furnace comprises a conveyor housed in the straight passage.

22. The apparatus according to claim 20, wherein said sealed tank is positioned between said inserting station and said main station and is an L-shaped curved passage, wherein said transfer means within said preheating furnace comprises a conveyor housed in the curved passage.

23. A continuous hot isostatic pressing apparatus comprising:

a hot isostatic press and a high pressure vessel having an open end, both being disposed at a main station of said apparatus;

at least one operating chamber having an open end and being disposed at a first auxiliary station of said apparatus;

moveable cover means for sealing said open ends;

means for moving said moveable cover means into and out of respective positions of engagement with said open ends of said high pressure vessel and said at least one operating chamber;

a sealed tank, said open ends of said high pressure vessel and said at least one operating chamber being disposed therein, said sealed tank isolating said open ends from an outside environment of said apparatus and communicating said open ends in a common atmosphere when said cover means are removed from said positions of engagement;

transfer means disposed in said sealed tank for transferring a work object to be processed between said first auxiliary station and said main station, wherein said work object may be transferred from inside one of said high pressure vessel and said at least one operating chamber into the other while exposing said work object to said common atmosphere;

means for selectively drawing a partial vacuum within said sealed tank, said high pressure vessel and said at least one operating chamber;

means for providing a selected predetermined gaseous atmosphere in said sealed tank, said high pressure vessel and said at least one operating chamber;

passage means having a valve therein communicating said sealed tank and an interior of said high pressure vessel; and passage means having a valve therein communicating said sealed tank and an interior of said at least one operating chamber, wherein the atmosphere of said high pressure vessel and said at least one operating chamber may be selectively balanced with the atmosphere in said sealed tank prior to disengaging said cover means.

24. The apparatus according to claim 23, wherein the sealed tank is annular and the transfer means further comprises a rotary type transfer means.

* * * * *